US012767365B2

(12) United States Patent
Keller

(10) Patent No.: US 12,767,365 B2
(45) Date of Patent: Oct. 20, 2026

(54) STRAPPING TOOL WITH A SEALING-CYCLE-INTERRUPT OPERATING MODE

(71) Applicant: Signode Industrial Group LLC, Tampa, FL (US)

(72) Inventor: Andreas Keller, Birr (CH)

(73) Assignee: Signode Industrial Group LLC, Tampa, FL (US)

( * ) Notice: Subject to any disclaimer, the term of this patent is extended or adjusted under 35 U.S.C. 154(b) by 130 days.

(21) Appl. No.: 18/837,355

(22) PCT Filed: Feb. 8, 2023

(86) PCT No.: PCT/US2023/062192
§ 371 (c)(1),
(2) Date: Aug. 9, 2024

(87) PCT Pub. No.: WO2023/158953
PCT Pub. Date: Aug. 24, 2023

(65) Prior Publication Data

US 2025/0162743 A1 May 22, 2025

Related U.S. Application Data

(60) Provisional application No. 63/268,142, filed on Feb. 17, 2022.

(51) Int. Cl.
*B65B 13/02* (2006.01)
*B65B 13/18* (2006.01)
(Continued)

(52) U.S. Cl.
CPC ..... *B65B 13/025* (2013.01); *B65B 13/187* (2013.01); *B65B 13/345* (2013.01); *B65B 57/08* (2013.01)

(58) Field of Classification Search
None
See application file for complete search history.

(56) References Cited

U.S. PATENT DOCUMENTS 1,891,239 A 12/1932 Ekern
1,984,652 A 12/1934 Ekern
(Continued)

FOREIGN PATENT DOCUMENTS

BR 112014014798 A2 6/2017
BR 112014015409 A2 6/2017
(Continued)

OTHER PUBLICATIONS

"International Search Report and Written Opinion", from corresponding International Patent Application No. PCT/US2023/062192, Jul. 17, 2023.
(Continued)

*Primary Examiner* — Chinyere J Rushing-Tucker
(74) *Attorney, Agent, or Firm* — Neal, Gerber & Eisenberg LLP

(57) ABSTRACT

A strapping tool configured to carry out a strapping cycle including tensioning and sealing cycles. During the tensioning cycle, the strapping tool drives a tensioning wheel to tension strap around a load. During the sealing cycle, the strapping tool attaches two overlapping portions of the strap to one another by pivoting opposing jaws from home positions to sealing positions to deform the strap before pivoting them back to their home positions to release it. When operated in a sealing-cycle-interrupt operating mode, the strapping tool pauses the sealing cycle after the jaws reach their sealing positions but before they return to their home positions to prevent the tool from being removed from the strap. When a release sensor is triggered responsive to the operator pulling a rocker lever to raise the tension wheel,
(Continued)

the strapping tool finishes pivoting the jaws back to their home positions to complete the sealing cycle.

19 Claims, 48 Drawing Sheets

(51) Int. Cl.
*B65B 13/34* (2006.01)
*B65B 57/08* (2006.01)

(56) References Cited

U.S. PATENT DOCUMENTS 2,007,002 A 7/1935 Porter
2,040,576 A 5/1936 Erich
2,076,276 A 4/1937 Porter
2,257,090 A 9/1941 Childress
2,336,264 A 12/1943 Leslie, II
2,661,030 A 12/1953 Crosby et al.
2,801,558 A 8/1957 Crosby et al.
2,915,003 A 12/1959 Crosby et al.
2,936,156 A 5/1960 Coupland
2,941,782 A 6/1960 Winkler
2,986,376 A 5/1961 Falck-Pedersen
3,028,885 A 4/1962 Leslie et al.
3,032,075 A 5/1962 Hall et al.
3,103,955 A 9/1963 Ericsson et al.
3,150,694 A 9/1964 Meier
3,206,167 A 9/1965 Armington
3,211,186 A 10/1965 Harold
3,249,131 A 5/1966 Lingle
3,284,049 A 11/1966 Haraden
3,319,666 A 5/1967 Victor et al.
3,360,017 A 12/1967 Vilcins
3,396,760 A 8/1968 Peter et al.
3,442,733 A 5/1969 Vilcins
3,442,734 A 5/1969 Ericsson
3,506,041 A 4/1970 Angarola
3,583,315 A 6/1971 Hebert
3,586,572 A 6/1971 Ericsson
3,654,033 A 4/1972 Angarola et al.
3,718,526 A 2/1973 Annis
3,769,859 A 11/1973 Sykes et al.
3,792,808 A 2/1974 Neff et al.
3,810,495 A 5/1974 Pack
3,844,317 A 10/1974 Angarola et al.
3,863,684 A 2/1975 Simmons
4,015,643 A 4/1977 Cheung
4,020,879 A 5/1977 Billett et al.
4,041,787 A 8/1977 Brundler
4,239,096 A 12/1980 Smilgys et al.
4,245,678 A 1/1981 Sansum
4,282,907 A 8/1981 Massion et al.
4,313,779 A 2/1982 Nix
4,356,845 A 11/1982 Kimbrough
4,450,032 A 5/1984 Wehr
4,488,926 A 12/1984 Rauch et al.
4,607,709 A 8/1986 Walser
4,718,522 A 1/1988 Frania et al.
5,078,185 A 1/1992 Angarola
5,632,851 A 5/1997 Young
5,653,095 A 8/1997 Stamm
5,689,943 A 11/1997 Wehr
5,881,855 A 3/1999 Putney et al.
5,916,108 A 6/1999 Drietz et al.
6,003,578 A 12/1999 Chang
6,109,325 A 8/2000 Chang
6,206,053 B1 3/2001 Hillegonds
6,308,760 B1 10/2001 Finzo et al.
6,328,087 B1 12/2001 Finzo et al.
6,338,375 B1 1/2002 Harada
6,415,712 B1 7/2002 Helland et al.
6,422,272 B1 7/2002 Crittenden
6,578,337 B2 6/2003 Scholl et al.
6,895,733 B2 5/2005 Nix
6,918,235 B2 7/2005 Nix
7,073,431 B1 7/2006 Chen
7,089,970 B2 8/2006 Bernard
7,155,885 B1 1/2007 Nasiatka et al.
7,497,068 B2 3/2009 Nasiatka et al.
7,857,560 B2 12/2010 Leggett et al.
8,387,523 B2 3/2013 Yang
8,567,310 B2 10/2013 Yi
9,085,070 B2 7/2015 Skonieczy et al.
9,272,799 B2 3/2016 Figiel et al.
9,284,080 B2 3/2016 Neeser et al.
9,315,283 B2 4/2016 Neeser et al.
9,346,572 B2 5/2016 Leppert
9,403,609 B2 8/2016 Bonifazi et al.
9,468,968 B2 10/2016 Figiel et al.
9,487,314 B2 11/2016 Finzo
9,586,708 B2 3/2017 Finzo
9,630,265 B2 4/2017 Figiel et al.
9,630,730 B2 4/2017 Leppert
9,932,135 B2 4/2018 Finzo et al.
10,183,769 B2 1/2019 Figiel et al.
10,308,383 B2 6/2019 Boss et al.
10,322,831 B2 6/2019 Nasiatka et al.
10,464,699 B2 11/2019 Figiel et al.
10,577,137 B2 3/2020 Nasiatka et al.
10,745,158 B2 8/2020 Sikora et al.
10,882,649 B2 1/2021 Rauch
11,053,034 B1 7/2021 Sikora et al.
11,084,610 B2 8/2021 Boss et al.
11,104,460 B2 8/2021 Neeser et al.
11,111,039 B2 9/2021 Yang
11,130,598 B2 9/2021 Sikora et al.
11,155,375 B2 10/2021 Keller et al.
11,174,051 B2 11/2021 Graef et al.
11,267,596 B2 3/2022 Finzo et al.
11,352,153 B2 6/2022 Keller et al.
11,492,157 B2 11/2022 Hochstrasser et al.
11,560,246 B2 1/2023 Neeser et al.
11,577,866 B2 2/2023 Nasiatka et al.
11,597,547 B2 3/2023 Finzo
11,667,417 B2 6/2023 Finzo et al.
11,999,516 B2 6/2024 Neeser et al.
2002/0139085 A1 10/2002 Kasel
2002/0179175 A1 12/2002 Finzo
2003/0230058 A1 12/2003 Nix
2004/0237806 A1 12/2004 Sickels
2005/0000586 A1 1/2005 Zeimetz et al.
2008/0219745 A1 9/2008 Bungert et al.
2010/0077810 A1 4/2010 De
2011/0056390 A1 3/2011 Neeser et al.
2011/0056391 A1 3/2011 Neeser et al.
2011/0056392 A1 3/2011 Neeser et al.
2011/0100233 A1 5/2011 Neeser et al.
2012/0210682 A1 8/2012 Gardner et al.
2013/0085053 A1* 4/2013 Figiel ..... B65B 13/025 493/84
2014/0060345 A1* 3/2014 Figiel ..... B21F 9/002 100/32
2014/0083311 A1 3/2014 Bonifazi et al.
2014/0290179 A1 10/2014 Keller
2015/0033959 A1 2/2015 Finzo
2015/0034206 A1 2/2015 Finzo
2015/0210411 A1 7/2015 Finzo et al.
2015/0246739 A1 9/2015 Finzo et al.
2015/0321777 A1 11/2015 Nasiatka et al.
2016/0107775 A1 4/2016 Amacker et al.
2016/0376041 A1 12/2016 Skonieczny, Jr. et al.
2017/0166335 A1 6/2017 Nasiatka et al.
2017/0174374 A1 6/2017 Figiel et al.
2018/0054033 A1 2/2018 Skonieczny et al.
2018/0127124 A1 5/2018 Sikora et al.
2019/0256233 A1 8/2019 Sikora et al.
2020/0339289 A1 10/2020 Finzo
2020/0339290 A1 10/2020 Finzo
2020/0354094 A1* 11/2020 Keller ..... B65B 13/34
2020/0377245 A1 12/2020 Sikora et al.
2021/0371143 A1 12/2021 Sikora et al.

(56) References Cited

U.S. PATENT DOCUMENTS

| | | | |
|---|---|---|---|
| 2022/0144463 | A1 | 5/2022 | Finzo et al. |
| 2023/0150704 | A1 | 5/2023 | Neeser et al. |

FOREIGN PATENT DOCUMENTS

| | | | |
|---|---|---|---|
| CN | 2346694 | Y | 11/1999 |
| CN | 1297270 | A | 5/2001 |
| CN | 1386675 | A | 12/2002 |
| CN | 1386676 | A | 12/2002 |
| CN | 1388040 | A | 1/2003 |
| CN | 201102638 | Y | 8/2008 |
| CN | 201411059 | Y | 2/2010 |
| CN | 101391661 | B | 6/2011 |
| CN | 102256875 | A | 11/2011 |
| CN | 105358432 | A | 2/2016 |
| CN | 110626539 | A | 12/2019 |
| CN | 110723340 | A | 1/2020 |
| DE | 929114 | C | 6/1955 |
| DE | 1185532 | B | 1/1965 |
| DE | 1973947 | U | 11/1967 |
| DE | 3525647 | A1 | 1/1987 |
| DE | 29507452.3 | U1 | 7/1995 |
| DE | 10026200 | A1 | 11/2001 |
| DE | 102009016302 | A1 | 10/2010 |
| EP | 0480627 | A1 | 4/1992 |
| EP | 0664256 | A1 | 7/1995 |
| EP | 0703146 | A1 | 3/1996 |
| EP | 0999132 | A1 | 5/2000 |
| EP | 1260441 | A1 | 11/2002 |
| EP | 1371560 | A1 | 12/2003 |
| EP | 1413519 | A1 | 4/2004 |
| EP | 1582463 | A2 | 10/2005 |
| EP | 3272659 | A1 | 1/2018 |
| EP | 3696102 | A1 | 8/2020 |
| EP | 3696103 | A1 | 8/2020 |
| EP | 3730415 | A1 | 10/2020 |
| GB | 896398 | A | 5/1962 |
| GB | 2098163 | A | 11/1982 |
| GB | 2185229 | A | 7/1987 |
| GB | 2185228 | B | 12/1987 |
| JP | S36020086 | Y | 8/1961 |
| JP | 01006555 | A | 1/1989 |
| JP | 2004018117 | A | 1/2004 |
| JP | 2006036252 | A | 2/2006 |
| JP | 2009250321 | A | 10/2009 |
| KR | 100943256 | B1 | 2/2010 |
| KR | 20100135275 | A | 12/2010 |
| TW | M258045 | U | 3/2005 |
| WO | 2009129634 | A1 | 10/2009 |
| WO | 2009129636 | A1 | 10/2009 |
| WO | 2019165142 | A1 | 8/2019 |
| WO | 2022015566 | A2 | 1/2022 |

OTHER PUBLICATIONS desmondttm123, https://forum.arduino.cc/t/convert-a-rotational-motor-to-a-linear-motor/163939 (Year: 2013).

"CB 130 Hand Tool for PP/PET Strapping Service For Internal Use Only", Cyklop GmbH, Aug. 2002 (indicated at p. 2), 39 pages.

"CB 130 Operating Manual Hand tool for PP/PET—strapping", Cyklop GmbH, Mar. 7, 2002 (indicated at p. 2), 22 pages.

"CB130 Operating Instructions—Hand Tool", Cyklop, available before the priority date of the present application.

"Cyklop CB130 Strapping Tool", available before the priority date of the present application and described in the internal "Service" document that to Applicant's knowledge was not publicly available before the priority date of the present application.

"Description of the Operating Sequence of the Cyklop CB 130 Tool", The Cyklop CB 130 Tool was publicly available before the priority date of the present application.

"Friction Weld—Battery Powered—CB 130", Polyester / Polypropylene Friction Weld Single-Handed Operation, Cyklop International, the CB-130 tool was publicly available before the priority date of the present application.

"Fromm Operation Manual / Spare Parts List", Battery—Powered Plastic Strapping Tool Model P331 M/HA, Fromm System GmbH, Mar. 6, 2014 (indicated at p. 1), 26 pages.

"Fromm Operation Manual/Spare Parts List", Battery—Powered Plastic Strapping Tool Model P328 M/HA, Fromm System GmbH, Mar. 6, 2014 (indicated at p. 1), 26 pages.

"Hand Tool CB 130 Operating Instructions", Cyklop GmbH, Mar. 7, 2002 (indicated at p. 2), 26 pages.

"ITA 85 Technical Sheet", located at www.itatools.com, available before the priority date of the present application.

"Itatools ITA 84 ITA 85 Battery Tools for Steel Automatic Function", posted by ITATOOLS1 at Youtube, located online at: https://www.youtube.com/watch?v=iYOPCKhGf2k, Sep. 2, 2021.

"Operating Instructions STR 64 Pneumatic Hand Tool For Steel Strapping", Orgapack GmbH, publicly available before the priority date of the present application.

"Operation Manual for Grippack 100/114 Sealers", Signode Industrial Group LLC, available before the priority date of the present application.

"Operation Manual for SLB Sealless Strapping Tool", Signode Industrial Group LLC, available before the priority date of the present application.

"Operation, Parts and Safety Manual PNSC-2 Pneumatic Combination Strapping Tool", Signode, publicly available before the priority date of the present application.

"Operation, Parts and Safety Manual RCNS2-34 RCNS2-114 Pistol-Grip Style Air Powered Sealers", Signode Engineered Products, publicly available before the priority date of the present application.

"OR-T 100 Operating and Safety Instructions", Orgapack, Battery-hand tool for plastic strapping, Nov. 2004.

"OR-T 120 Operating Instructions", Orgapack, Battery-operated hand tool for plastic strapping, Sep. 2012.

"OR-T 130, OR-T 260, OR-T 450 Operating Instructions", Orgapack, Battery-operated hand tool for plastic strapping, Mar. 2017.

"OR-T 200 Manual Battery-hand Tool for Plastic Strapping", Orgapack, available before the priority date of the present application.

"OR-T 250 Manual Battery-operated Hand Tool for Plastic Strapping", Orgapack, available before the priority date of the present application.

"OR-T 300 Operating and Safety Instructions", Orgapack, Battery-hand tool for plastic strapping, Mar. 2005.

"OR-T 400 Operating Instructions", Orgapack, Battery-hand tool for plastic strapping, Sep. 2009.

"OR-T 50 Operating and Safety Instructions", Orgapack, Hand tool for plastic strapping, May 2006.

"ORT 83 Operating Instructions", Orgapack, Hand tool for plastic strapping, Aug. 2000.

"OR-T 85 Operating Instructions", Orgapack, Hand tool for plastic strapping, Jun. 2000.

"OR-T 86 Operating Instructions", Orgapack, Hand tool for plastic strapping, Aug. 1999.

"OR-T 87 Operating and Safety Instructions", Orgapack, Hand tool for plastic strapping, May 2002.

"Service Manual Battery-Powered Plastic Strapping Tool Model P329", Fromm, available before the priority date of the present application.

"SIAT GT One User's Manual", M. J. Maillis Group, SIAT S.p.a, May 15, 2012 (indicated at p. 99); 102 pages.

First Office Action and Search Report with English Translation, from related Chinese Patent Application No. 202380020598.8, Jun. 11, 2026.

Zhang, et al., "Design of the Transmission System of Automatic Enlacing Machine", Journal of Chongqing Institute of Technology, No. 8, p. 60-62, Aug. 28, 2006.

* cited by examiner

STRAPPING TOOL WITH A SEALING-CYCLE-INTERRUPT OPERATING MODE

PRIORITY

This application is a national phase application of PCT/US2023/062192, filed on Feb. 8, 2023, which claims priority to and the benefit of U.S. Provisional Patent Application No. 63/268,142, filed Feb. 17, 2022, the entire contents of which is incorporated herein by reference.

FIELD

The present disclosure relates to strapping tools, and more particularly to strapping tools configured to tension strap around a load and to attach overlapping portions of the strap to one another to form a tensioned strap loop around the load.

BACKGROUND

Battery-powered strapping tools are configured to tension strap around a load and to attach overlapping portions of the strap to one another to form a tensioned strap loop around the load. To use one of these strapping tools to form a tensioned strap loop around a load, an operator pulls strap leading end first from a strap supply, wraps the strap around the load, and positions the leading end of the strap below another portion of the strap. The operator then introduces one or more (depending on the type of strapping tool) of these overlapped strap portions into the strapping tool and actuates one or more buttons to initiate: (1) a tensioning cycle during which a tensioning assembly tensions the strap around the load; and (2) after completion of the tensioning cycle, a sealing cycle during which a sealing assembly attaches the overlapped strap portions to one another (thereby forming a tensioned strap loop around the load) and during which a cutting assembly cuts the strap from the strap supply.

How the strapping tool attaches overlapping portions of the strap to one another during the sealing cycle depends on the type of strapping tool and the type of strap. Certain strapping tools configured for plastic strap (such as polypropylene strap or polyester strap) include friction welders, heated blades, or ultrasonic welders configured to attach the overlapping portions of the strap to one another. Some strapping tools configured for plastic strap or metal strap (such as steel strap) include jaws that mechanically deform (referred to as "crimping" in the strapping industry) or cut notches into (referred to as "notching" in the strapping industry) a seal element positioned around the overlapping portions of the strap to attach them to one another. Other strapping tools configured for metal strap include punches and dies configured to form a set of mechanically interlocking cuts in the overlapping portions of the strap to attach them to one another (referred to in the strapping industry as a "sealless" attachment).

SUMMARY

Various embodiments of the present disclosure provide a strapping tool configured to carry out a strapping cycle including a tensioning cycle and a sealing cycle. During the tensioning cycle, the strapping tool drives a tensioning wheel to tension strap around a load. During the sealing cycle, the strapping tool attaches two overlapping portions of the strap to one another by pivoting opposing jaws from respective home positions to respective sealing positions to deform the strap—such as by cutting notches into two overlapping portions of the strap—before pivoting the jaws back to their home positions to release the strap. When operated in a sealing-cycle-interrupt operating mode, the strapping tool pauses the sealing cycle after the jaws reach their sealing positions but before the jaws return to their home positions to trap the strap between the jaws. This prevents the strapping tool from being inadvertently removed from the strap, such as by falling off of the strap if the operator releases the strapping tool during the strapping cycle. When a release sensor is triggered responsive to the operator pulling a rocker lever to raise the tension wheel, the strapping tool finishes pivoting the jaws back to their home positions to complete the sealing cycle and enable the strapping tool to be removed from the strap.

DETAILED DESCRIPTION

Figure 1A:
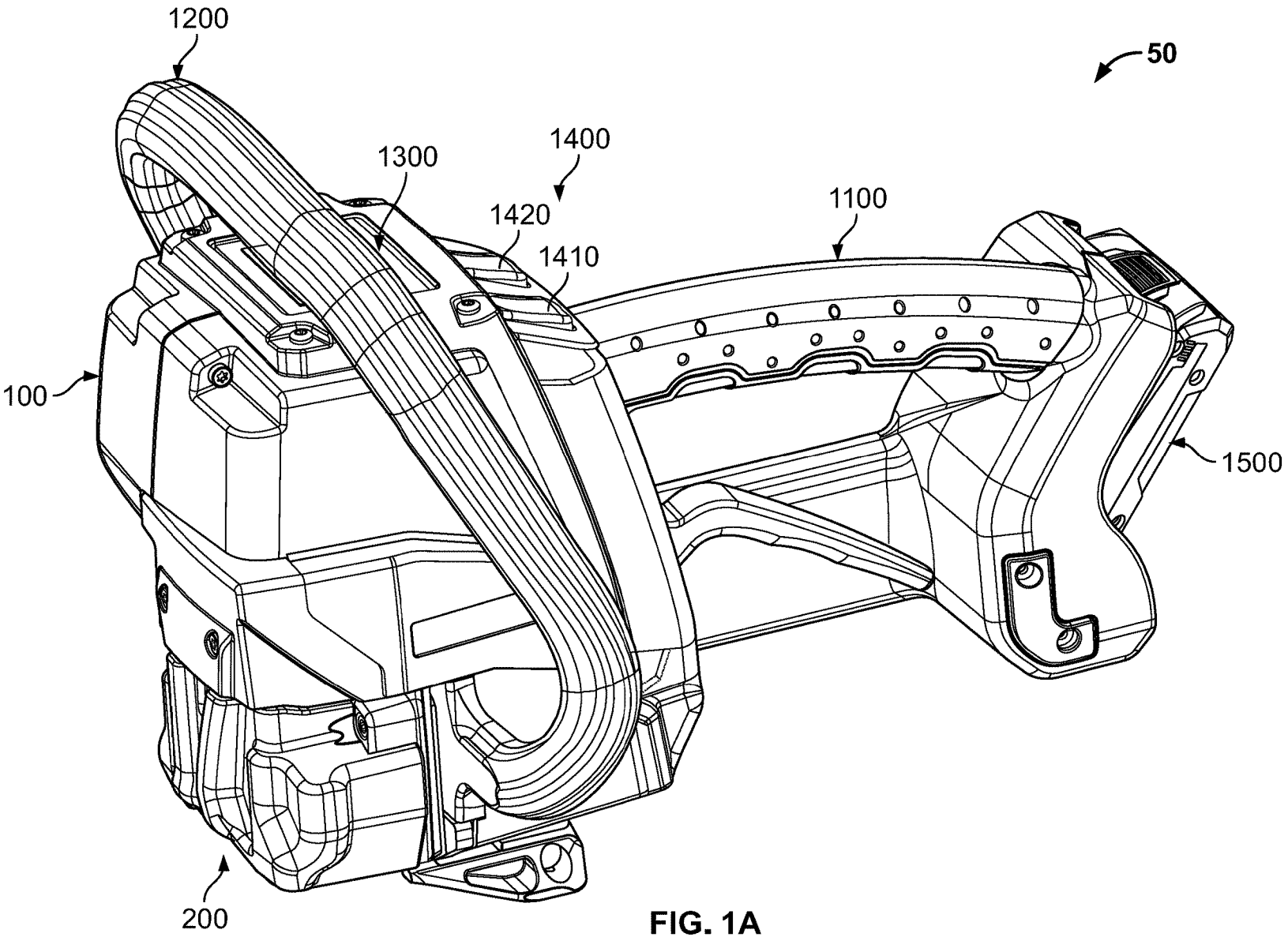
FIG. 1A is a perspective view of one example embodiment of a strapping tool of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 1B:
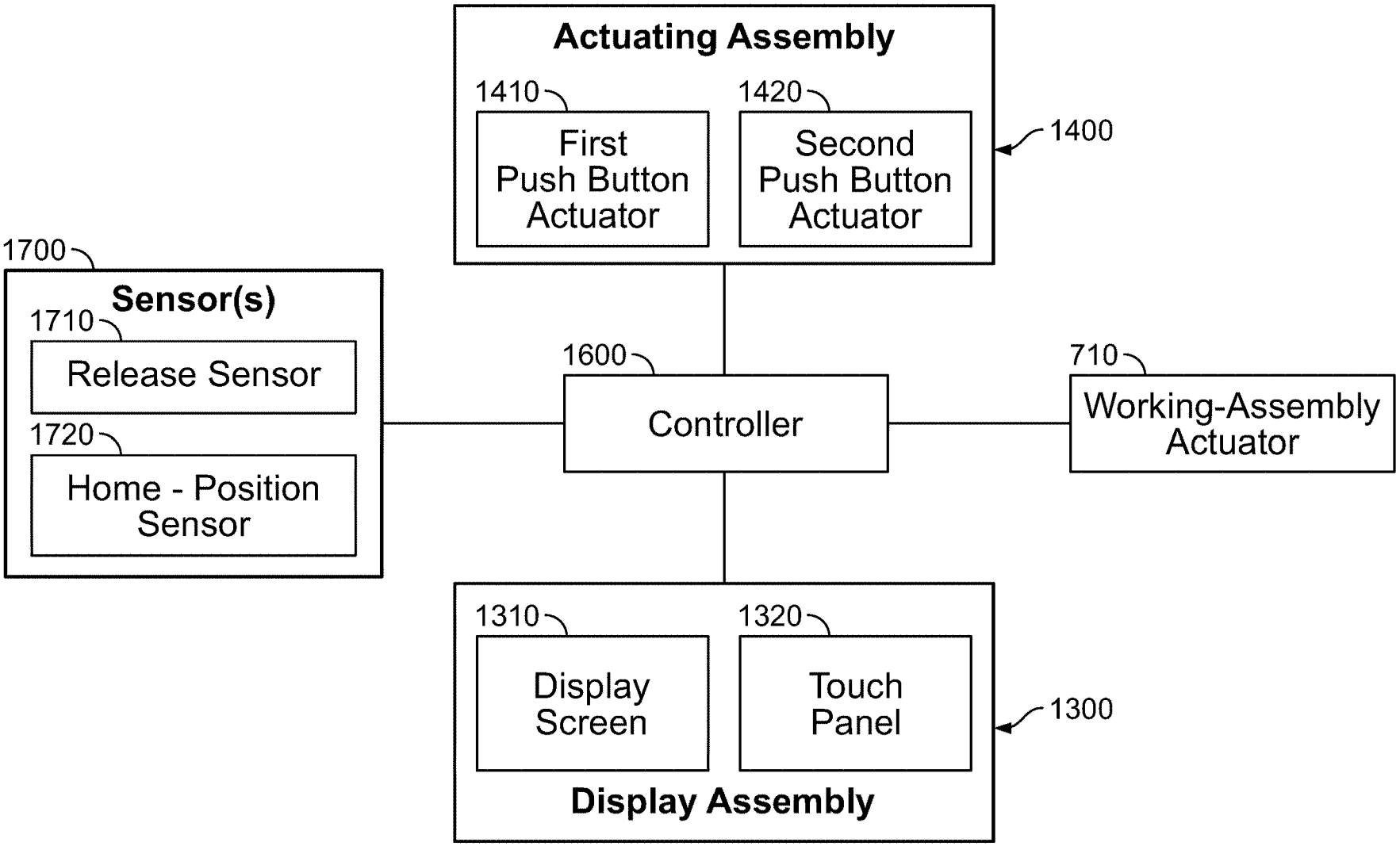
FIG. 1B is a block diagram of certain components of the strapping tool of FIG. 1A.

FIGS. 1A and 1B show one example embodiment of the strapping tool 50 of the present disclosure (sometimes referred to as the "tool" in the Detailed Description for brevity) and certain assemblies and components thereof. The strapping tool 50 is configured to carry out a strapping cycle including: (1) a tensioning cycle during which the strapping tool tensions strap (metal strap in this example embodiment) around a load; and (2) a sealing cycle during which the strapping tool, after tensioning the strap, attaches overlapping portions of the strap to one another by cutting notches into a seal element positioned around the overlapping portions of the strap and into the overlapping portions of the strap themselves (referred to as "notching" in the strapping industry and in this Detailed Description) and cuts the strap from the strap supply.

The strapping tool 50 includes a housing 100, a working assembly 200, first and second handles 1100 and 1200, a display assembly 1300, an actuating assembly 1400, a power supply 1500, a controller 1600 (FIG. 1B), and one or more sensors 1700 (FIG. 1B).

The housing 100, which is best shown in FIG. 1A, is formed from multiple components (not individually labeled) that collectively at least partially enclose and/or support some (or all) of the other assemblies and components of the strapping tool 50. In this example embodiment, the housing 100 includes a front housing section that at least partially encloses and/or supports at least some of the components of the working assembly 200, the display assembly 1300, and the actuating assembly 1400; a rear housing section that at least partially encloses and/or supports the power supply 1500 and the controller 1600; and a connector housing section that extends between and connects the bottoms of the front and rear housing sections. The first handle 1100 extends between the tops of the front and rear housing sections, and in some embodiments is integrally formed with the housing sections. This is merely one example, and in other embodiments the components of the strapping tool may be supported and/or enclosed by any suitable portion of the housing 100. The housing 100 may be formed from any suitable quantity of components joined together in any suitable manner. In this example embodiment, the housing 100 is formed from plastic, though it may be made from any other suitable material in other embodiments.

The working assembly 200 includes the majority of the components of the strapping tool 50 that are configured to carry out the strapping cycle to tension the strap around the load, attach the overlapping portions of the strap to one another, and cut the strap from the strap supply. Specifically, the working assembly 200 includes a support 300, a tensioning assembly 400, a sealing assembly 500, a drive assembly 700, a rocker-lever assembly 900, and a decoupling assembly 1900.

Figure 2:
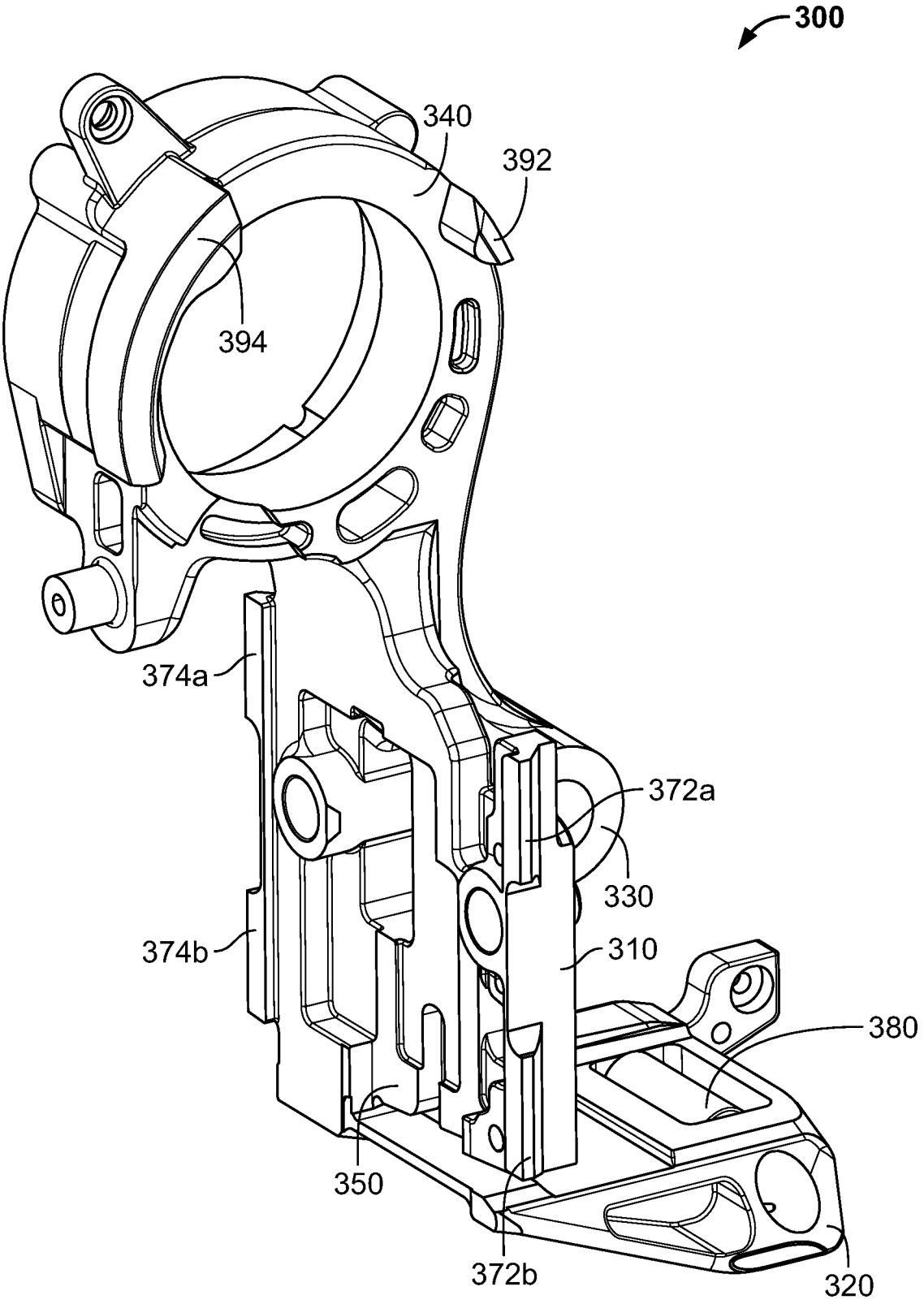
FIG. 2 is a perspective view of the support of the working assembly of the strapping tool of FIG. 1A.

The support 300, which is best shown in FIG. 2, serves as a direct or indirect common mount for the tensioning assembly 400, the sealing assembly 500, the drive assembly 700, the rocker-lever assembly 900, and the decoupling assembly 1900. The support 300 also includes components configured to help change the effective length of a linkage 820 of the conversion assembly 800 of the drive assembly 700 during the sealing cycle, as explained below with respect to FIGS. 13A-15H.

The support 300 includes a body 310, a foot 320 extending transversely from a bottom of the body 310, a tensioning-assembly-mounting element 330 extending rearward from the body 310, and a drive-and-conversion-assembly-mounting element 340 extending upwardly from the body 310. The body 310 includes aligned first and second sealing-assembly-mounting tongues 372*a* and 372*b* and aligned third and fourth sealing-assembly-mounting tongues 374*a* and 374*b* laterally spaced apart from the first and second sealing-assembly-mounting tongues 372*a* and 372*b*. Circumferentially spaced first and second linkage engagers 392 and 394 project from the drive-and-conversion-assembly-mounting element 340. A roller 380 is coupled to and freely rotatable relative to the foot 320.

The tensioning assembly 400, which is best shown in FIGS. 4A-4D, is configured to tension the strap around the load during the tensioning cycle. The tensioning assembly 400 includes a tensioning-assembly support 410, tensioning-assembly gearing 420, a tension wheel 440 driven by the tensioning-assembly gearing 420, and covers (not labeled) mounted to the tensioning-assembly support 410 to partially or completely enclose certain components of the tensioning-assembly gearing 420 and the tension wheel 440.

The tensioning-assembly gearing 420 includes: a driven gear 421; a first sun gear 422; first planet gears 423*a*, 423*b*, and 423*c*; a carrier 424; a first ring gear 425; a spacer 426; a second ring gear 427; a tension-wheel mount 428; and second planet gears 429*a*, 429*b*, and 429*c*. The components of the tensioning-assembly gearing 420 are centered on—and certain of them are rotatable about—a tension-wheel rotational axis 440*a*. The carrier 424 includes a first planet-gear carrier 424*a* to which the first planet gears 423*a*-423*c* are rotatably mounted (such as via respective bearings and mounting pins) and a second sun gear 424*b* rotatable with (and here integrally formed with) the planet-gear carrier 424*a* about the tension-wheel rotational axis 440*a*. The first ring gear 425 includes internal teeth 425*it* and external teeth 425*ot*. The second ring gear 427 includes internal teeth 427*it*. The tension-wheel mount 428 includes a second planet-gear carrier 428*a* and a tension-wheel shaft 428*b* rotatable with (and here integrally formed with) the second planet-gear carrier 428*a* about the tension-wheel rotational axis 440*a*. The second planet gears 429*a*-429*c* are rotatably mounted to the second planet-gear carrier 428*a* (such as via respective bearings and mounting pins).

The first sun gear 422 is fixedly mounted to the driven gear 421 (such as via a splined connection) such that the driven gear and the first sun gear rotate together about the tension-wheel rotational axis 440*a*. The first sun gear 422 meshes with and drivingly engages the first planet gears 423*a*-423*c*. The first planet gears mesh with the internal teeth 425*it* of the first ring gear 425. The second planet gears mesh with the internal teeth 427*it* of the second ring gear 427. The spacer 426 separates the first and second ring gears 425 and 427. The second sun gear 424*b* extends through the spacer 426 and meshes with and drivingly engages the second planet gears 429*a*-429*c*. The tension wheel 440 is fixedly mounted to the tension-wheel shaft 428*b* (such as via a splined connection) such that the tension-wheel shaft and the tension wheel rotate together about the tension-wheel rotational axis 440*a*.

The tensioning-assembly gearing 420 is mounted to the tensioning-assembly support 410. The second ring gear 427 is fixed in rotation about the tension-wheel rotational axis 440*a* relative to the tensioning-assembly support 410 (that is, the second ring gear 427 is not rotatable about the tension-wheel rotational axis 440*a* relative to the tensioning-assembly support 410). In this example embodiment, pins (which are shown but not labeled) are positioned between the outer surface of the second ring gear 427 and the tensioning-assembly support 410 to prevent relative rotation, though any suitable components (such as set screws, glue, or high-friction components or fasteners) may be used to do so. The decoupling assembly 1900 (except when actuated, as described below) fixes the first ring gear 425 in rotation about the tension-wheel rotational axis 440*a* relative to the tensioning-assembly support 410 (so the first ring gear cannot rotate about the tension-wheel rotational axis 440*a* relative to the tensioning-assembly support 410).

During the tensioning cycle, the drive assembly 700 drives the driven gear 421, as described below. The driven gear 421 begins rotating itself and the first sun gear 422 about the tension-wheel rotational axis 440*a* in a tensioning rotational direction (clockwise from the perspective of FIG. 4B in this example embodiment). The first sun gear 422 drives the first set of planet gears 423*a*-423*c*. Since the decoupling assembly 1900 prevents the first ring gear 425 from rotating about the tension-wheel rotational axis 440*a*, rotation of the planet gears 423*a*-423*c* causes the carrier 424—including the second sun gear 424*b*—to rotate about the tension-wheel rotational axis 440*a* in the tensioning rotational direction. the second sun gear 424*b* drives the second set of planet gears 429*a*-429*c*. Since the second ring gear 427 cannot rotate about the tension-wheel rotational axis 440*a*, rotation of the planet gears 429*a*-429*c* causes the tension-wheel mount 428 and the tension wheel 440 mounted thereto to rotate about the tension-wheel rotational axis 440*a* in the tensioning rotational direction. Accordingly, the tensioning-assembly gearing 420 operatively connects the drive assembly 700 to the tension wheel 440 to rotate the tension wheel 440 about the tension-wheel rotational axis 440*a* in the tensioning rotational direction.

Figure 7A:
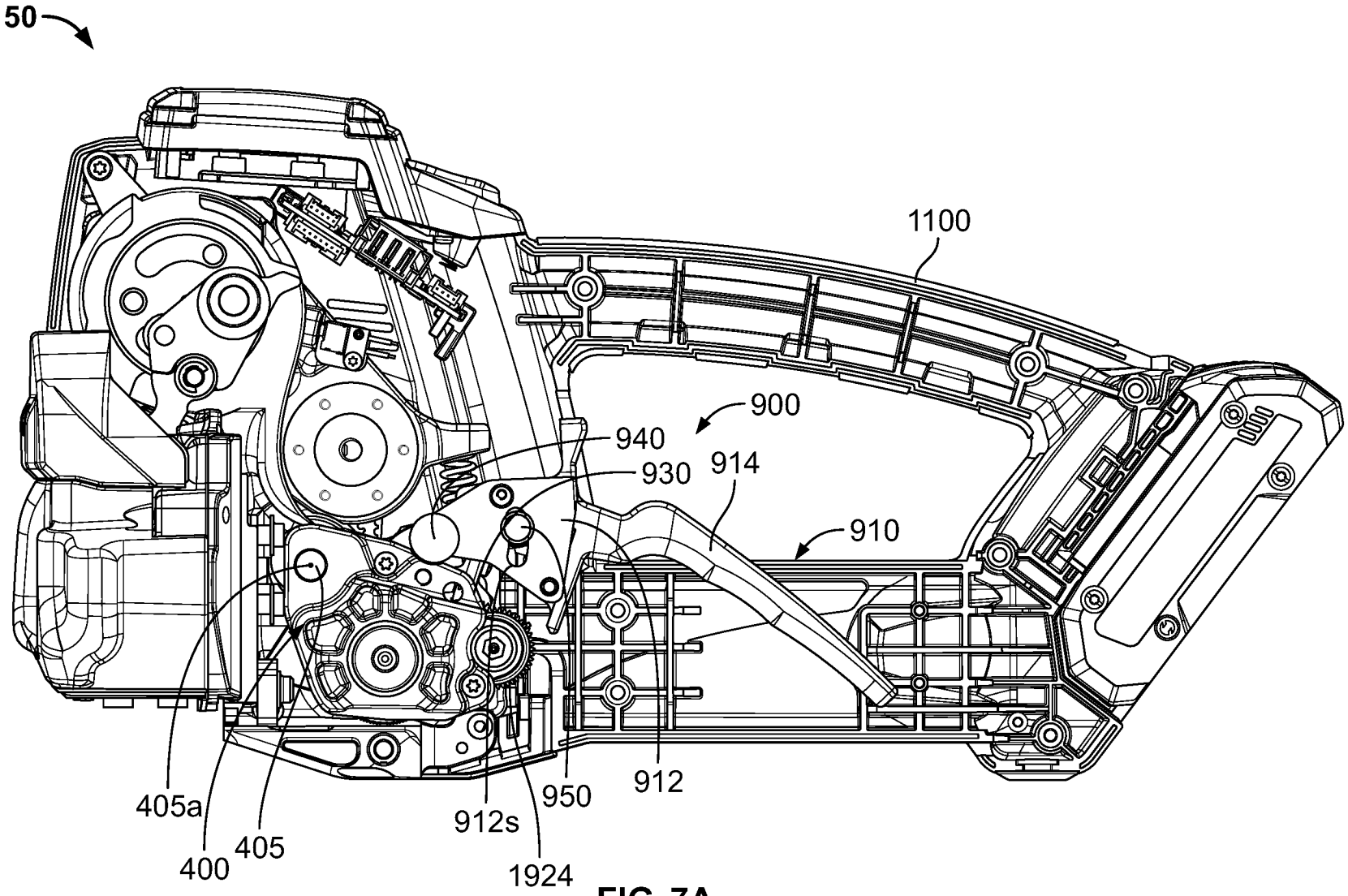
FIGS. 7A-7C are cross-sectional side views of the strapping tool of FIG. 1A showing the rocker-lever assembly and the tensioning assembly in different positions.
Figure 7B:
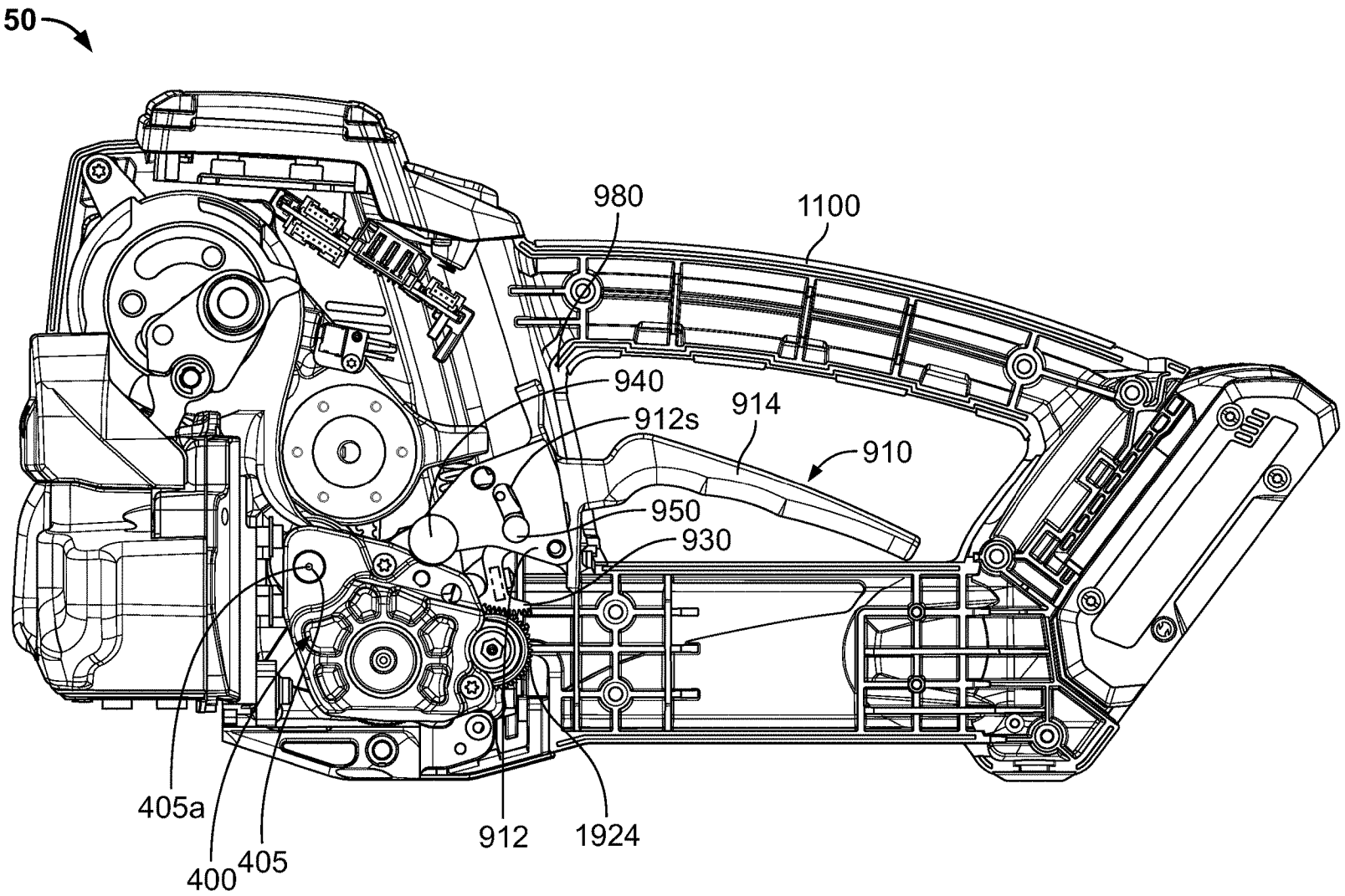
Figure 7C:
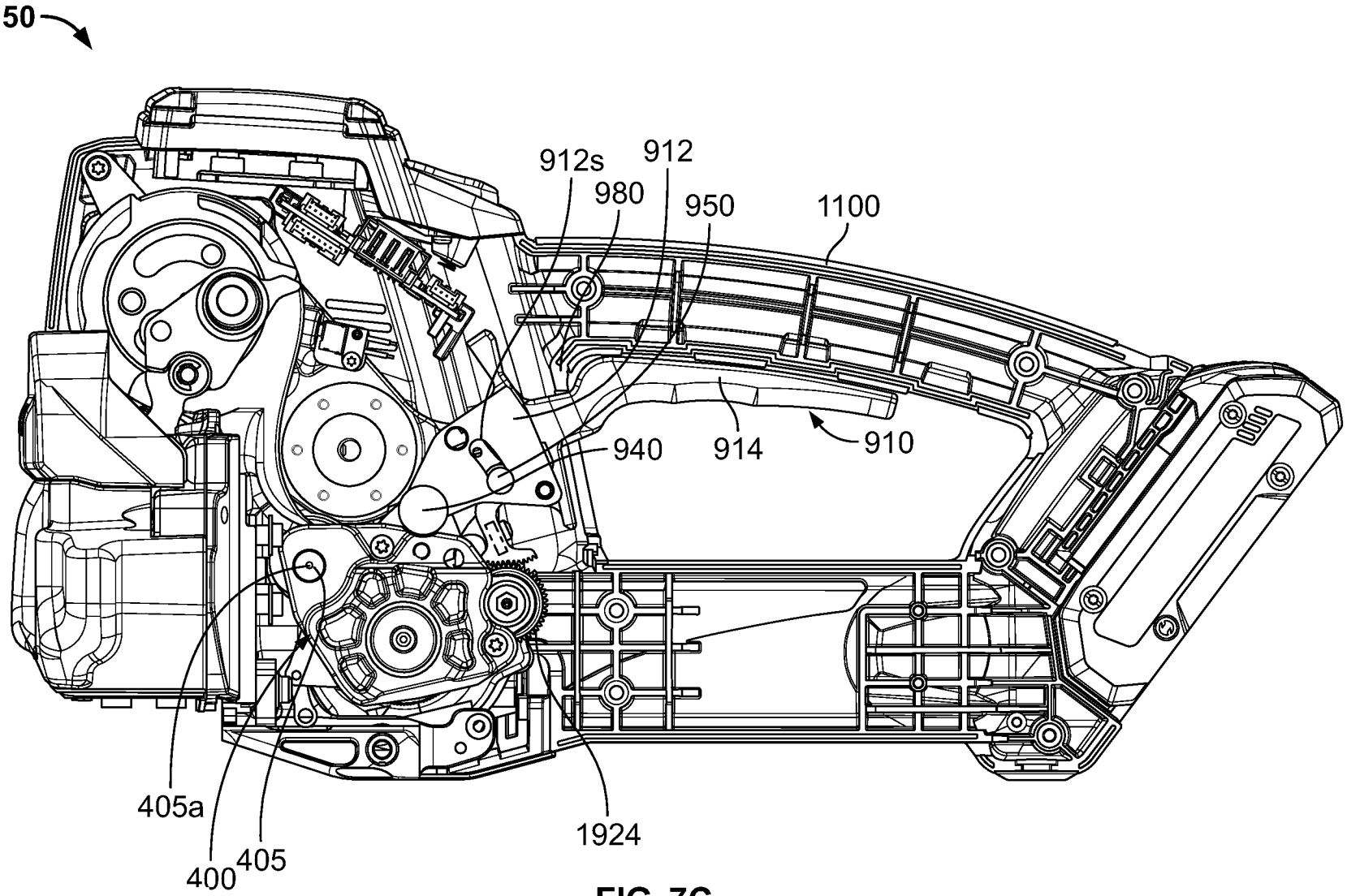

The tensioning assembly 400 is movably mounted to the tensioning-assembly-mounting element 330 of the support 300 and configured to pivot relative to the support 300—and particularly relative to the foot 320 of the support 300—under control of the rocker-lever assembly 900 (as described below) and about a tensioning-assembly-pivot axis 405*a* of a tensioning-assembly-pivot shaft 405 between a strap-tensioning position (FIG. 7A) and a strap-insertion position (FIG. 7C). When the tensioning assembly 400 is in the strap-tensioning position, the tension wheel 440 is adjacent to (and in this embodiment contacts) the roller 380 of the support 300 (or the upper surface of the strap if the strap has been inserted into the strapping tool 50). When the tensioning assembly 400 is in the strap-insertion position, the tension wheel 440 is spaced-apart from the roller 380 to enable the top portion of the strap (described below) to be inserted between the tension wheel 440 and the roller 380. A tensioning-assembly-biasing element 400*s* (FIG. 3B), which is a compression spring in this example embodiment but may be any other suitable type of biasing element, biases the tensioning assembly 400 to the strap-tensioning position.

The decoupling assembly 1900, which is best shown in FIGS. 5A-5D, is configured to enable the tension wheel 440 to rotate about the tension-wheel rotational axis 440*a* in a direction opposite the tensioning rotational direction to facilitate removal of the tool 50 from the strap after the tensioning process is complete. The decoupling assembly 1900 includes a decoupling-assembly shaft 1910, a decoupling-assembly housing 1920, a first engageable element

1930, an expandable element 1940, a second engageable element 1950, and first and second bearings 1960*a* and 1960*b*.

The decoupling-assembly shaft 1910 includes a body 1912 having a first end 1912*a* having an irregular cross-section and second end 1912*b* having teeth. A first bearing support 1914 extends from the first end 1912*a*, and a second bearing support 1916 extends from the second end 1912*b*. The decoupling-assembly housing 1920 includes a tubular body 1922 having teeth 1924 extending around its outer circumference. The body 1922 defines an opening 1922*o*. The first engageable element 1920 comprises a tubular bushing having a cylindrical outer surface and an interior surface having a perimeter that matches the perimeter of the first end 1912*a* of the body 1912 of the decoupling-assembly shaft 1910. The expandable element 1940 includes a torsion spring having a first end 1940*a* and a second end 1940*b*. The second engageable element 1950 includes a tubular body 1952 and an annular flange 1954 at one end of the body 1952. An opening 1954*o* is defined through the flange 1954.

The first engageable element 1930 is mounted on the first end 1912*a* of the body 1912 of the decoupling-assembly shaft 1910 for rotation therewith and is disposed within the body 1922 of the decoupling-assembly housing 1920. The second engageable element 1950 is also disposed within the body 1922 of the decoupling-assembly housing 1920 such that the body 1952 of the second engageable element 1950 is adjacent the first engageable element 1930 and such that at least part of the decoupling-assembly shaft 1910 extends through the second engageable element 1950. The expandable element 1940, which is a torsion spring in this example embodiment, is disposed within the body 1922 of the decoupling assembly housing 1920 and circumscribes the first engageable element 1930 and the body 1952 of the second engageable element 1950. The outer diameters of the first engageable element 1930 and the body 1952 of the second engageable element are substantially the same and are equal to or larger than the resting inner diameter of the torsion spring 1940. This means that the torsion spring 1940 exerts a compression force on the first engageable element 1930 and the body 1952 of the second engageable element that prevents those components (and the decoupling-assembly shaft 1910) from rotating relative to one another. The first end 1940*a* of the expandable element 1940 is received in the opening 1954*o* defined through the flange 1954 of the second engageable element 1950, and the second end 1940*b* of the expandable element 1940 is received in the opening 1922*o* defined in the body 1922 of the decoupling-assembly housing 1920. The bearings 1960*a* and 1960*b* are mounted on the first and second bearing supports 1914 and 1916, respectively, of the decoupling-assembly shaft 1910.

Figure 3A:
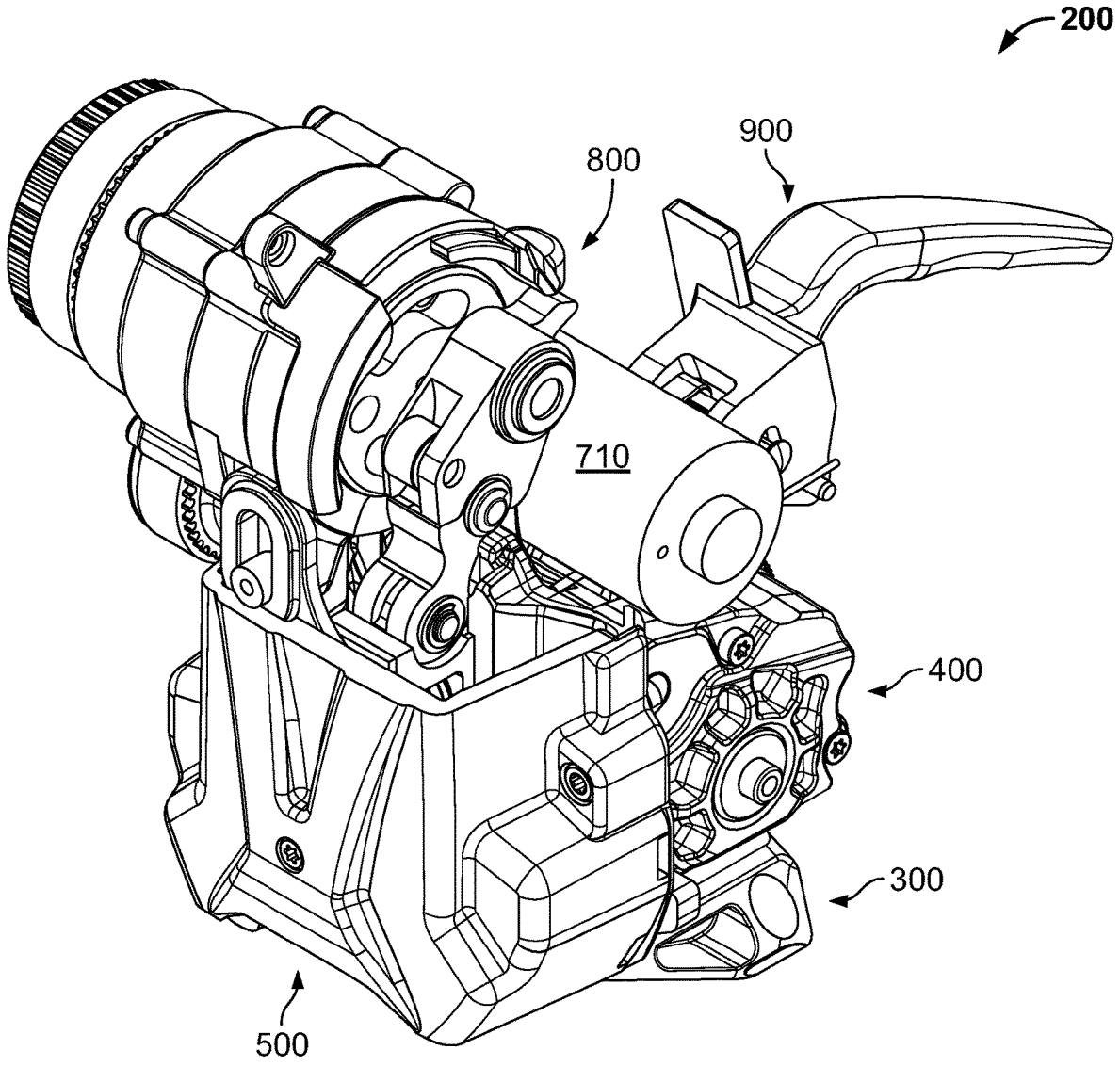
FIGS. 3A and 3B are perspective views of the working assembly of the strapping tool of FIG. 1A.
Figure 3B:
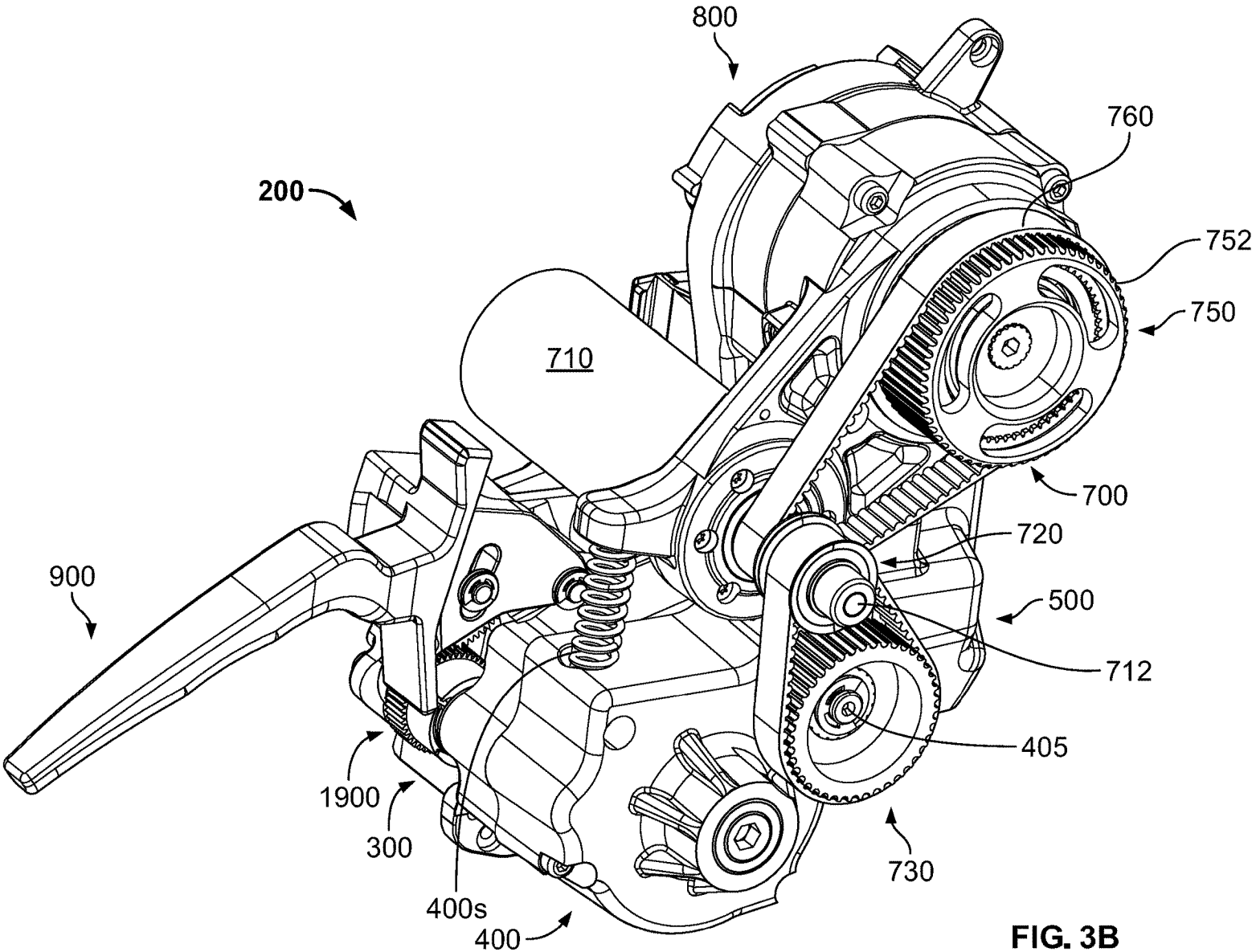
Figure 4A:
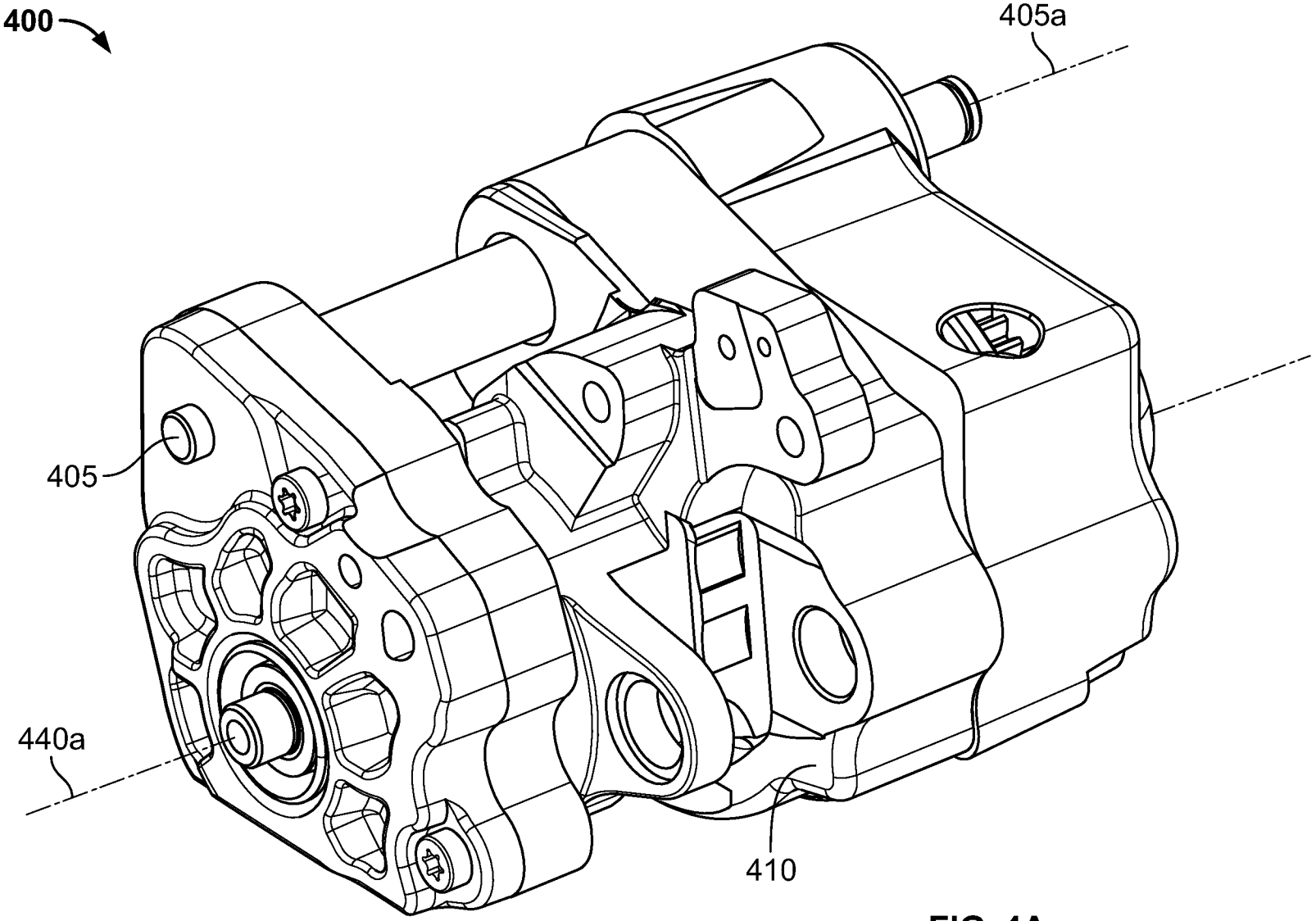
FIG. 4A is a perspective view of the tensioning assembly of the working assembly of FIG. 3A.
Figure 4B:
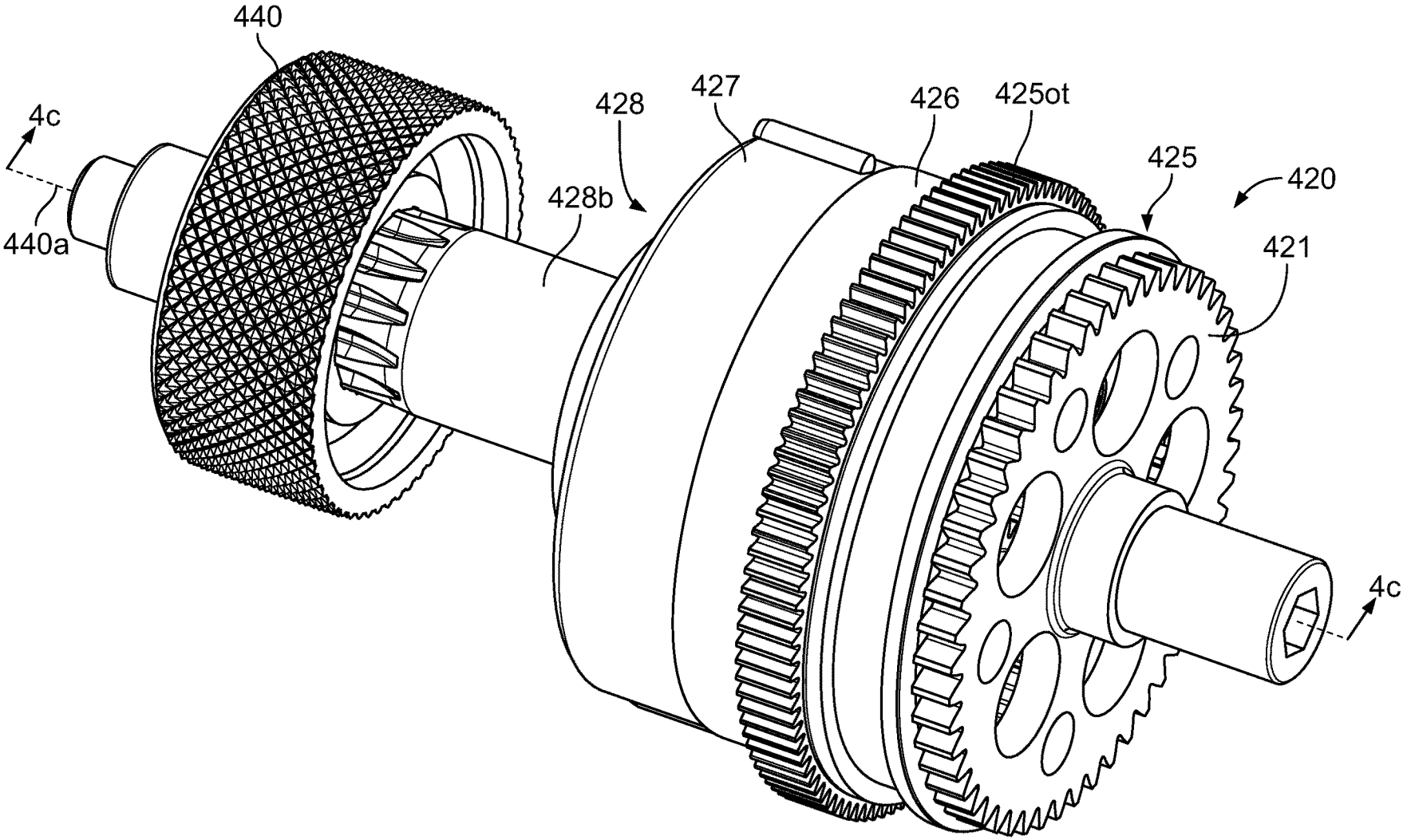
FIG. 4B is a perspective view of the tensioning-assembly gearing and the tension wheel of the tensioning assembly of FIG. 4A.
Figure 4C:
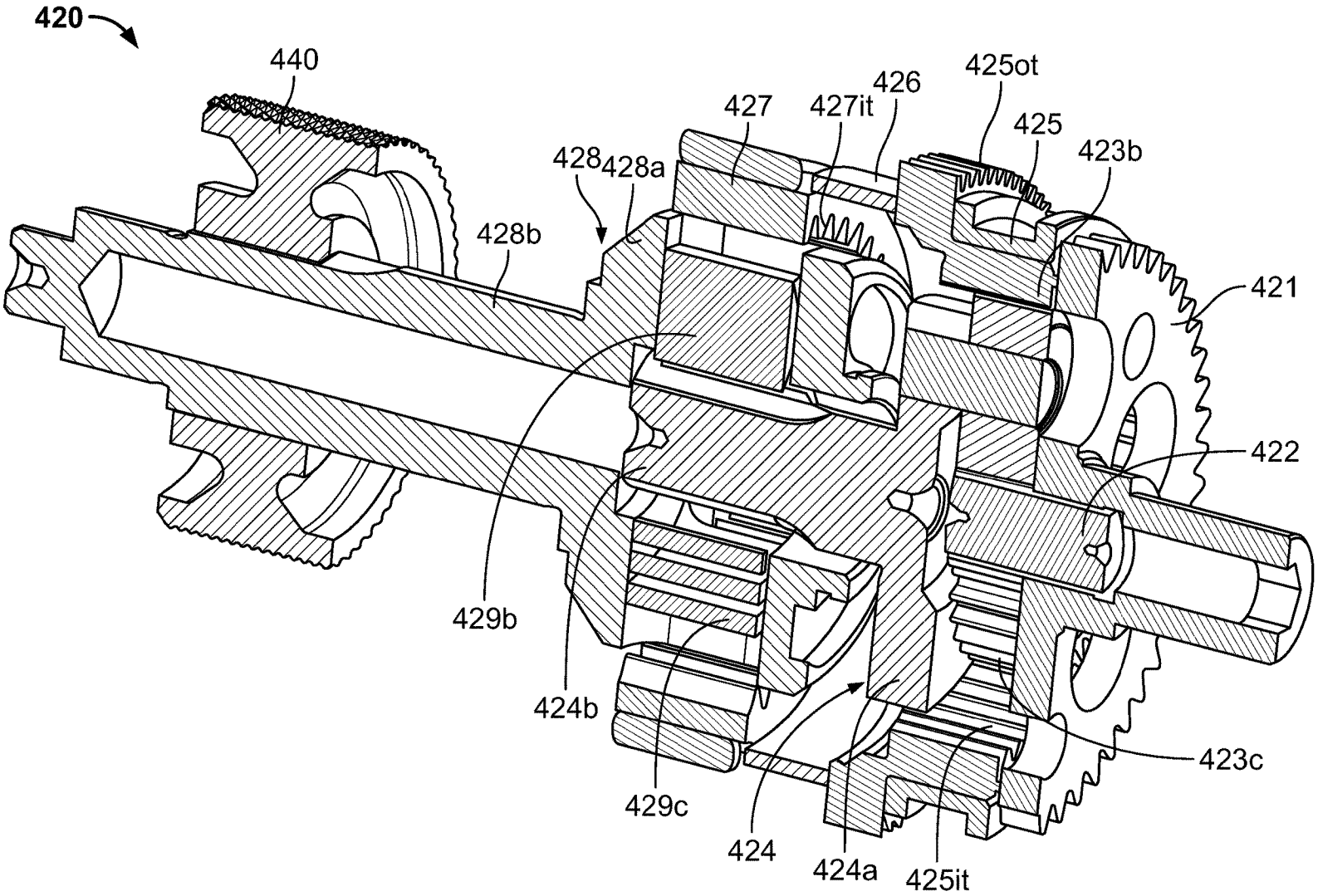
FIG. 4C is a cross-sectional perspective view of the tensioning assembly gearing and the tension wheel of FIG. 4B taken along line 4C-4C of FIG. 4B.
Figure 4D:
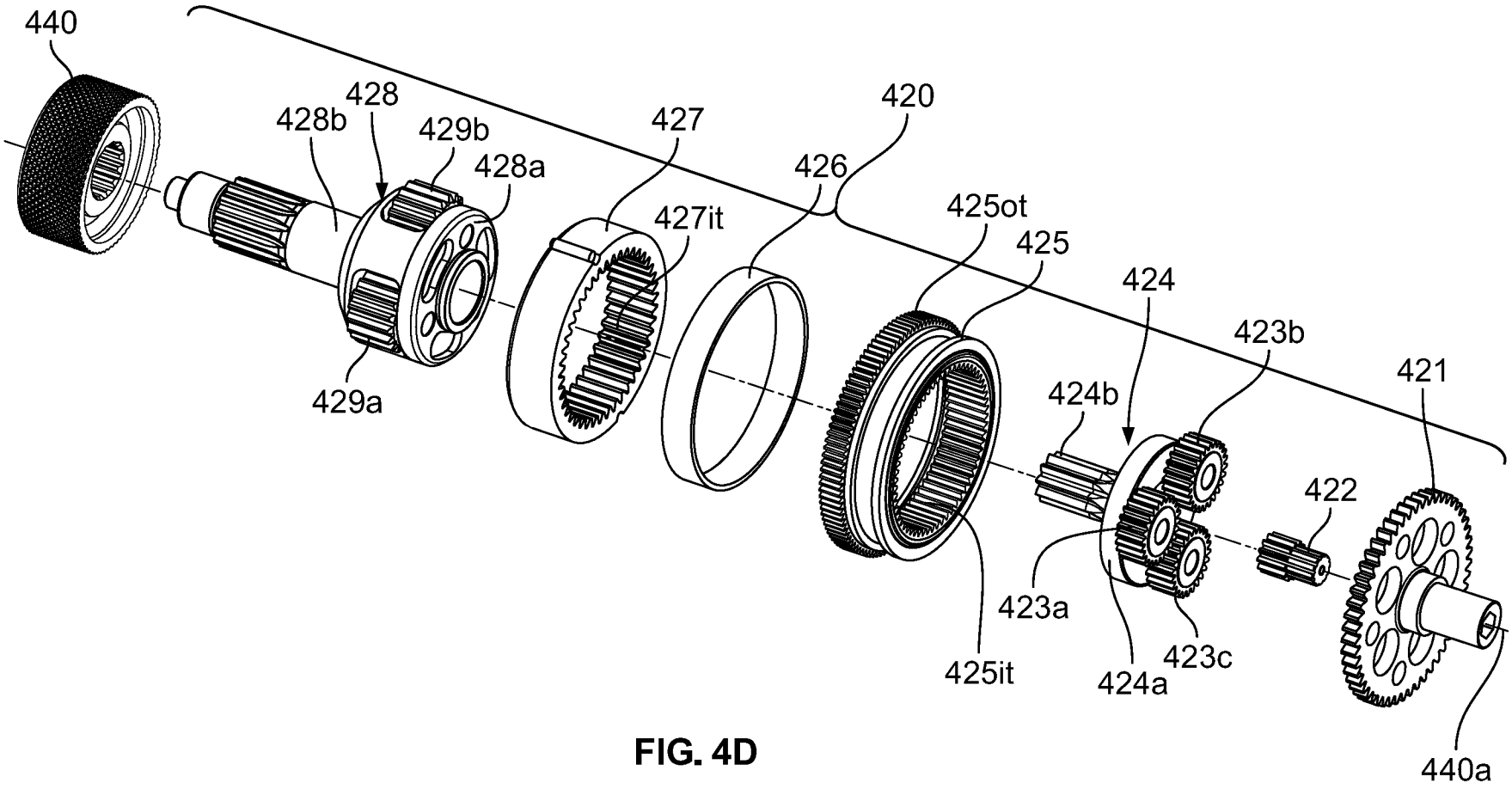
FIG. 4D is an exploded perspective view of the tensioning-assembly gearing and the tension wheel of FIG. 4B.
Figure 5A:
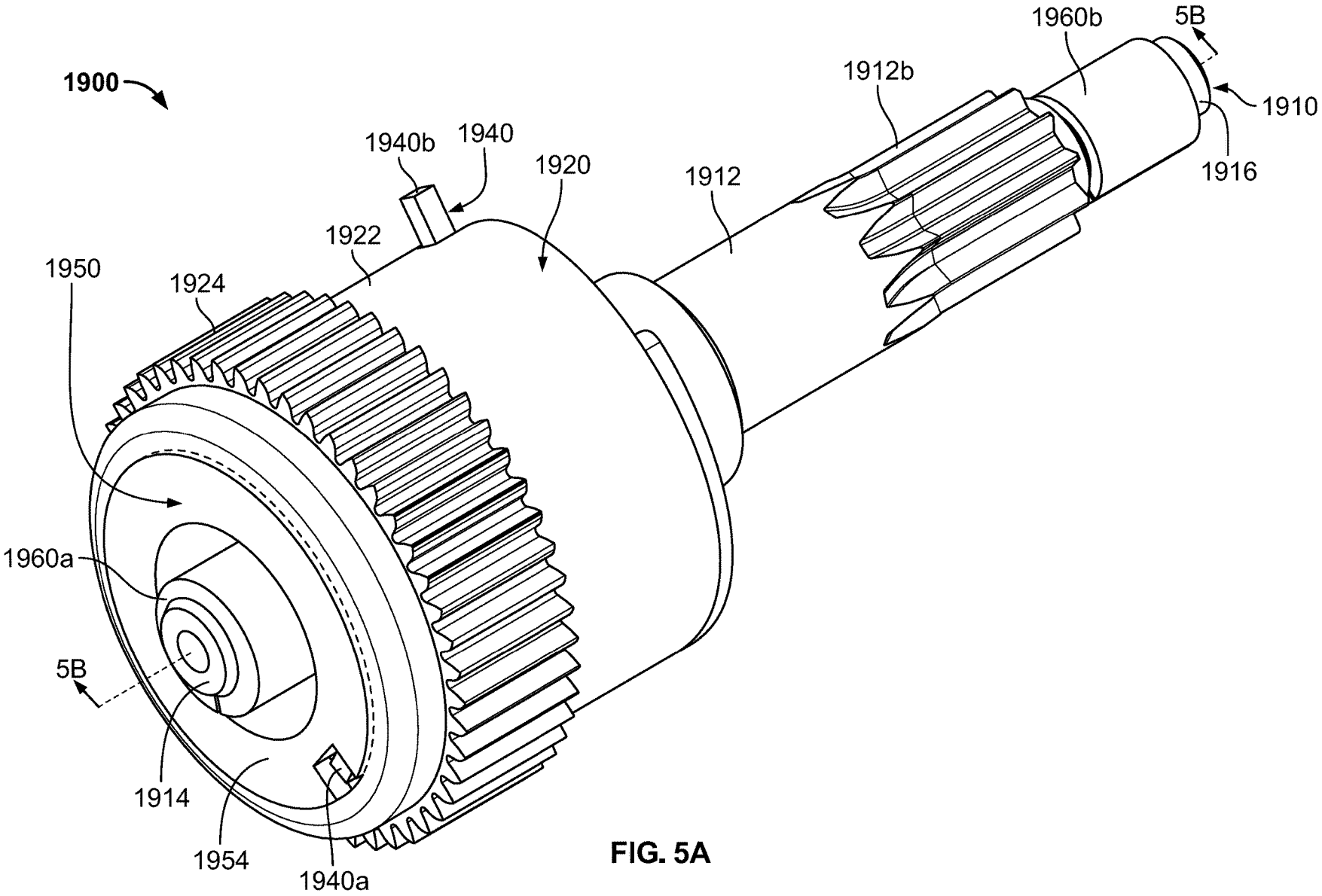
FIG. 5A is a perspective view of the decoupling assembly of the working assembly of FIG. 3A.
Figure 5B:
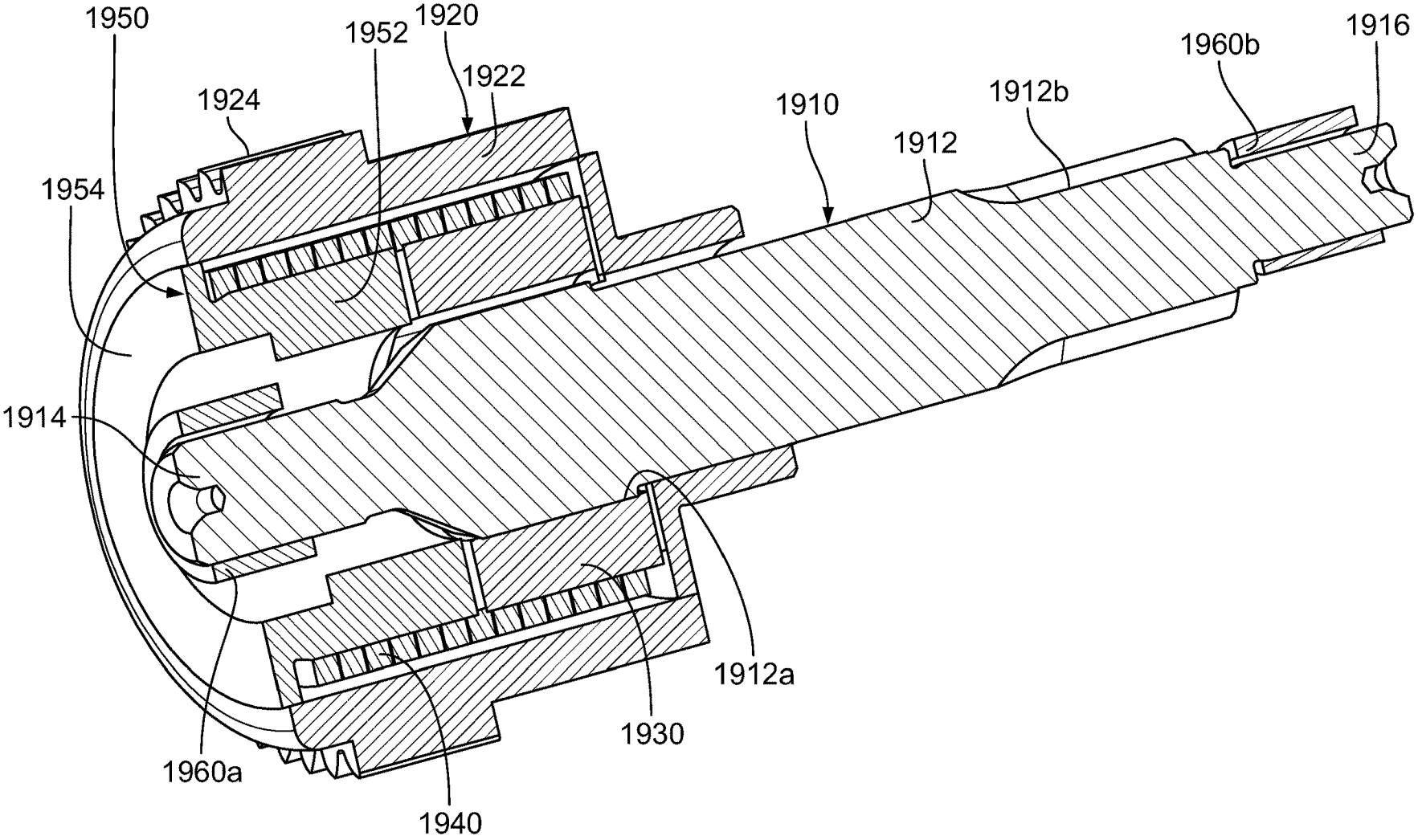
FIG. 5B is a cross-sectional perspective view of the decoupling assembly of FIG. 5A taken along line 5B-5B of FIG. 5A.
Figure 5C:
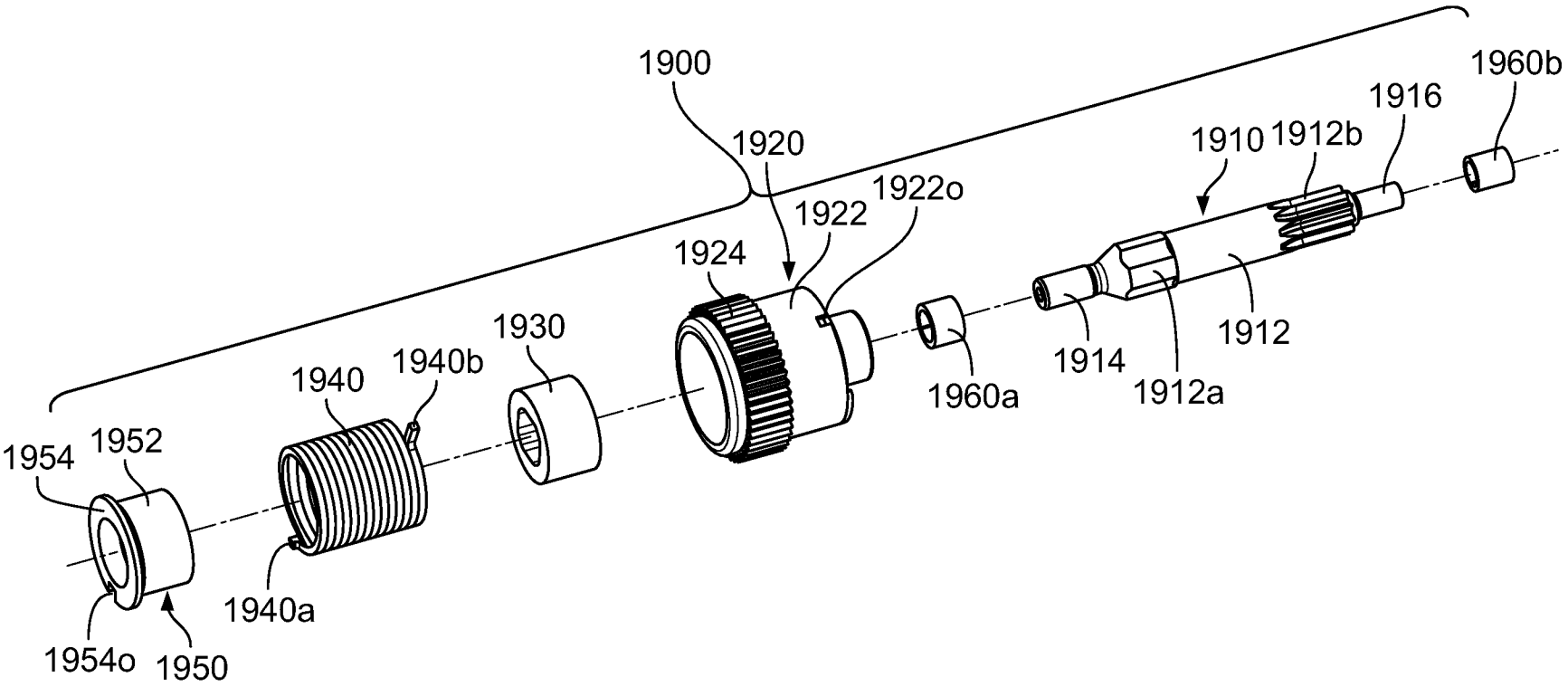
FIG. 5C is an exploded perspective view of the decoupling assembly of FIG. 5A.
Figure 5D:
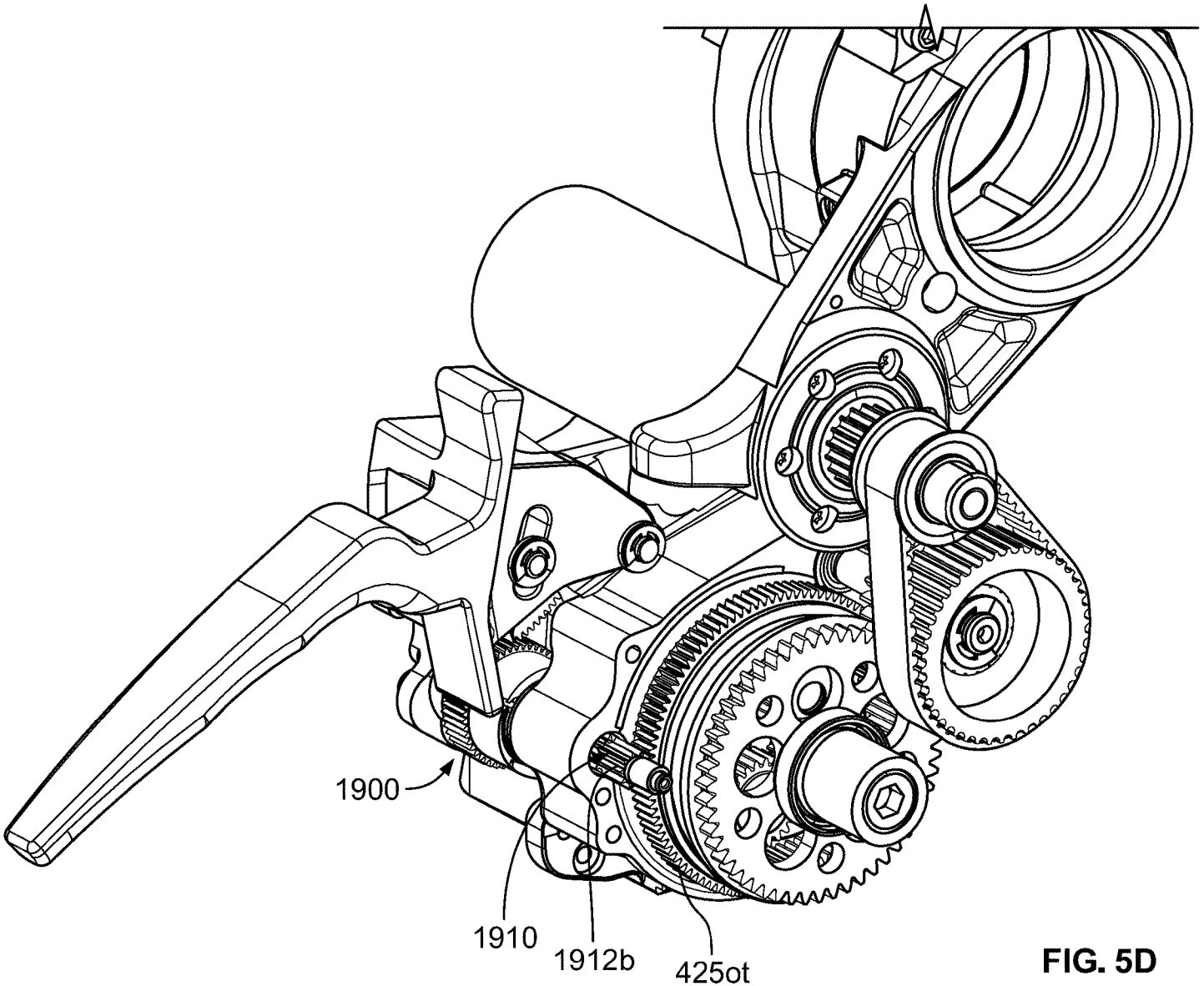
FIG. 5D is a perspective view of part of the working assembly of FIG. 3A including parts of the decoupling assembly and parts of the tensioning assembly.
Figure 6A:
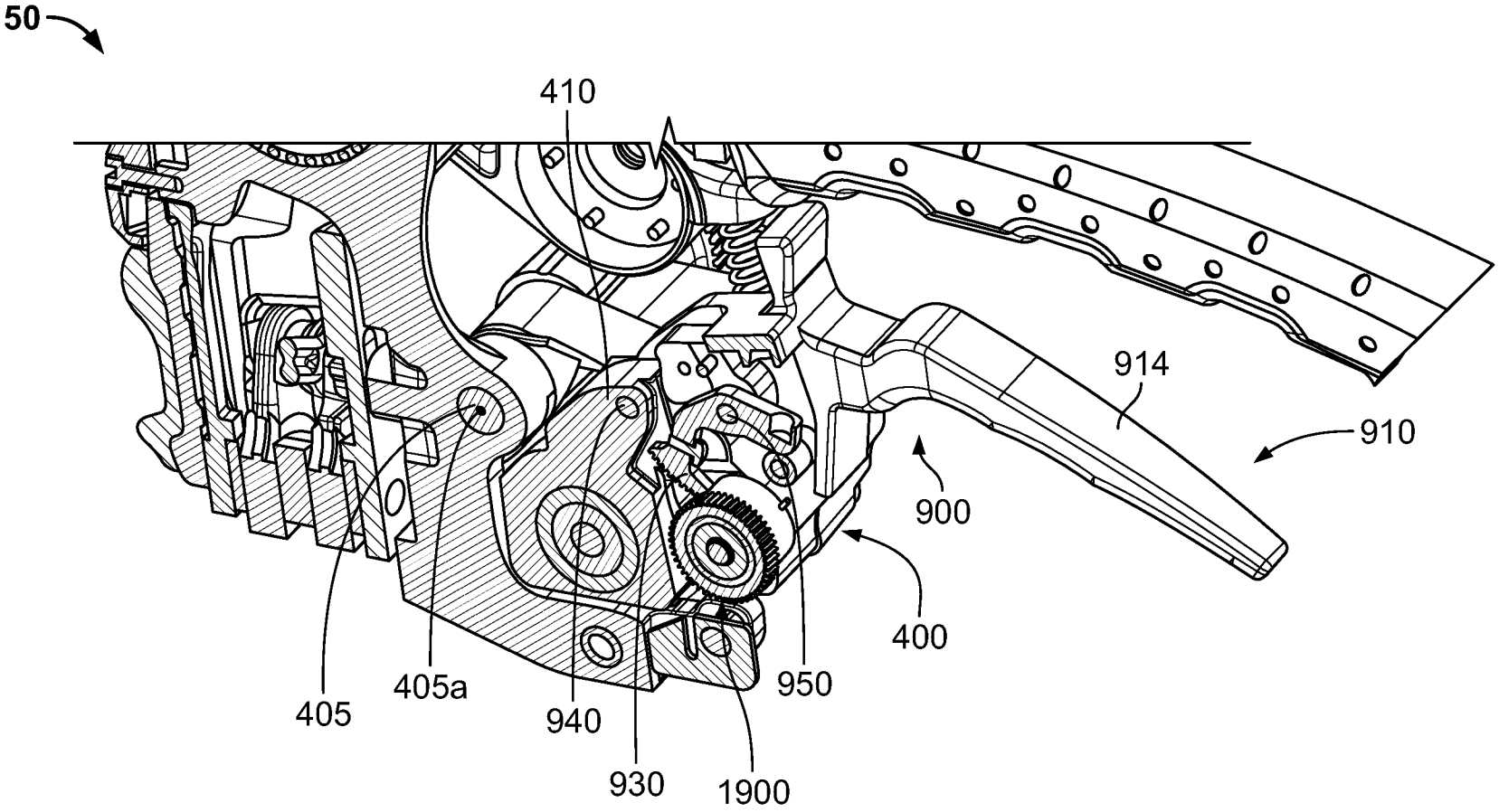
FIG. 6A is a cross-sectional perspective view of part of the working assembly of FIG. 3A including the rocker-lever assembly.
Figure 6B:
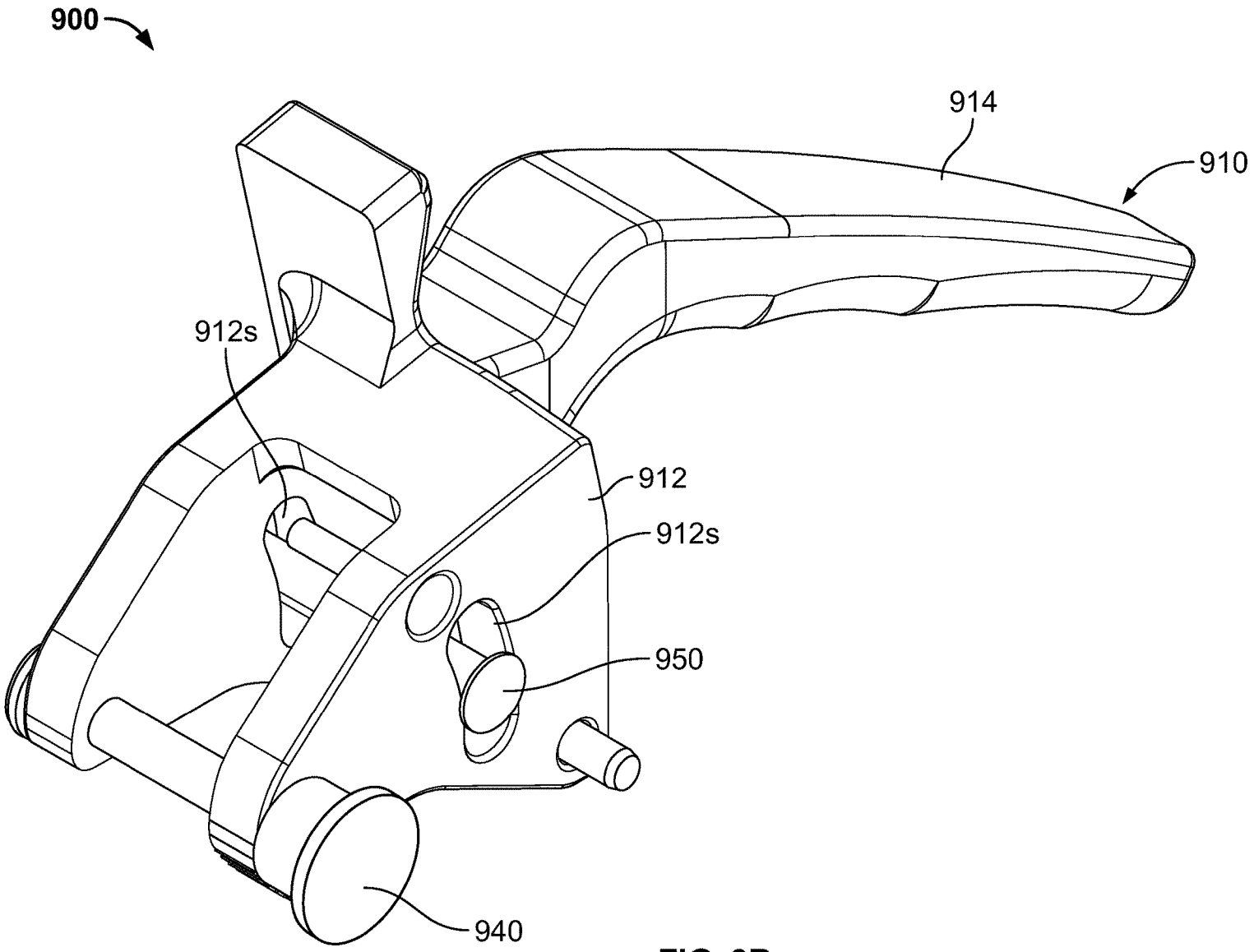
FIGS. 6B and 6C are perspective views of the rocker-lever assembly.
Figure 6C:
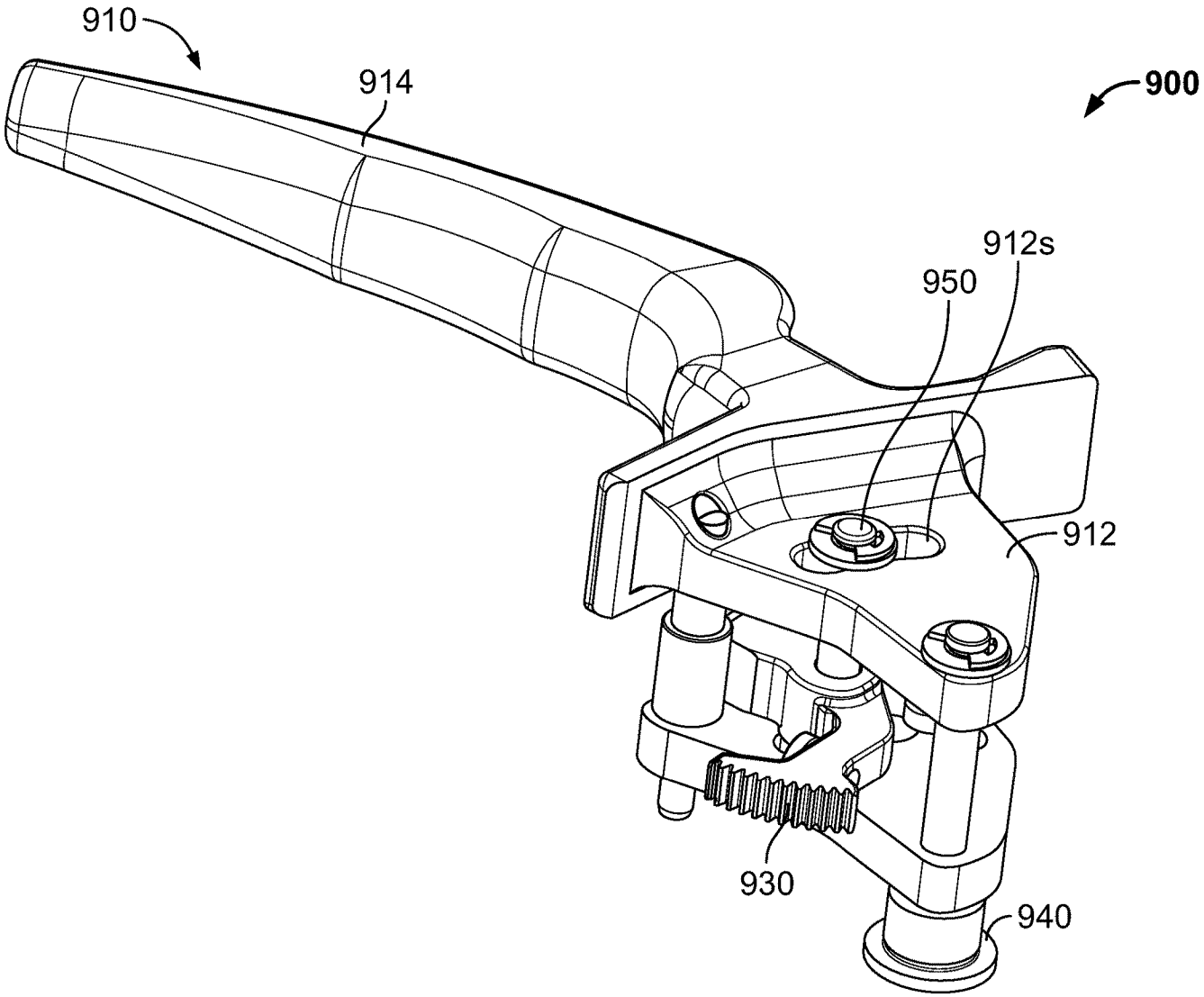
Figure 6D:
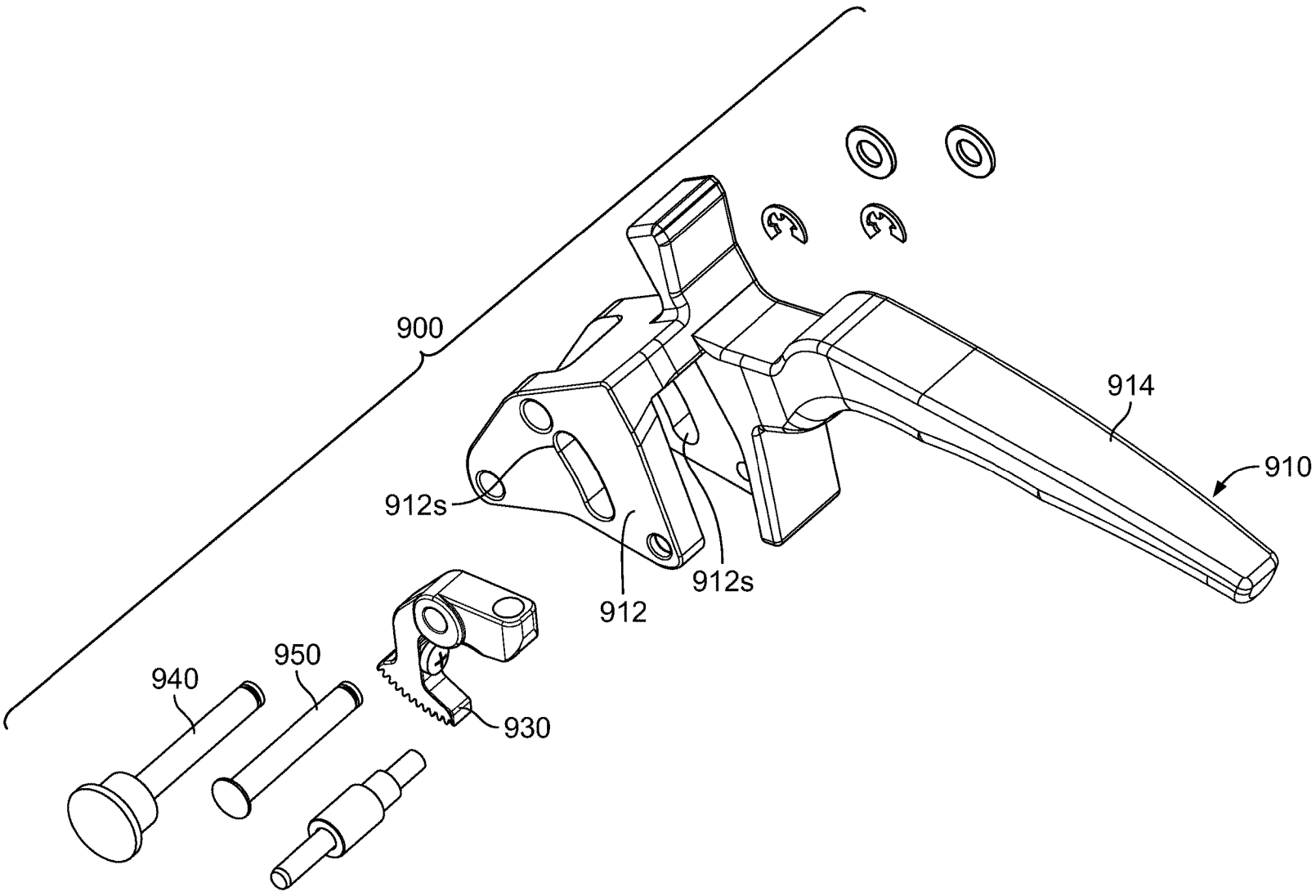
FIGS. 6D and 6E are exploded perspective views of the rocker-lever assembly.
Figure 6E:
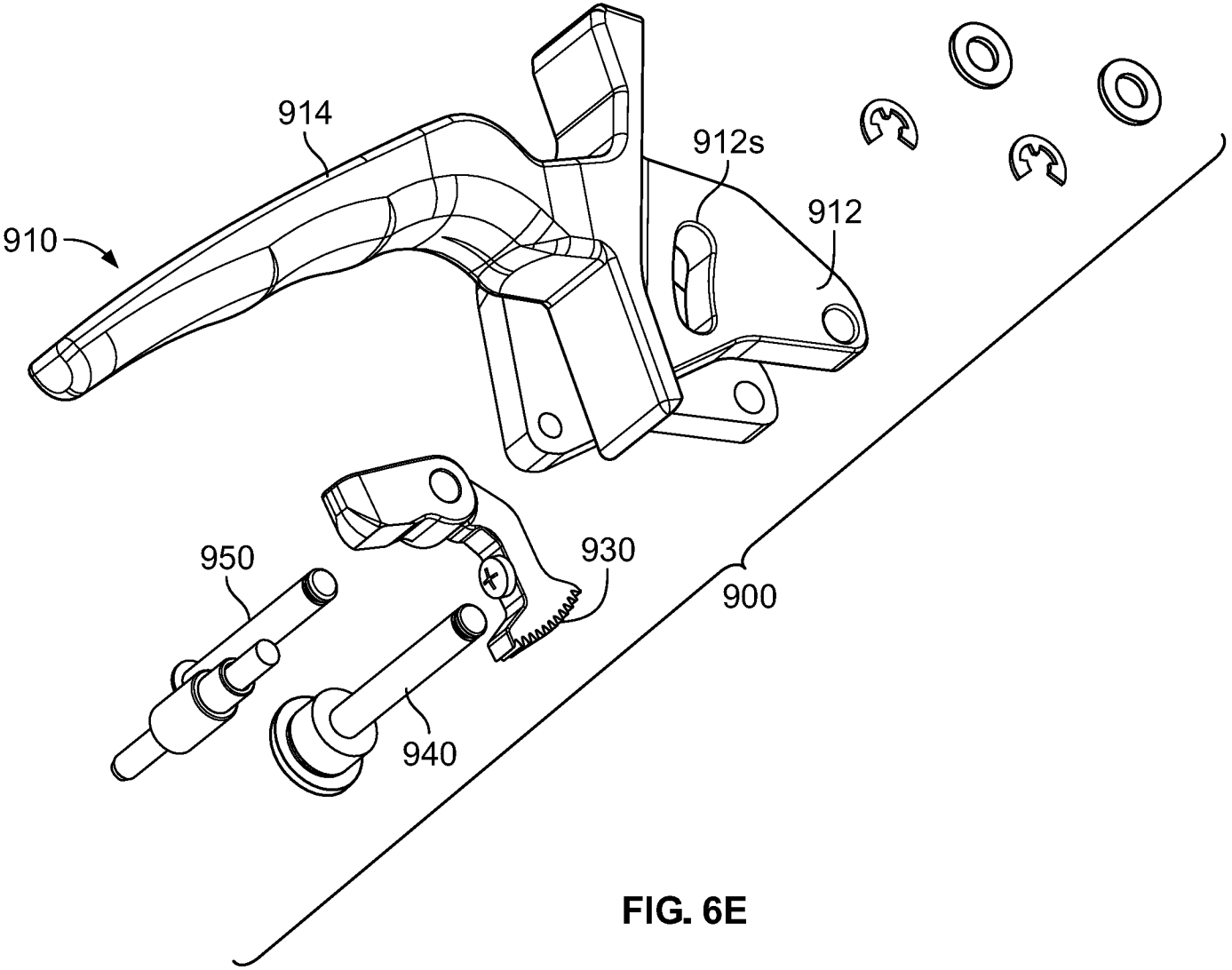

As best shown in FIGS. 3B, 5D, and 6A, the decoupling assembly 1900 is mounted to the tensioning-assembly support 410 and operatively connected to the tensioning-assembly gearing 420. More specifically, the decoupling assembly 1900 is mounted to the tensioning-assembly support 410 via a fastener (not labeled) that fixes the second engageable element 1950 in rotation relative to the tensioning-assembly support 410 such that the second engageable element 1950—and the first end 1940*a* of the expandable element 1940 received in the opening 1954*o* of the flange 1954 of the second engageable element 1950—cannot rotate relative to the tensioning-assembly support 410. The teeth on the second end 1912*b* of the body 1912 of the decoupling-assembly shaft 1910 mesh with the outer teeth 425*ot* of the first ring gear 425 of the tensioning-assembly gearing 420 of the tensioning assembly 400. Since the body 1952 is fixed in rotation relative to the tensioning-assembly support 410 and the decoupling-assembly shaft 1910 is fixed in rotation with the first engageable element 1930, the decoupling-assembly shaft 1910 is fixed in rotation relative to the tensioning-assembly housing 410. Since the teeth on the second end 1912*b* engage the outer teeth 425*ot* of the first ring gear 425 of the tensioning-assembly gearing 420, the decoupling assembly 1900 prevents the first ring gear 425 from rotating about the tension-wheel rotational axis 440*a*.

The decoupling assembly 1900 is actuatable (such as by the rocker-lever assembly 900 as described below) to eliminate the connection between the torsion spring 1940 and the first engageable element 1930 such that the first engageable element 1930 and the decoupling-assembly shaft 1910 may rotate relative to the second engageable element 1930. As explained above, the second engageable element 1950 and the first end 1940*a* of the expandable element 1940 (that is received in the opening 1954*o* of the flange 1954 of the second engageable element 1950) are fixed in rotation relative to the tensioning-assembly support 410. To eliminate the connection between the torsion spring 1940 and the first engageable element 1930, the decoupling-assembly housing 1920 is rotated relative to the tensioning-assembly support 410, the first end 1940*a* of the torsion spring 1940, and the second engageable element 1950. The second end 1940*b* of the torsion spring 1940, which is received in the opening 1922*o* defined in the body 1922 of the decoupling-assembly housing 1920, rotates with the decoupling-assembly housing 1920. As this occurs, the inner diameter of the torsion spring 1940 near its second end 1940*b* begins expanding, and eventually expands enough (thereby reducing the compression force or eliminating it altogether) to enable the first engageable element 1930 and the decoupling-assembly shaft 1910 to rotate relative to the second engageable element 1950 (and the torsion spring 1940).

Upon completion of the tensioning cycle, the tension wheel 440 holds a significant amount of tension in the strap, and the strap exerts a counteracting force (or torque) on the tension wheel 440 in a direction opposite the tensioning direction. Actuation of the decoupling assembly 1900 after the tensioning process is completed enables the tension wheel 440 to rotate in the direction opposite the tensioning direction to release that tension in a controlled manner. Specifically, upon completion of the tensioning cycle, the decoupling-assembly shaft 1910 continues to prevent the first ring gear 425 of the tensioning-assembly gearing 420 from rotating about the tension-wheel rotational axis 440, which prevents the tension wheel 440 from rotating in the direction opposite the tensioning direction. As the decoupling-assembly housing 1920 is rotated (such as via actuation of the rocker-lever assembly 900 as described below), the inner diameter of the torsion spring 1940 near its second end 1940*b* begins expanding. Eventually, the force the first ring gear 425 exerts on the decoupling-assembly shaft 1910 exceeds the compression force the torsion spring 1940 exerts on the first engageable element 1930. When this occurs, the first ring gear 425 rotates in the direction opposite the tensioning direction about the tension-wheel rotational axis 440*a*. Since the first sun gear 422 is fixed in rotation (by the drive assembly 700), this causes the first planetary gears 423*a*-423*c* to rotate in the direction opposite the tensioning direction about the tension-wheel rotational axis 440*a*. This (as explained above) causes the tension wheel 440 to rotate in the direction opposite the tensioning direction about the tension-wheel rotational axis 440*a*.

The rocker-lever assembly 900, which is best shown in FIGS. 6A-6E, is operably connected to: (1) the tensioning assembly 400 and configured to move the tensioning assembly 400 relative to the support 300 from the strap-tensioning position to the strap-insertion position; and (2) the decoupling assembly 1900 and configured to actuate the decoupling assembly, thereby enabling the tension wheel 440 to rotate in the direction opposite the tensioning rotational direction. The rocker-lever assembly 900 includes a rocker lever 910, a rocker-lever gear 930, a rocker-lever pivot pin 940, a rocker-lever travel pin 950, and a rocker-lever biasing element (not shown). The rocker lever 910 includes a rocker-lever body 912 defining two aligned travel-pin slots 912*s* and a rocker-lever arm 914 extending rearwardly from the rocker-lever body 912.

The rocker-lever pivot pin 940 and the rocker-lever travel pin 950 attach the rocker lever 910 to the tensioning assembly 400 such that the rocker lever 910 is pivotable relative to the tensioning assembly 400 between a home position (FIG. 7A) and an intermediate position (FIG. 7B). Specifically, the rocker-lever pivot pin 940 extends through openings (not shown) defined through the tensioning-assembly support 410 and the rocker-lever body 912 of the rocker lever 910 such that the rocker lever 910 is pivotable about the pivot pin 940—which defines a rocker-lever pivot axis (not shown)—and relative to the tensioning assembly 400 and the decoupling assembly 1900. The rocker-lever travel pin 950 extends through an opening (not shown) defined through the tensioning-assembly support 410 and through the travel-pin slots 912*s* of the rocker-lever body 912.

As the rocker lever 910 pivots about the pivot pin 940 (and the rocker-lever pivot axis) and relative to the tensioning assembly 400 and the support 300, the travel-pin slots 912*s* move relative to the rocker-lever travel pin 950 (which is mounted to the tensioning-assembly support 410). The size, shape, position, and orientation of the travel-pin slots 912*s* constrain the pivoting movement of the rocker lever 910 about the pivot pin 940 between the home and intermediate positions. As shown in FIG. 7A, when the rocker lever 910 is in its home position, the rocker-lever travel pin 950 is positioned at and engages the upper ends (not labeled) of the travel-pin slots 912*s*, preventing the rocker lever 910 from further rotation relative to the tensioning assembly 400 in the clockwise direction. Conversely, and as shown in FIG. 7B, when the rocker lever 910 is in its intermediate position, the rocker-lever travel pin 950 is positioned at the lower ends (not labeled) of the travel-pin slots 912*s*, preventing the rocker lever 910 from further rotation relative to the tensioning assembly 400 in the counter-clockwise direction. Although not shown here, the rocker-lever biasing element, which is a torsion spring in this example embodiment but may be any other suitable component, biases the rocker lever 910 to its home position.

As best shown in FIG. 6A, the rocker-lever gear 930 is attached to the rocker-lever body 912 of the rocker lever 910 via the rocker-lever travel pin 950 such that the rocker-lever gear 930 is rotatable about the rocker-lever travel pin 950. The rocker lever 910 is operably connected to the rocker-lever gear 930 and configured to rotate the rocker-lever gear 930 about the rocker-lever travel pin 950 as the rocker lever 910 pivots from its home position to its intermediate position. As the rocker-lever gear 930 rotates, it actuates the decoupling assembly 1900, as described above. More specifically, as the rocker-lever gear 930 rotates, it meshes with the teeth 1924 of the body 1922 of the decoupling-assembly housing 1920, thereby forcing the decoupling-assembly housing 1920 to rotate (thereby actuating the decoupling assembly 1900).

As explained above and as shown in FIG. 7B, once the rocker lever 910 reaches its intermediate position, the rocker-lever travel pin 950 is positioned at the lower ends of the travel pin slots 912*s*, preventing the rocker lever 910 from further rotation relative to the tensioning assembly 400 in the counter-clockwise direction. At this point, if the tensioning assembly 400 is in its strap-tensioning position, as shown in FIG. 7B, continued application of force on the rocker lever 910 (and particularly the rocker-lever arm 914) towards the handle 1100 causes the rocker lever 910 and the tensioning assembly 400 to rotate together about the tensioning-assembly-pivot axis 405*a* until the rocker lever 910 reaches its actuated position and the tensioning assembly 400 reaches its strap-insertion position. FIG. 7C shows the rocker lever 910 in its actuated position and the tensioning assembly 400 in its strap-insertion position.

The sealing assembly 500, which is best shown in FIGS. 8A-10, is configured to attach overlapping portions of the strap to one another to form a tensioned strap loop around the load during the sealing cycle by notching both a seal element positioned around the overlapping portions of the strap and the overlapping portions of the strap themselves. The sealing assembly 500 includes a front cover 502, a back cover 506, and a jaw assembly 520.

The front cover 502 is generally U-shaped. The back cover 506 includes a generally planar base 506*a*, two mounting wings 506*b* and 506*c* extending rearward and inward from opposing lateral ends of the base 506*a*, and a lip 506*d* extending forward from the base 506*a* toward the jaw assembly 520. The front cover 502 and the back cover 506 are connected to one another via one or more suitable fasteners (not labeled) and cooperate to partially enclose the jaw assembly 520.

Figure 17A:
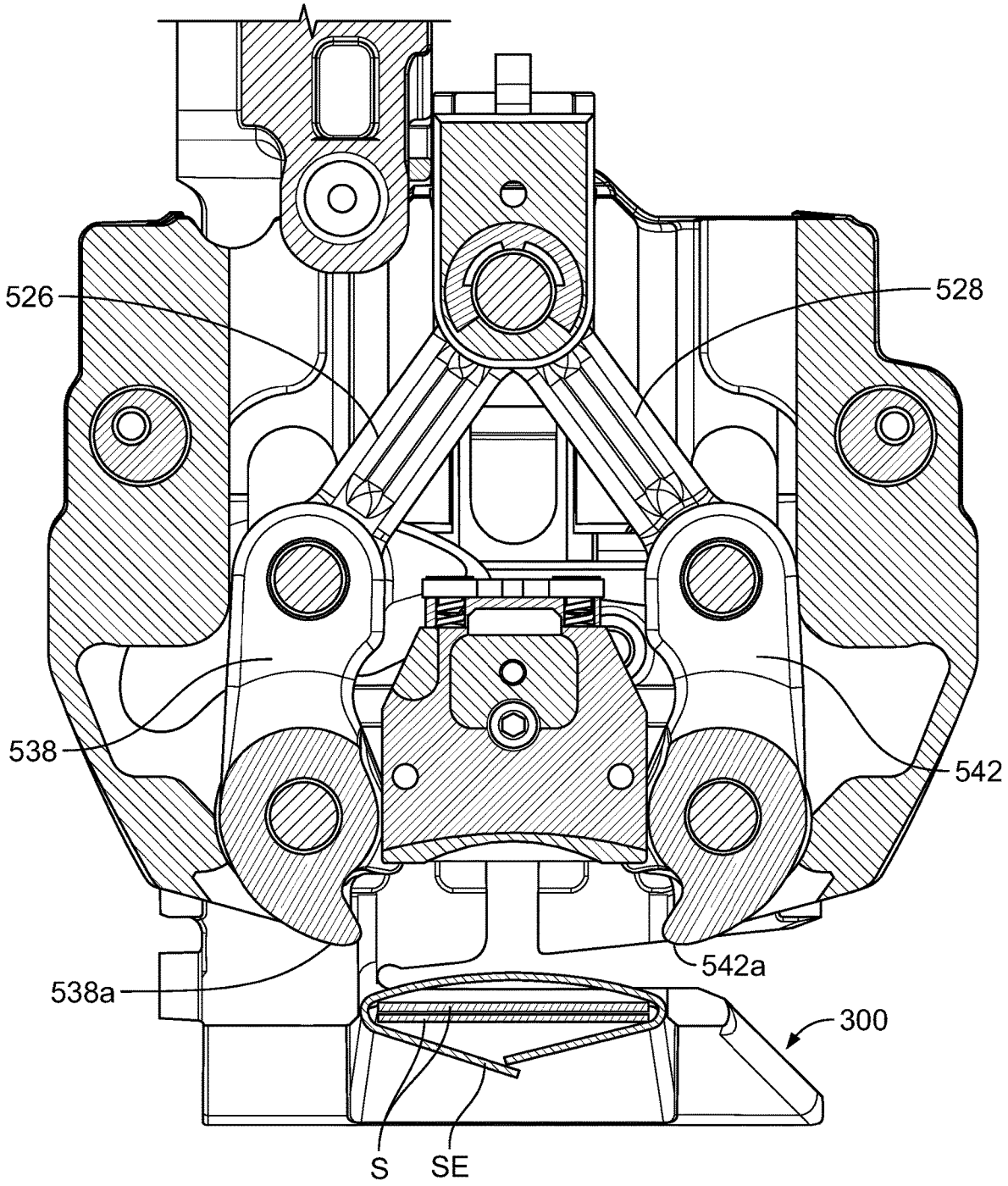
FIG. 17A is a cross-sectional elevational view of part of the support of FIG. 2 and part of the sealing assembly of FIG. 8A with the sealing assembly and the jaws in their home positions.
Figure 17B:
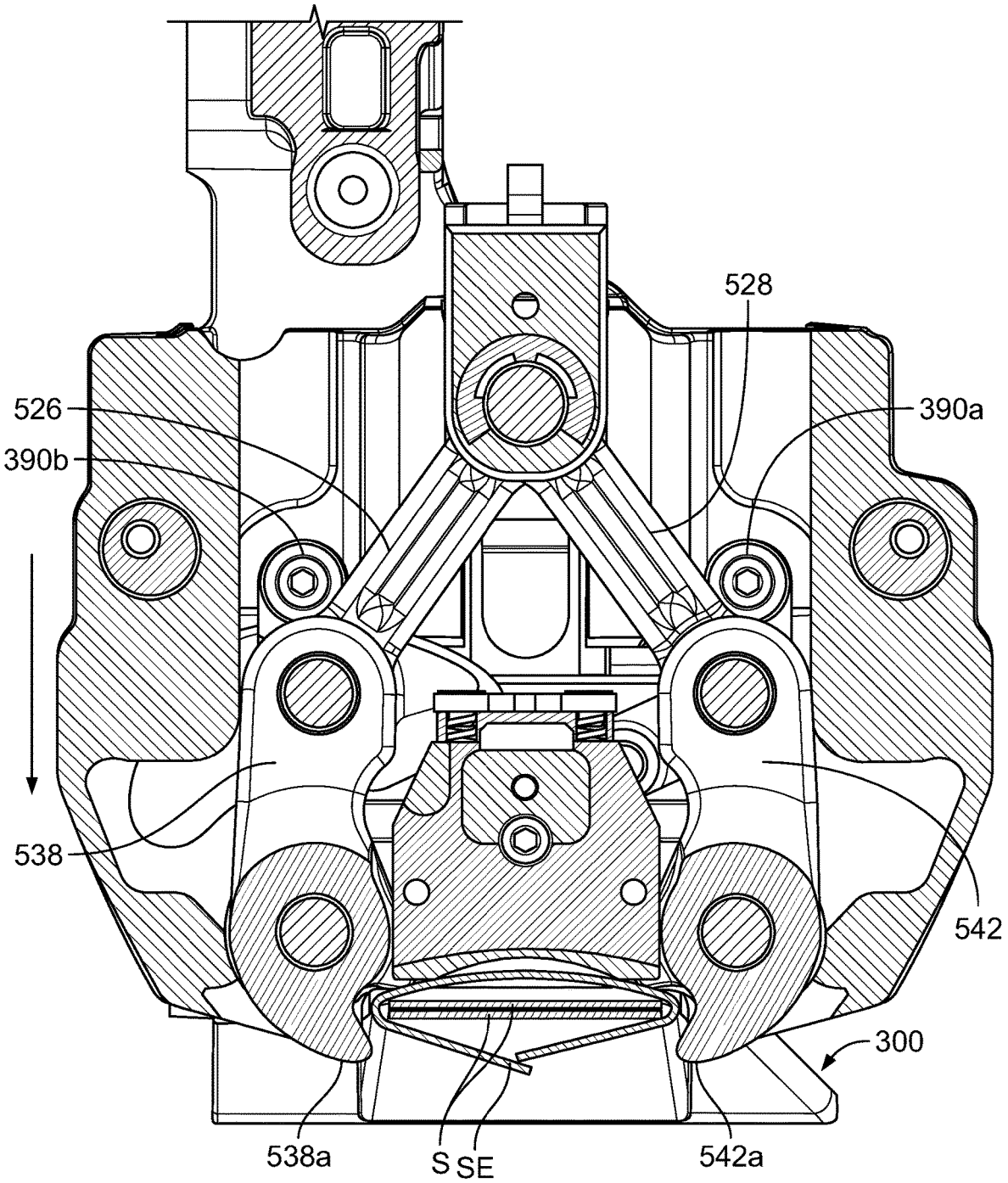
FIG. 17B is a cross-sectional elevational view of the part of the support of FIG. 2 and the part of the sealing assembly of FIG. 8A with the sealing assembly in its sealing position and the jaws in their home positions.

The sealing assembly 500 is movably (and more particularly, slidably) mounted to the support 300 via the back cover 506. Specifically, the back cover 506 is positioned so the first and second sealing-assembly-mounting tongues 372*a* and 372*b* of the support 300 are received in a groove defined between the base 506*a* and the first mounting wing 506*b* and so the third and fourth sealing-assembly-mounting tongues 374*a* and 374*b* of the support 300 are received in a groove defined between the base 506*a* and the second mounting wing 506*c*. This mounting configuration enables the sealing assembly 500 to move vertically relative to the support 300 and prevents the sealing assembly 500 from moving side-to-side or forward and rearward relative to the support 300. As best shown in FIG. 17B, laterally-spaced-apart first and second sealing-assembly-mounting elements 390*a* and 390*b* are fixedly attached to the body 310 of the support 300 and extend through respective vertically-extending slots (not labeled) defined through the base 506*a* of the back cover 506. These slots and sealing-assembly-mounting elements 390*a* and 390*b* co-act to constrain the vertical movement of the sealing assembly 500 relative to the support 300 between a (upper) home position (FIG. 17A) at which the sealing-assembly-mounting elements 390*a* and 390*b* are at the lower ends of the slots and a (lower) sealing position (FIGS. 17B and 17C) at which the sealing-assembly-mounting elements 390*a* and 390*b* are at the upper ends of the slots. As explained below, the drive assembly 700 controls movement of the sealing assembly 500 between its home and sealing positions.

Figure 8A:
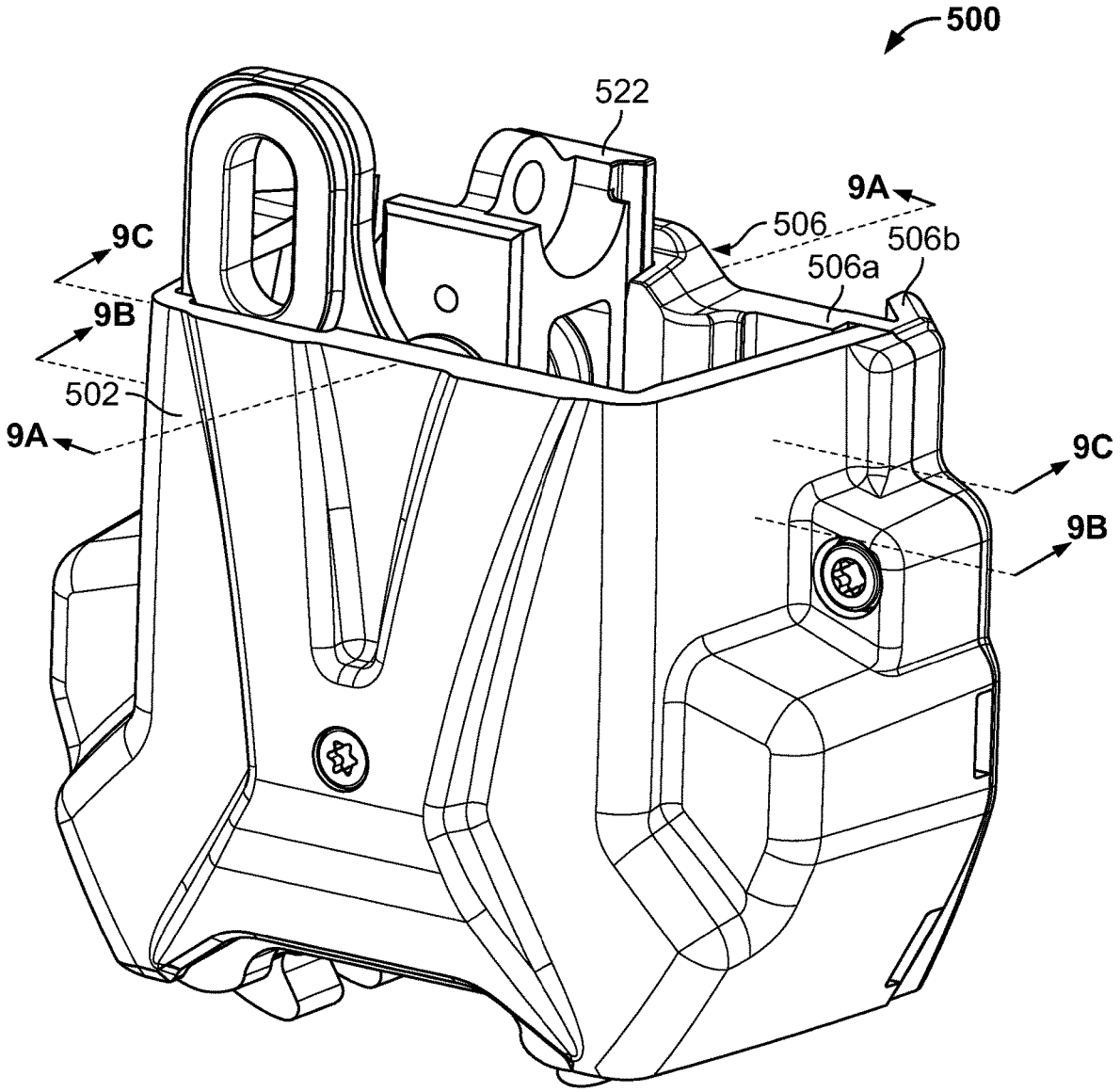
FIGS. 8A and 8B are perspective views of the sealing assembly of the working assembly of FIG. 3A.
Figure 8B:
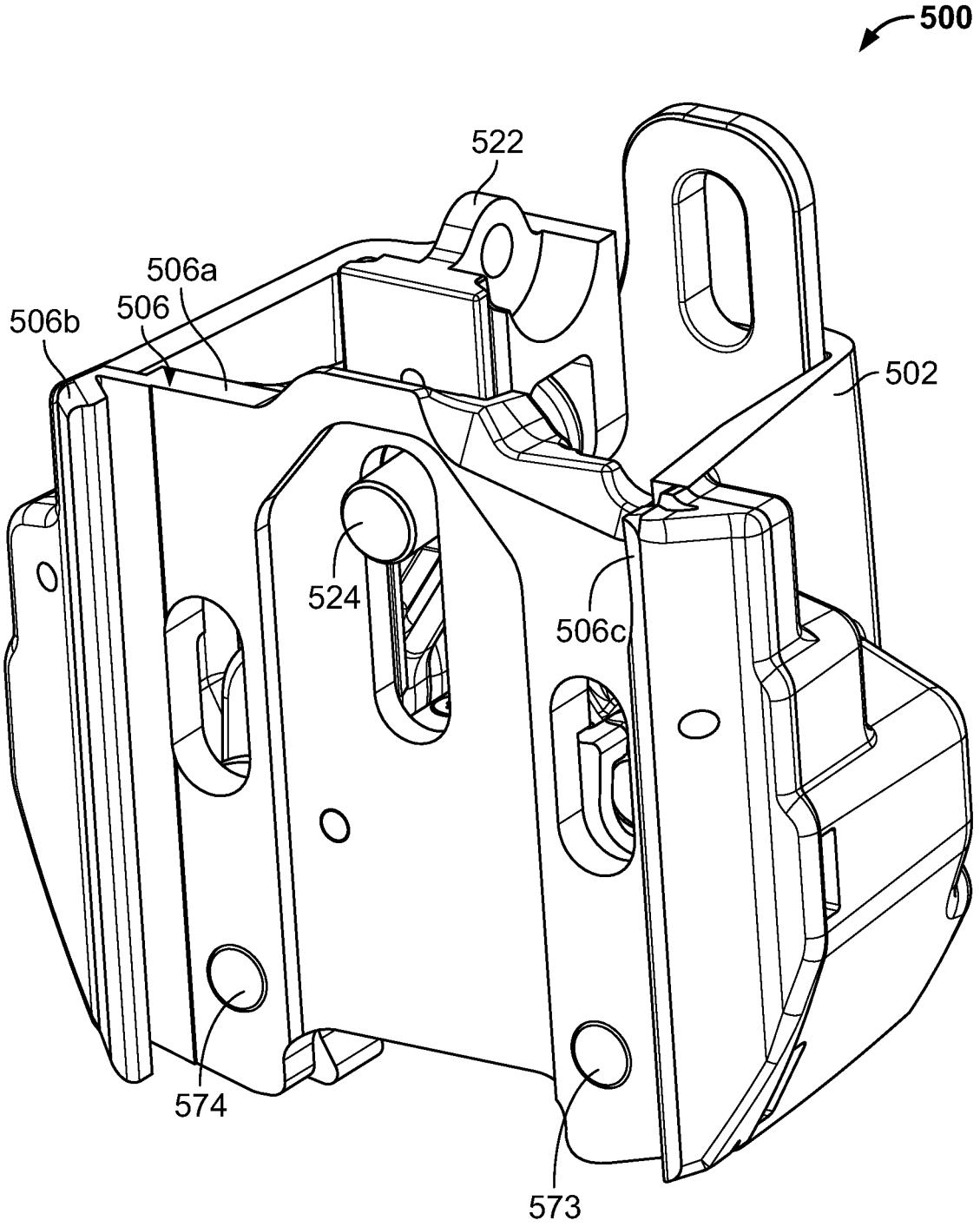
Figure 8C:
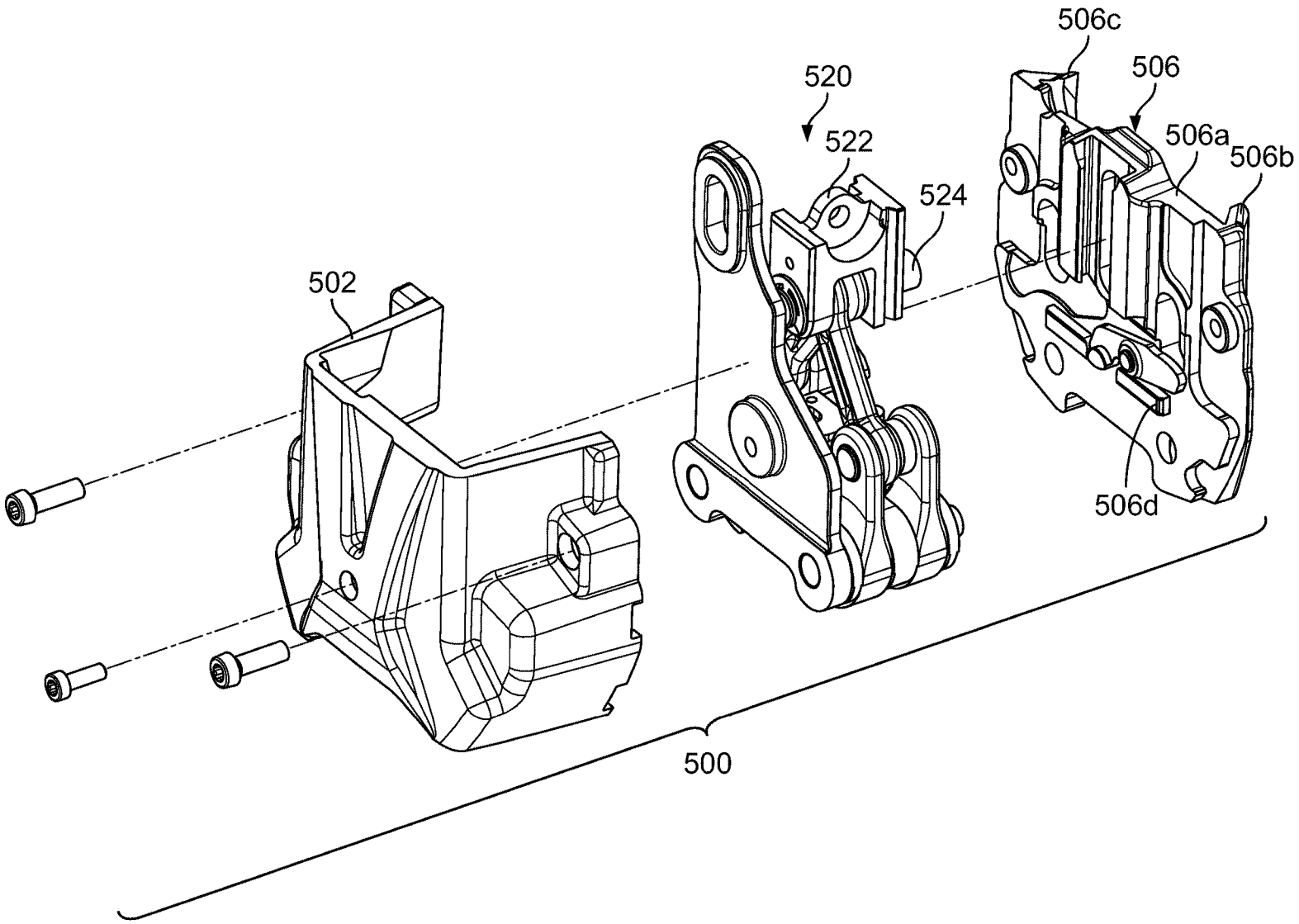
FIGS. 8C and 8D are a partially exploded perspective views of the sealing assembly of FIG. 8A.
Figure 8D:
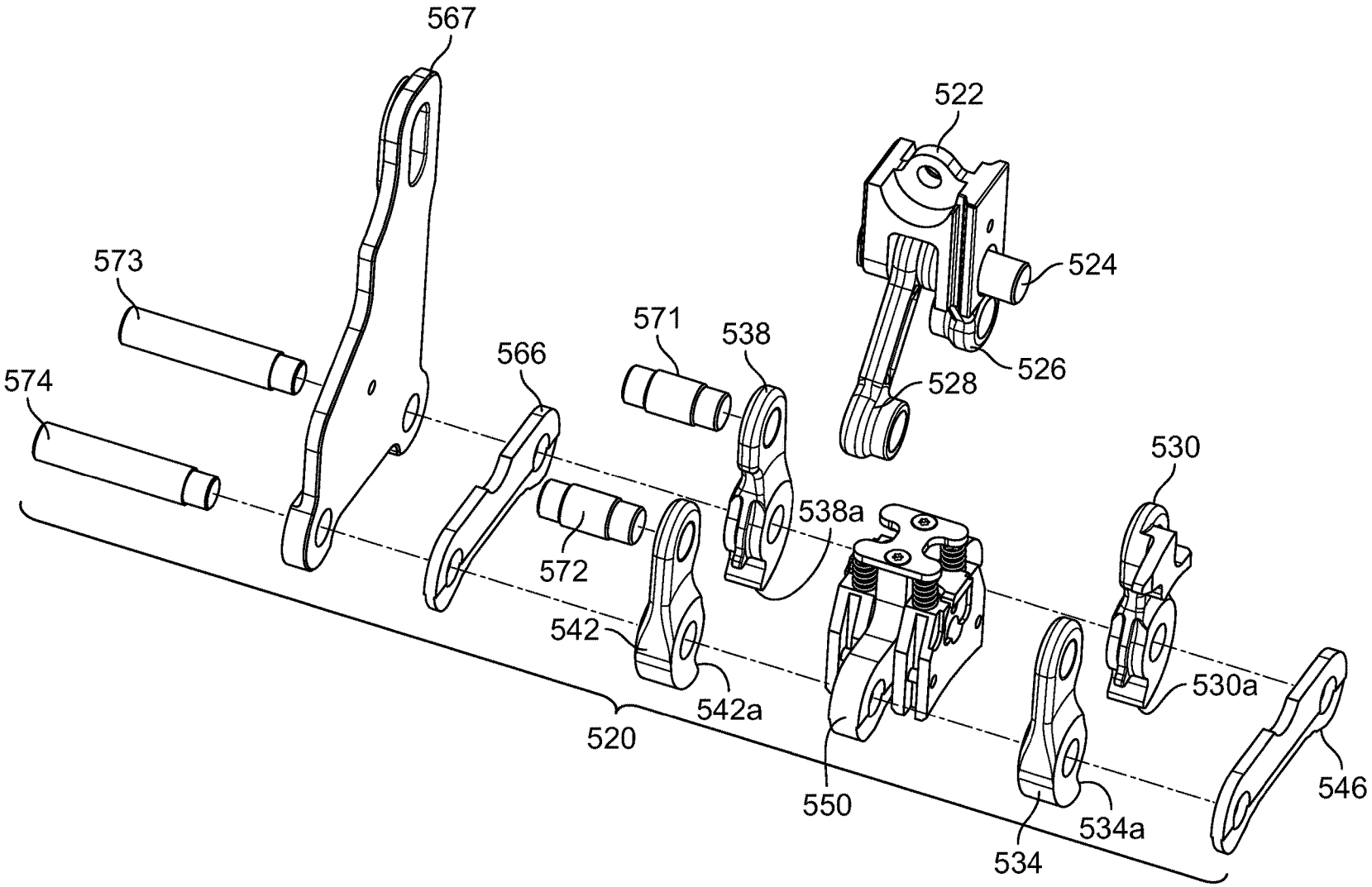

As best shown in FIGS. 8C and 8D, the jaw assembly 520 includes a coupler 522, a coupler pivot 524, first and second coupler/jaw linkages 526 and 528, a first jaw 530, a second jaw 534, a third jaw 538, a fourth jaw 542, a first jaw connector 546, a second jaw connector 550, a third jaw connector 566, a fourth jaw connector 567, first and second upper jaw pivots 571 and 572, and first and second lower jaw pivots 573 and 574. The first and second jaws 530 and 534 form a pair of opposing inner jaws, and the third and fourth jaws 538 and 542 form a pair of opposing outer jaws.

The first and second coupler/jaw linkages 526 and 528 are each pivotably connected to the coupler 522 near their respective upper ends via the coupler pivot 524. This pivotable connection enables the first and second coupler/jaw linkages 526 and 528 to pivot relative to the coupler 522 and the coupler pivot 524 about a longitudinal axis of the coupler pivot 524 (not shown). Here, the coupler pivot 524 includes a pivot pin retained via a retaining ring (not labeled), though it may be any other suitable pivot in other embodiments. As best shown in FIG. 8B, the rear end of the coupler pivot 524 is positioned in a slot (not labeled) defined in the back cover 506 so the slot limits the coupler pivot 524 to moving vertically between an upper and a lower position.

The respective upper portions of each of the first and second jaws 530 and 534 are pivotably connected to the respective lower ends of the coupler/jaw linkages 526 and 528 via the upper jaw pivots 571 and 572, respectively. The respective upper portions of each of the third and fourth jaws 538 and 542 are pivotably connected to the respective lower ends of the coupler/jaw linkages 526 and 528 via the upper jaw pivots 571 and 572, respectively. These pivotable connections enable the first inner and outer jaws 530 and 538 to pivot relative to the coupler/jaw linkage 526 about a longitudinal axis of the upper jaw pivot 571 (not shown) and the second inner and outer jaws 534 and 542 to pivot relative to the coupler/jaw linkage 528 about a longitudinal axis (not shown) of the upper jaw pivot 571.

Figure 17C:
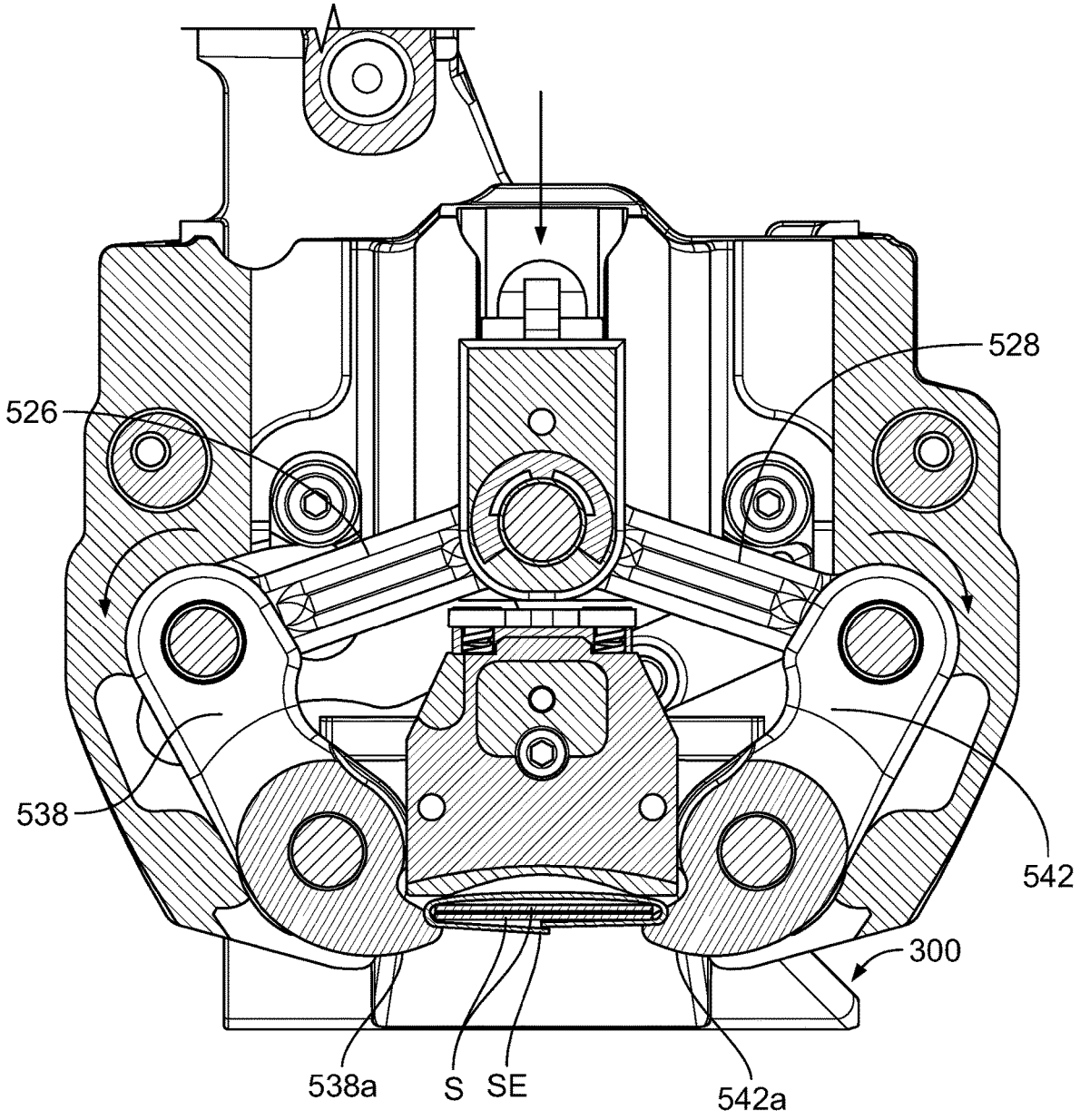
FIG. 17C is a cross-sectional elevational view of the part of the support of FIG. 2 and the part of the sealing assembly of FIG. 8A with the sealing assembly in its sealing position and the jaws in their sealing positions after cutting notches in the seal element and the strap.

The respective lower portions of each of the first and second jaws 530 and 534 are pivotably connected by the lower jaw pivots 573 and 574 to the first jaw connector 546, the second jaw connector 550, the third jaw connector 566, and the fourth jaw connector 567. The respective lower portions of each of the third and fourth jaws 538 and 542 are pivotably connected by the lower jaw pivots 573 and 574 to the first jaw connector 546, the second jaw connector 550, the third jaw connector 566, and the fourth jaw connector 567. The pivotable connections enable the first and third jaws 530 and 538 to pivot relative to the jaw connectors 546, 550, 566, and 567 about a longitudinal axis (not shown) of the lower jaw pivot 573 between respective home positions (FIG. 17A) and sealing positions (FIG. 17C). The pivotable connections enable the second and fourth jaws 534 and 542 to pivot relative to the jaw connectors 546, 550, 566, and 567 about a longitudinal axis (not shown) of the lower jaw pivot 574 between respective home positions (FIG. 17A) and sealing positions (FIG. 17C).

Figure 9A:
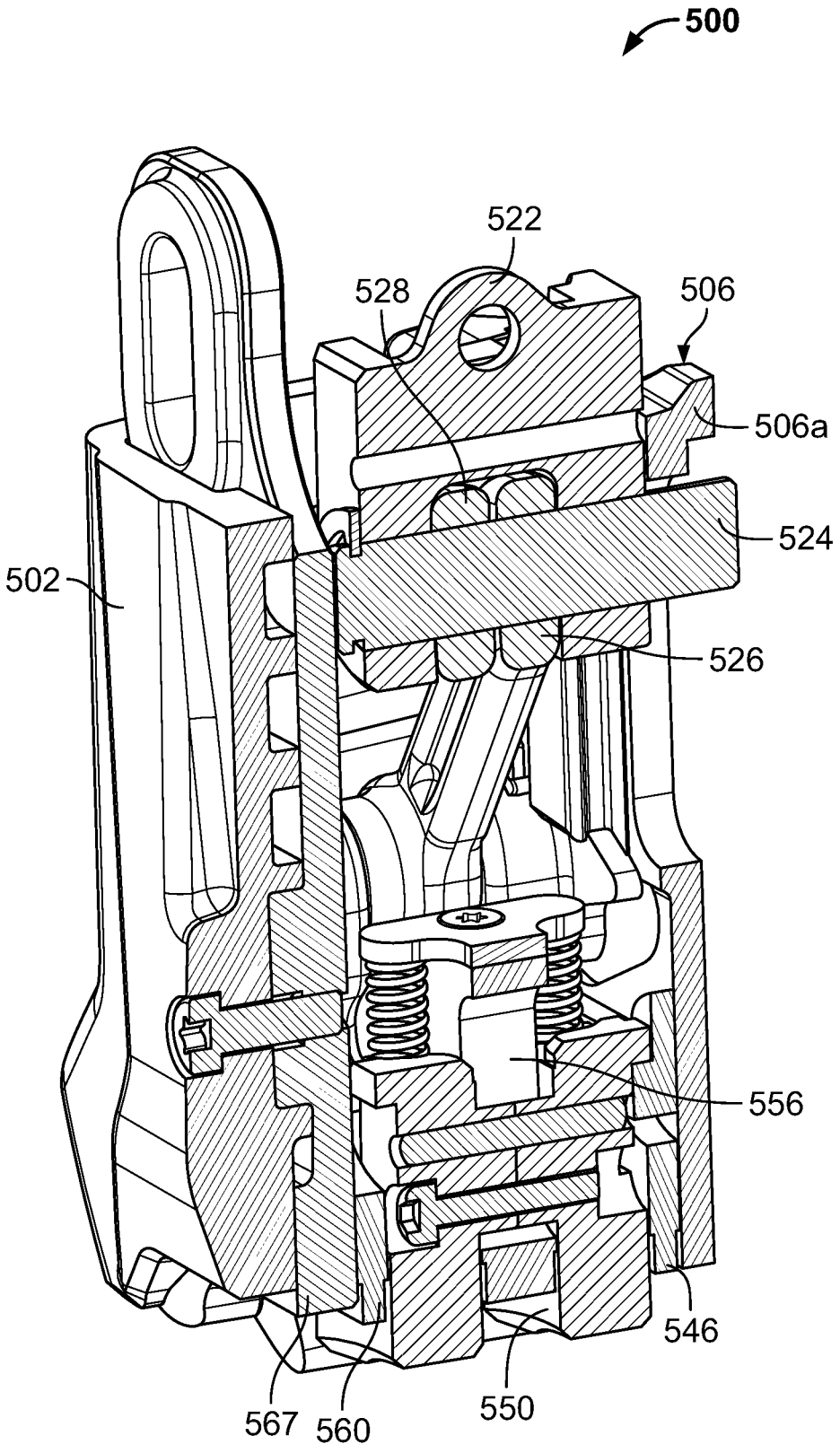
FIG. 9A is a cross-sectional perspective view of the sealing assembly of FIG. 8A taken substantially along line 9A-9A of FIG. 8A.
Figure 9B:
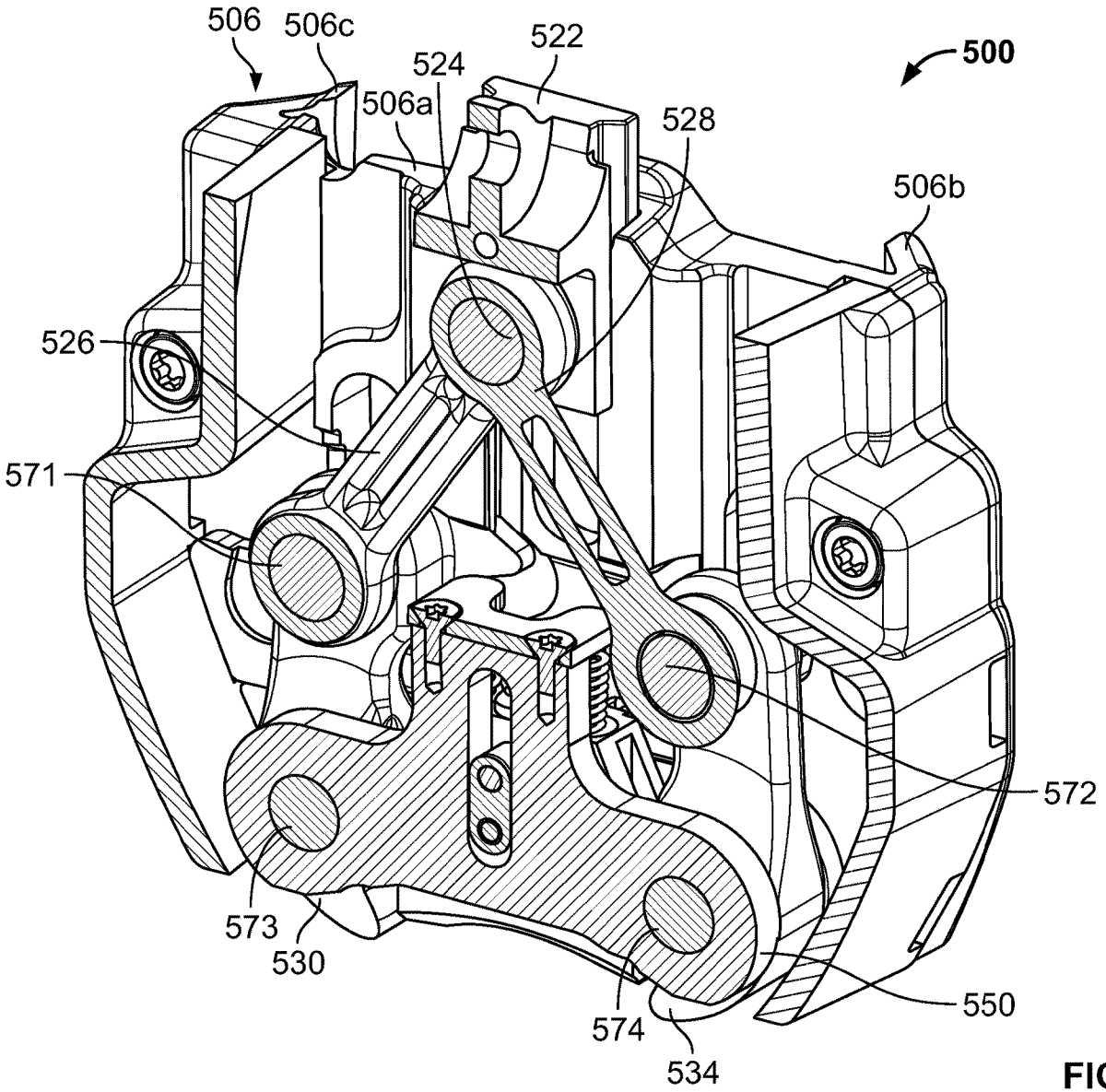
FIG. 9B is a cross-sectional perspective view of the sealing assembly of FIG. 8A taken substantially along line 9B-9B of FIG. 8A.
Figure 9C:
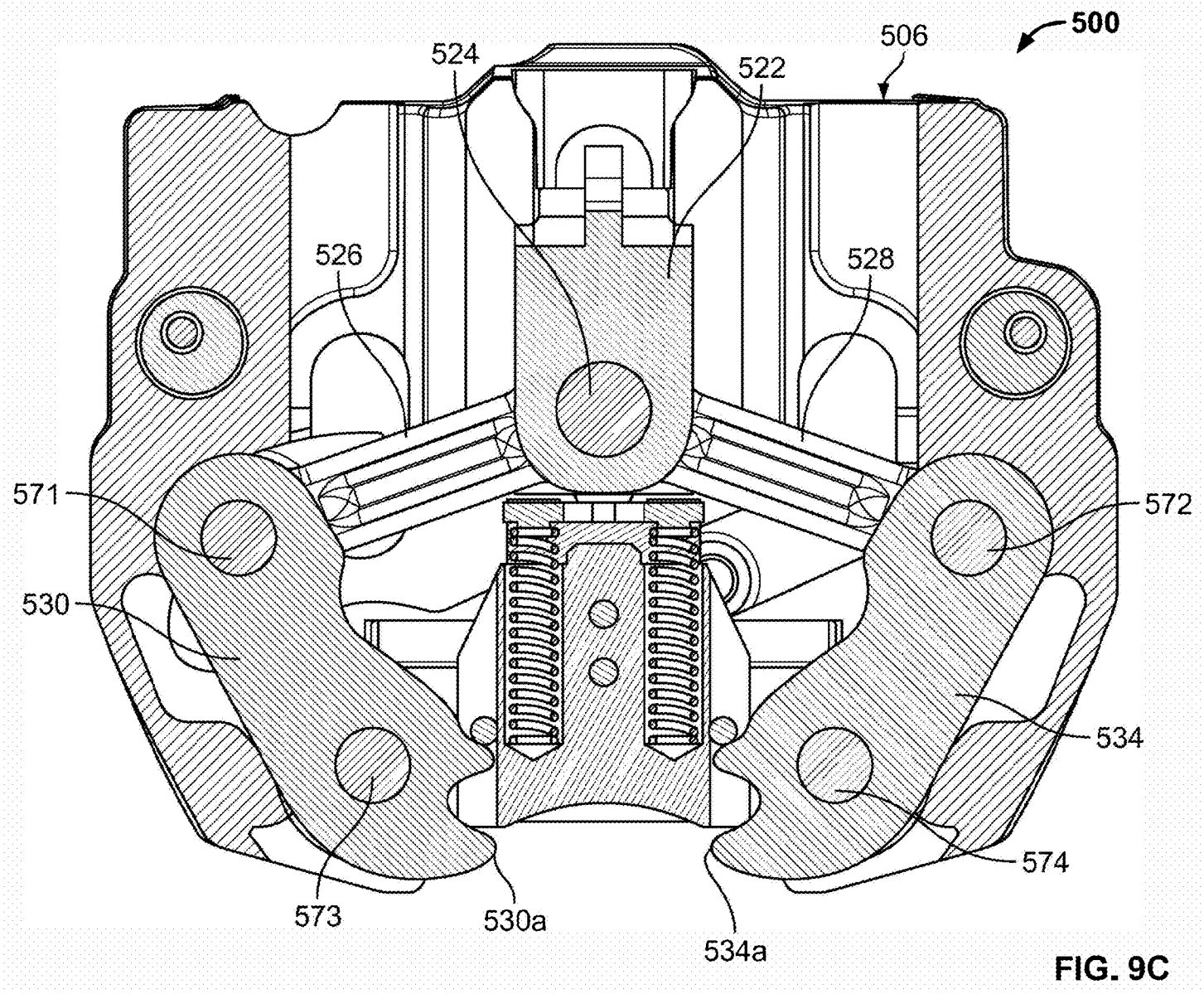
FIG. 9C is a cross-sectional elevational view of the sealing assembly of FIG. 8A taken substantially along line 9C-9C of FIG. 8A.

As best shown in FIGS. 8D and 9C, each jaw has a lower tooth that cuts a notch in the seal element and the overlapping portions of the strap during the sealing cycle. More specifically, the first jaw 530 has a lower tooth 530*a*, the second jaw 534 has a lower tooth 534*a*, the third jaw 538 has a lower tooth 538*a*, and the fourth jaw 542 has a lower tooth 542*a*.

Figure 10:
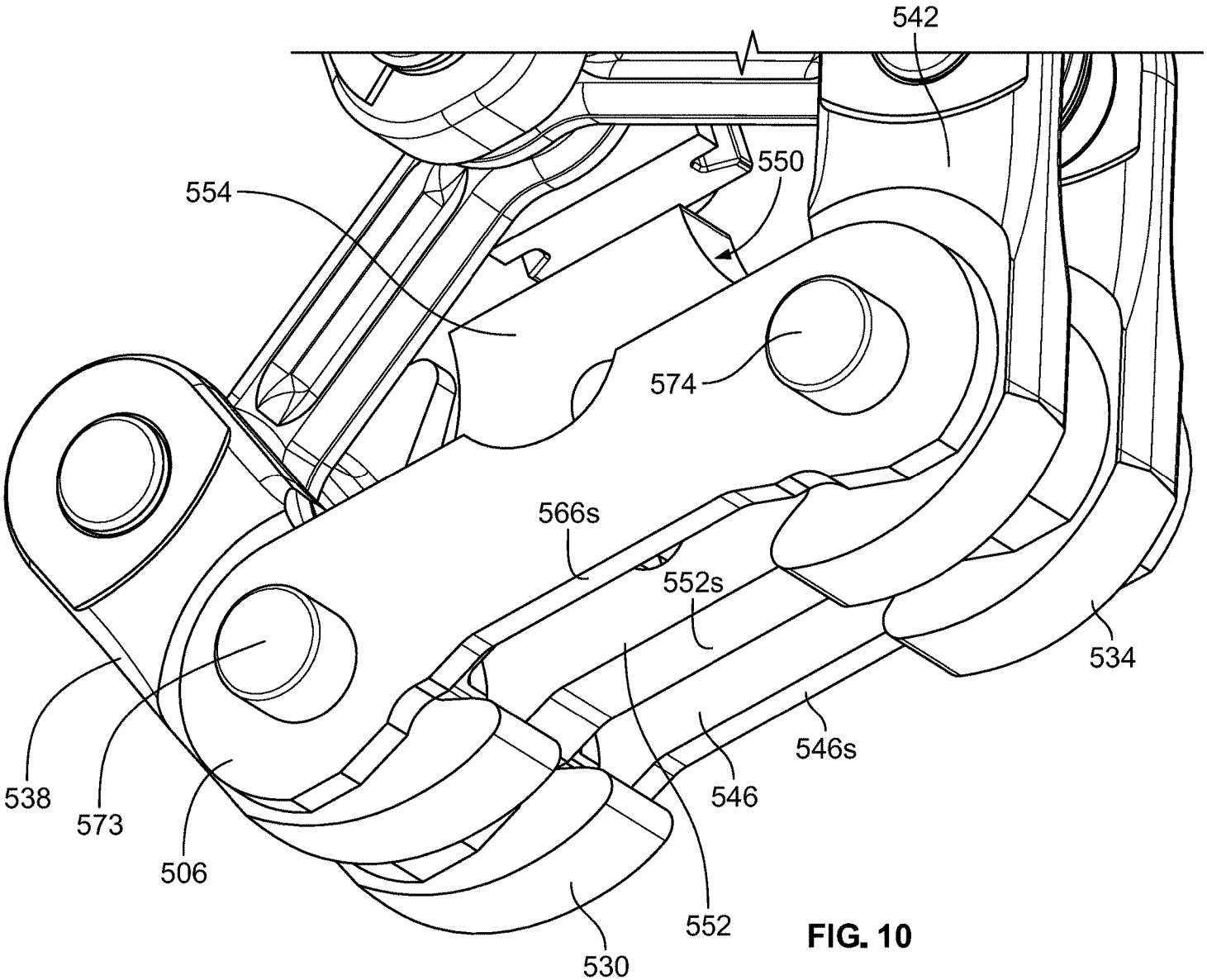
FIG. 10 is a perspective view of part of the sealing assembly of FIG. 8A.

As shown in FIG. 10, the first, second, and third jaw connectors 546, 550, and 566 include respective support surfaces 546*s*, 552*s*, and 566*s* configured to support the seal element during the sealing cycle. In this example embodiment, the support surfaces 546*s*, 552*s*, and 566*s* are planar and parallel to one another. The support surfaces 546*s*, 552*s*, and 566*s* support the seal element during the sealing cycle. In this example embodiment, the support surfaces 546*s* and 566*s* of the first and third jaw connectors 546 and 566 are coplanar while the support surface 552*s* of the second jaw connector 550 is offset below the support surfaces 546*s* and 566*s*, though in other embodiments all three support surfaces may be coplanar.

Although not shown here, a cutter is positioned in and movable within a recess defined in the back cover 506 (best shown in FIG. 8B) and mounted to the coupler pivot 524. Movement of the coupler pivot 524 downwards causes the coupler pivot 524 to force the cutter downward to cut the strap from the strap supply, and movement of the coupler pivot 524 back upward causes the cutter to move back upward.

Figure 11:
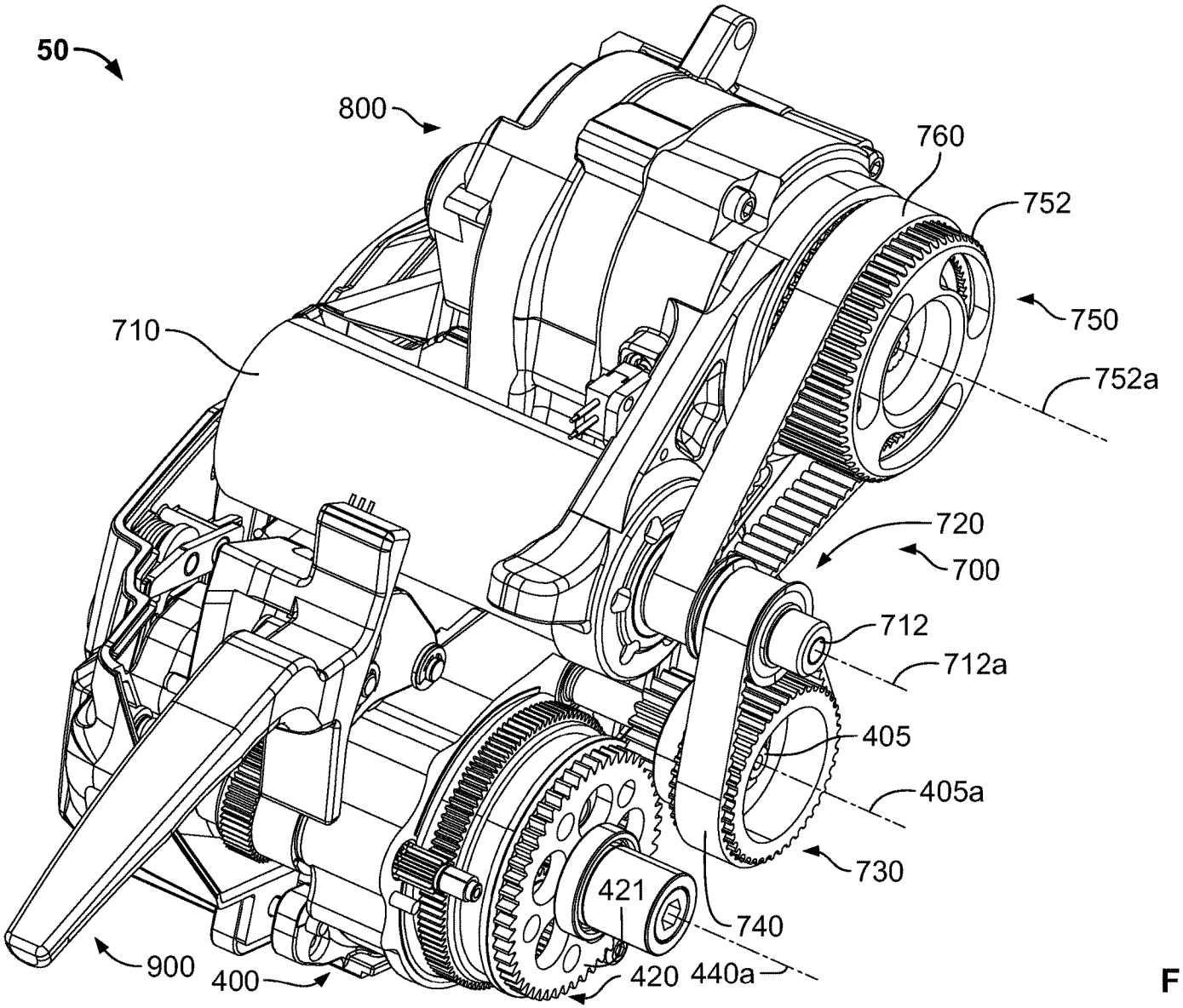
FIG. 11 is a perspective view of the working assembly of FIG. 3A showing the drive assembly.
Figure 12:
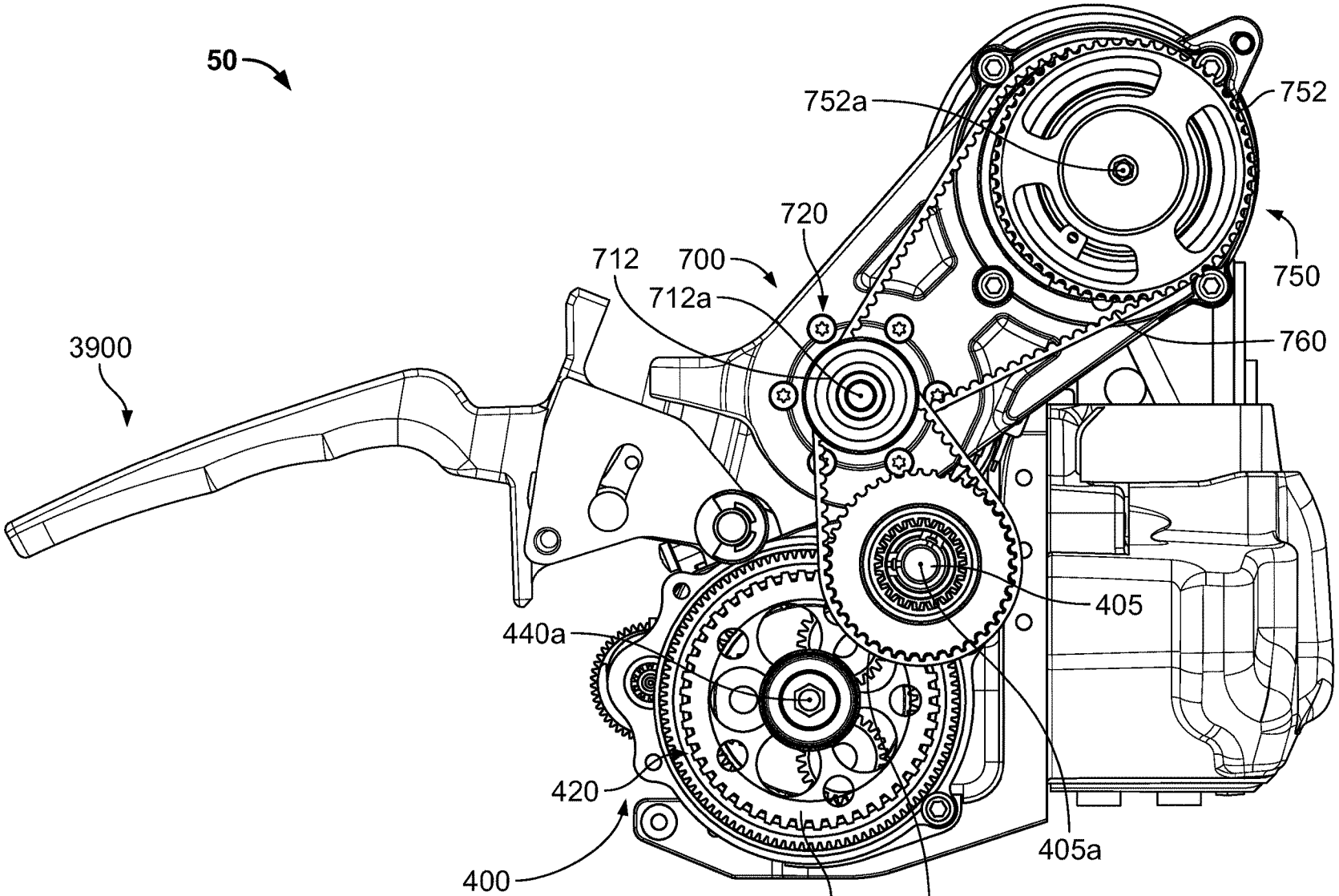
FIG. 12 is a side view corresponding to FIG. 11.

The drive assembly 700, which is best shown in FIGS. 3B, 11, and 12, is operably connected to the tensioning assembly 400 and configured to rotate the tension wheel 440 to tension the strap and is operably connected to the sealing assembly 500 to attach the overlapping portions of the strap to one another. The drive assembly 700 includes a working-assembly actuator 710, a first transmission 720, a second transmission 730, a first belt 740, a third transmission 750, a second belt 760, and a conversion assembly 800.

In this example embodiment, the working-assembly actuator 710 includes a motor (and is referred to herein as the motor 710), and particularly a brushless direct-current motor that includes a motor output shaft 712 having a motor-output-shaft rotational axis 712*a* (though the motor 710 may be any other suitable type of motor in other embodiments). The motor 710 is operably connected to (via the motor output shaft 712) and configured to drive the first transmission 720, which (as described below) is configured to selectively transmit the output of the motor 710 to either the tensioning assembly 400 or the sealing assembly 500. In other embodiments, the strapping tool includes separate tensioning and sealing actuators respectively configured to actuate the tensioning assembly and the sealing assembly rather than a single actuator configured to actuate both.

The first transmission 720 includes any suitable gearing and/or other components that are configured to selectively transmit the output of the motor 710 to the second transmission 730 via the first belt 740 and to the third transmission 750 via the second belt 760. More specifically, the first transmission 720 is configured such that: (1) rotation of the motor output shaft 712 in a first rotational direction causes the first transmission 720 to transmit the output of the motor 710 to the second transmission 730 via the first belt 740 and not to the third transmission 750; and (2) rotation of the motor output shaft 712 in a second rotational direction opposite the first rotational direction causes the first transmission 720 to transmit the output of the motor 710 to the third transmission 750 via the second belt 760 and not to the second transmission 730. Thus, in this embodiment, a single motor (the motor 710) is configured to actuate both the tensioning and sealing assemblies 400 and 500.

To accomplish this selective transmission of the motor output, the first transmission 720 includes a first belt pulley (or other suitable component) (not labeled) mounted on a first freewheel (not labeled) that is mounted on the motor output shaft 712 and a second belt pulley (or other suitable component) (not labeled) mounted on a second freewheel (not labeled) that is mounted on the motor output shaft 712. The first belt pulley is operatively connected (via the first belt 740) to the second transmission 730, and the second belt pulley is operatively connected (via the second belt 760) to the third transmission 750. When the motor output shaft 712 rotates in the first direction: (1) the first freewheel and the first belt pulley rotate with the motor output shaft 712, thereby transmitting the motor output to the second transmission 730 via the first belt 740; and (2) the motor output shaft 712 rotates freely through the second freewheel, which does not rotate the second belt pulley. Conversely, when the motor output shaft 712 rotates in the second direction: (1) the second freewheel and the second belt pulley rotate with the motor output shaft 712, thereby transmitting the motor output to the third transmission 750 via the second belt 760; and (2) the motor output shaft 712 rotates freely through the first freewheel, which does not rotate the first belt pulley. This is merely one example embodiment of the first transmission 720, and it may include any other suitable components in other embodiments.

The second transmission 730 is configured to transmit the output of the first transmission 720 to the tensioning assembly 400 to cause the tension wheel 440 to rotate. More particularly, the second transmission 730 is configured to transmit the output of the first transmission 720 to the tensioning-assembly gearing 420 (and here, the driven gear 421) of the tensioning assembly 400 to rotate the tension-wheel shaft 428*b* and the tension wheel 440 thereon. Accordingly, the motor 710 is operatively coupled to the tension wheel 440 (via the first transmission 720, the first belt 740, the second transmission 730, the tensioning-assembly gearing 420, and the tension-wheel shaft 428*b*) and configured to rotate the tension wheel 440.

The third transmission 750 is configured to transmit the output of the first transmission 720 to the conversion assembly 800. The third transmission 750 may include any suitable components, such as one or more gears and one or more shafts arranged in any suitable manner. In this example embodiment, the third transmission 750 includes third-transmission gearing 752 that is driven in rotation by the second belt 760 about a third-transmission rotational axis 752*a*.

The conversion assembly 800 is configured to transmit the output of the third transmission 750 to the sealing assembly 500 to carry out the sealing cycle, which includes: moving the sealing assembly from its home position to its sealing position, causing the jaws of the sealing assembly to move from their home positions to their sealing positions to cut notches in the seal element and the strap, causing the jaws to move back to their home positions to release the notched seal element and strap, and moving the sealing assembly back to its home position. In doing so, in this embodiment the conversion assembly 800 is configured to convert rotational motion (the rotation of shafts and gears) to linear motion (the reciprocating translational movement of a coupler).

The conversion assembly 800 is best shown in FIGS. 13A-15H and includes a drive wheel 810, a bearing 815, a linkage 820, and a retainer 850.

Figure 13A:
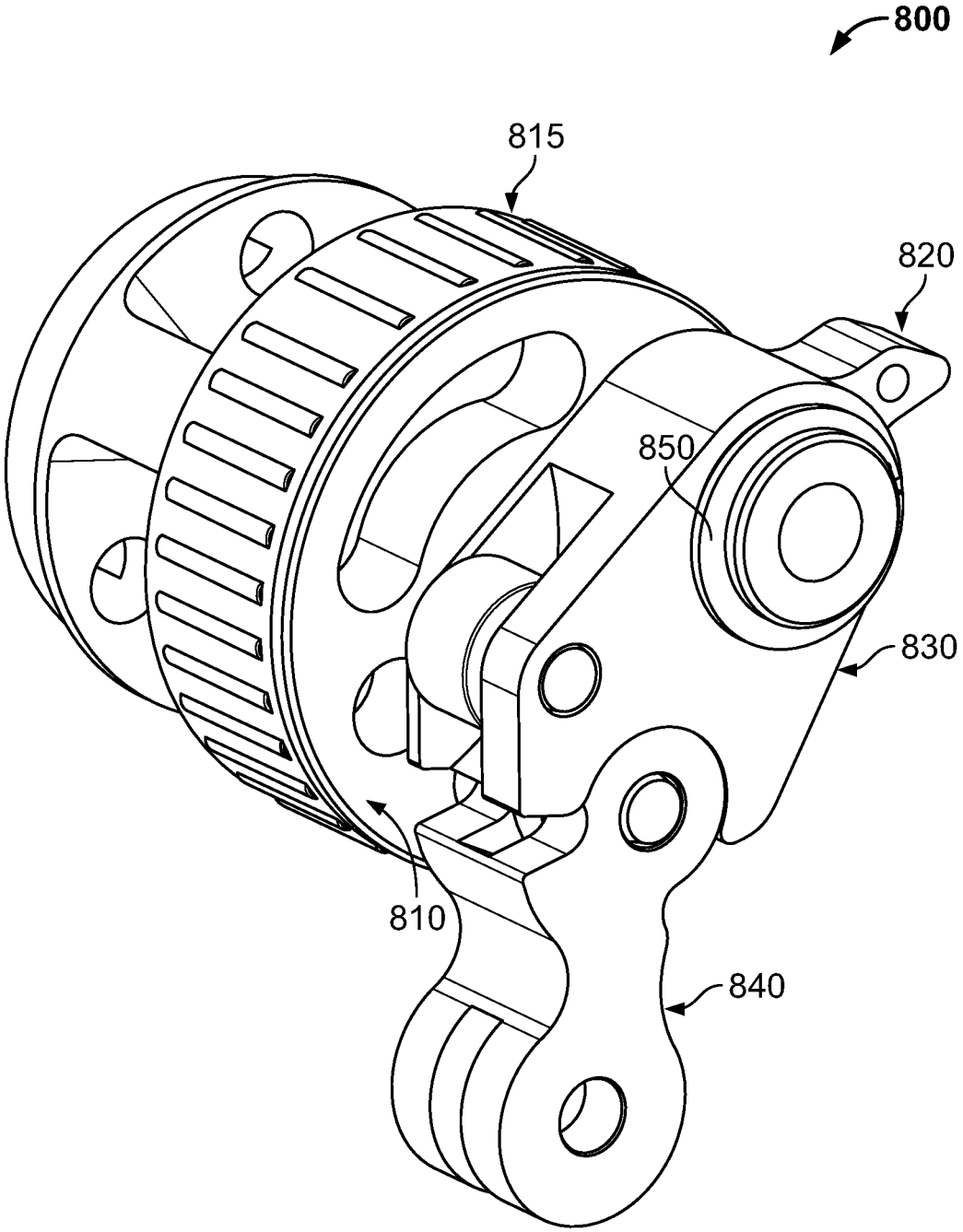
FIG. 13A is a perspective view of the conversion assembly of the drive assembly of the working assembly of FIG. 3A.
Figure 13B:
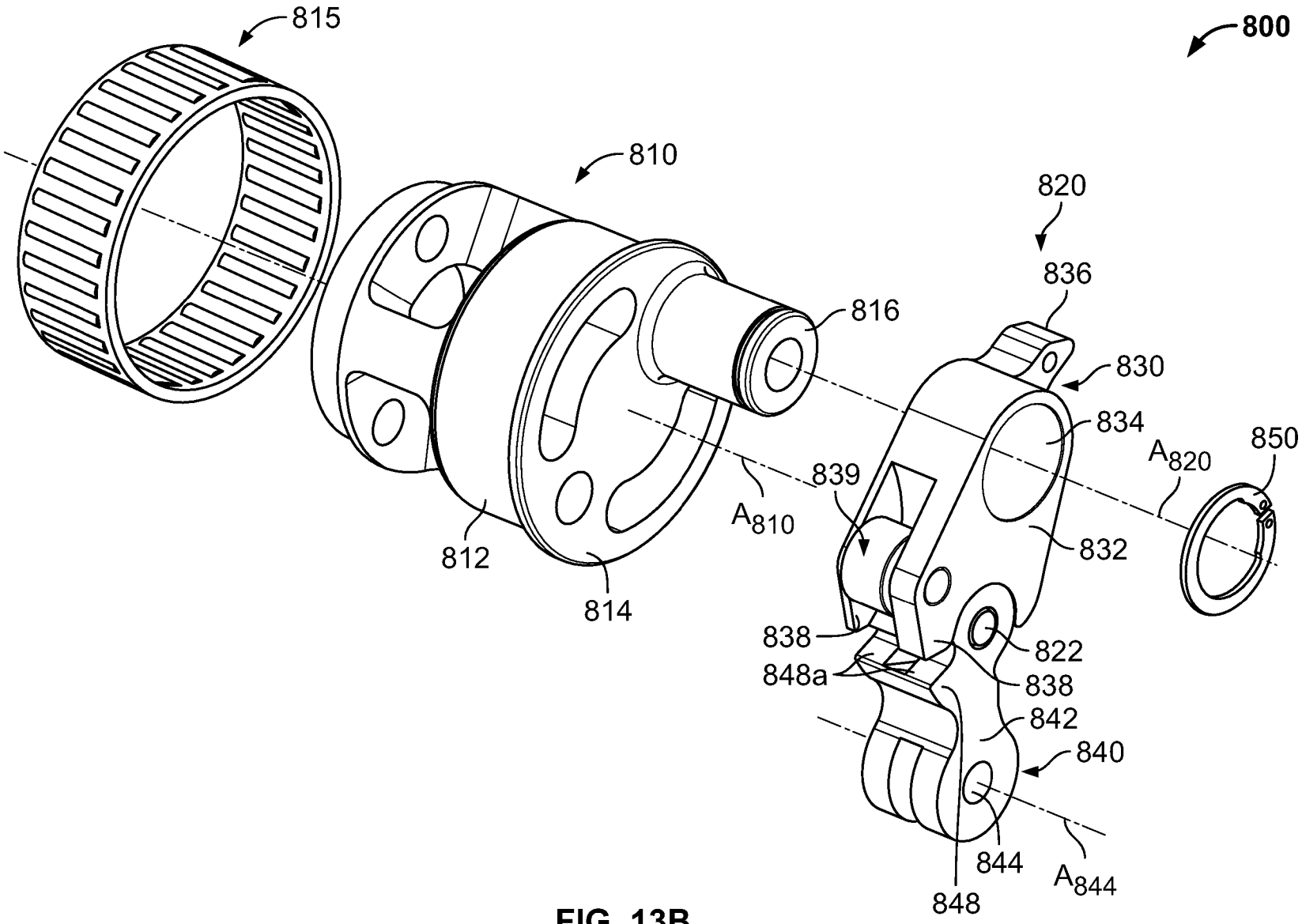
FIG. 13B is an exploded perspective view of the conversion assembly of FIG. 13A.

As best shown in FIG. 13B, the drive wheel 810 includes a generally cylindrical base 812 and a disc-shaped head 814 at one end of the base 812. The base 812 and the head 814 are centered on and rotatable about a drive-wheel rotational axis $A_{810}$. A linkage driveshaft 816 extends from the head 814 and is centered on a linkage rotational axis $A_{820}$. The linkage driveshaft 816 is positioned near the perimeter of the head 814 so the linkage rotational axis $A_{820}$ is radially spaced apart from the drive-wheel rotational axis $A_{810}$.

The linkage 820 includes a first link 830 and a second link 840. The first link 830 includes a body 832 having a head and an opposing foot. A linkage-driveshaft mounting opening 834 is defined through the head of the body 832. A first support engager 836 extends radially from the head of the body 832. The foot of the body 832 includes one or more (here, two) stop fingers 838. A second support engager 839 (here, a roller) is mounted between the stop fingers 838. The second link 840 includes a body 842 having a head and an opposing foot. A coupler-mounting opening 844 is defined through the foot of the body 842. Near the head, the body 842 includes a stop element 848 including one or more (here, two) stop surfaces 848*a*. The first and second links 830 and 840 are connected to one another via a pivot 822 that extends between the foot of the body 832 of the first link 830 and the head of the body 842 of the second link 840. The first and second links 830 and 840 are pivotable relative to one another about the pivot 822. Once connected, the head of the body 832 of the first link 830 forms the head of the linkage 820 (and is referred to as such below), and the foot of the body 842 of the second link 840 forms the foot of the linkage 820 (and is referred to as such below).

As best shown in FIG. 3A, the base 812 of the drive wheel 810 is journaled in the drive-and-conversion-assembly-mounting element 340 of the support 300 via the bearing 815, which is a roller bearing in this example embodiment, so the drive wheel 810 can rotate relative to the support 300 about the drive-wheel rotational axis $A_{810}$. As best shown in FIG. 13A, the linkage driveshaft 816 of the drive wheel 810 is received in the linkage-driveshaft mounting opening 834 of the first link 830 of the linkage mount 820 to mount the linkage 820 to the drive wheel 810. The retaining ring 850 is inserted into a groove (not labeled) defined around the perimeter of the linkage driveshaft 816 to retain the linkage 820 on the drive wheel 810. Once mounted, the linkage 820 is rotatable relative to the drive wheel 810 about the linkage rotational axis $A_{820}$.

Although not shown, the third transmission 750 is operably connected to the drive wheel 810 (such as via a shaft and suitable gearing) and configured to rotate the drive wheel 810 about the drive-wheel rotational axis $A_{810}$. The foot of the linkage 820 is pivotably connected to the coupler 522 of the sealing assembly 500 via a pin (not labeled) that extends through the coupler-mounting opening 844, as best shown in FIGS. 3A, 13A, and 13B, so the linkage 820 is pivotable relative to the coupler 522 about an axis $A_{844}$ (FIG. 13A). Accordingly, the motor 710 is operatively coupled to the sealing assembly 500 (via the third transmission 750, the second belt 760, and the conversion assembly 800) and configured to control the sealing assembly 500 to carry out a sealing cycle, as described below.

More specifically, rotation of the motor output shaft 712 of the motor 710 in the second rotational direction causes rotation of the second belt pulley of the first transmission 720. The second belt 760 transmits the output of the first transmission 720 (in this instance, the rotation of the second belt pulley) to the third transmission 750, which in turn transmits the output of the first transmission 720 to the conversion assembly 800. More specifically, the third transmission 750 transmits the output of the first transmission 720 to the drive wheel 810 of the conversion assembly 800, which causes the drive wheel 810 to rotate about the drive-wheel rotational axis $A_{810}$, carrying the linkage 820 with it.

Figure 14B:
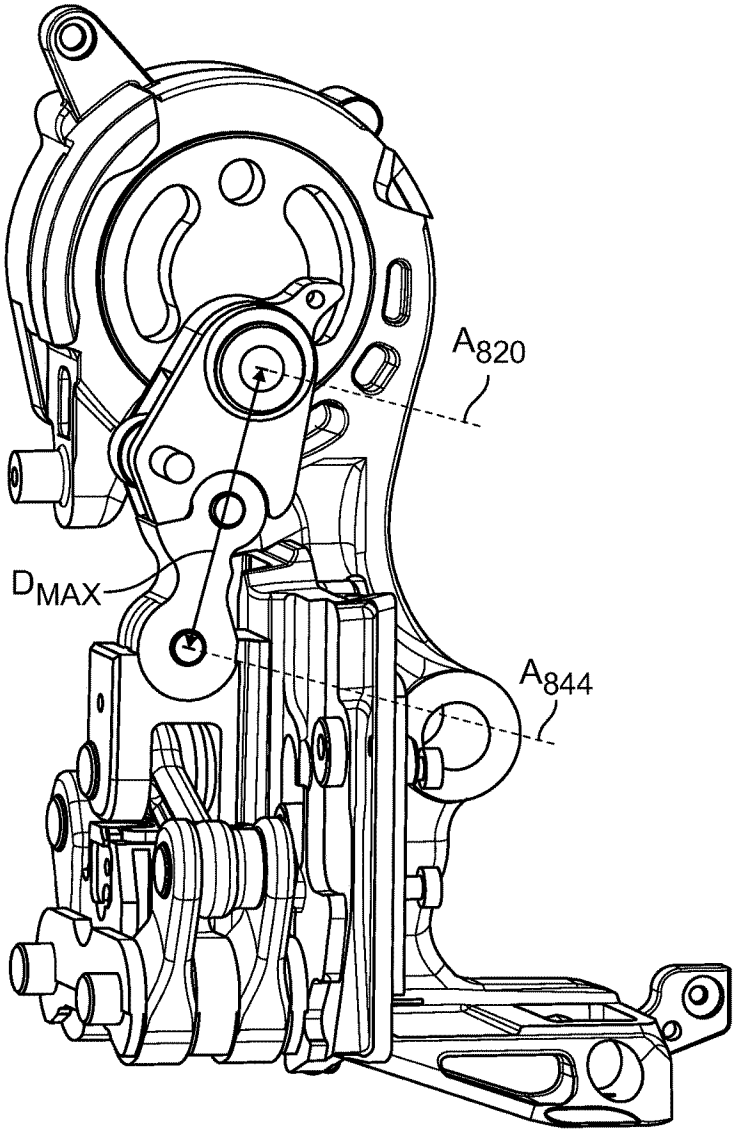
FIG. 14B is a perspective view of the part of the support of FIG. 2, part of the sealing assembly of FIG. 8A, and the part of the conversion assembly of FIG. 13A in which the effective length of the linkage of the conversion assembly is at a maximum.
Figure 14A:
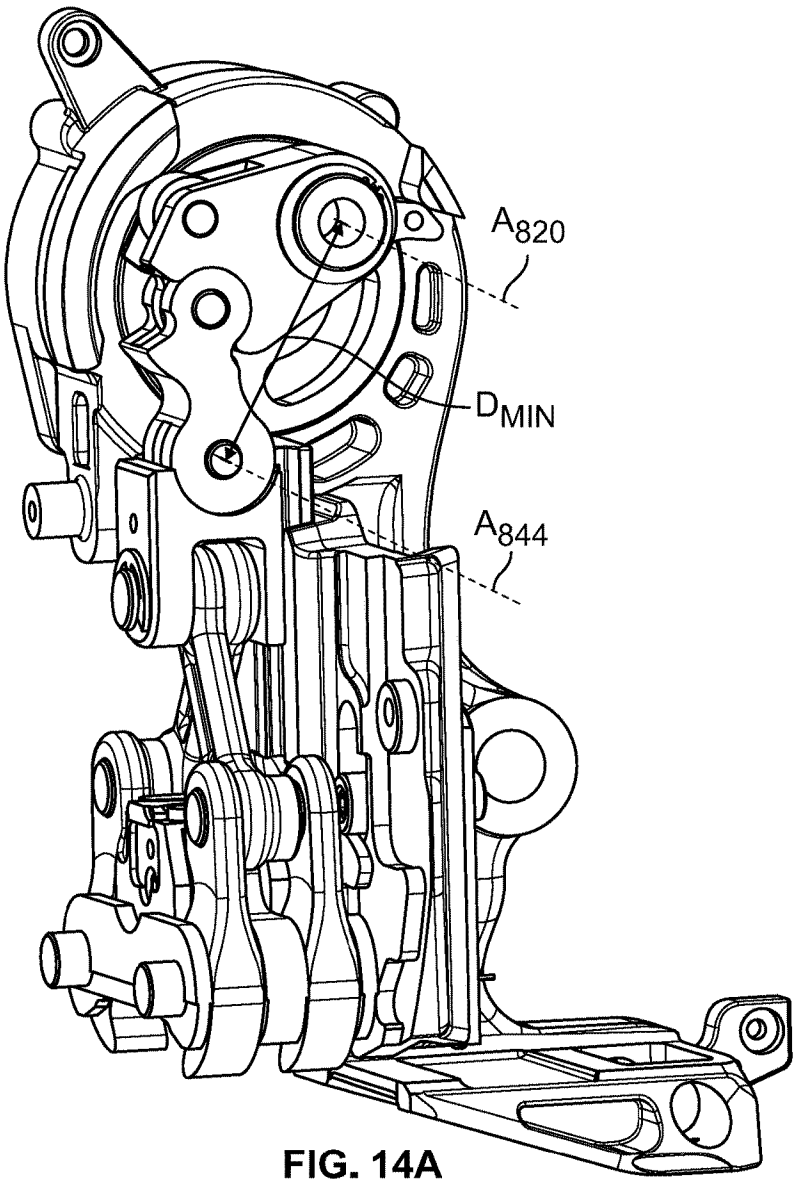
FIG. 14A is a perspective view of part of the support of FIG. 2, part of the sealing assembly of FIG. 8A, and part of the conversion assembly of FIG. 13A in which the effective length of the linkage of the conversion assembly is at a minimum.
Figure 15A:
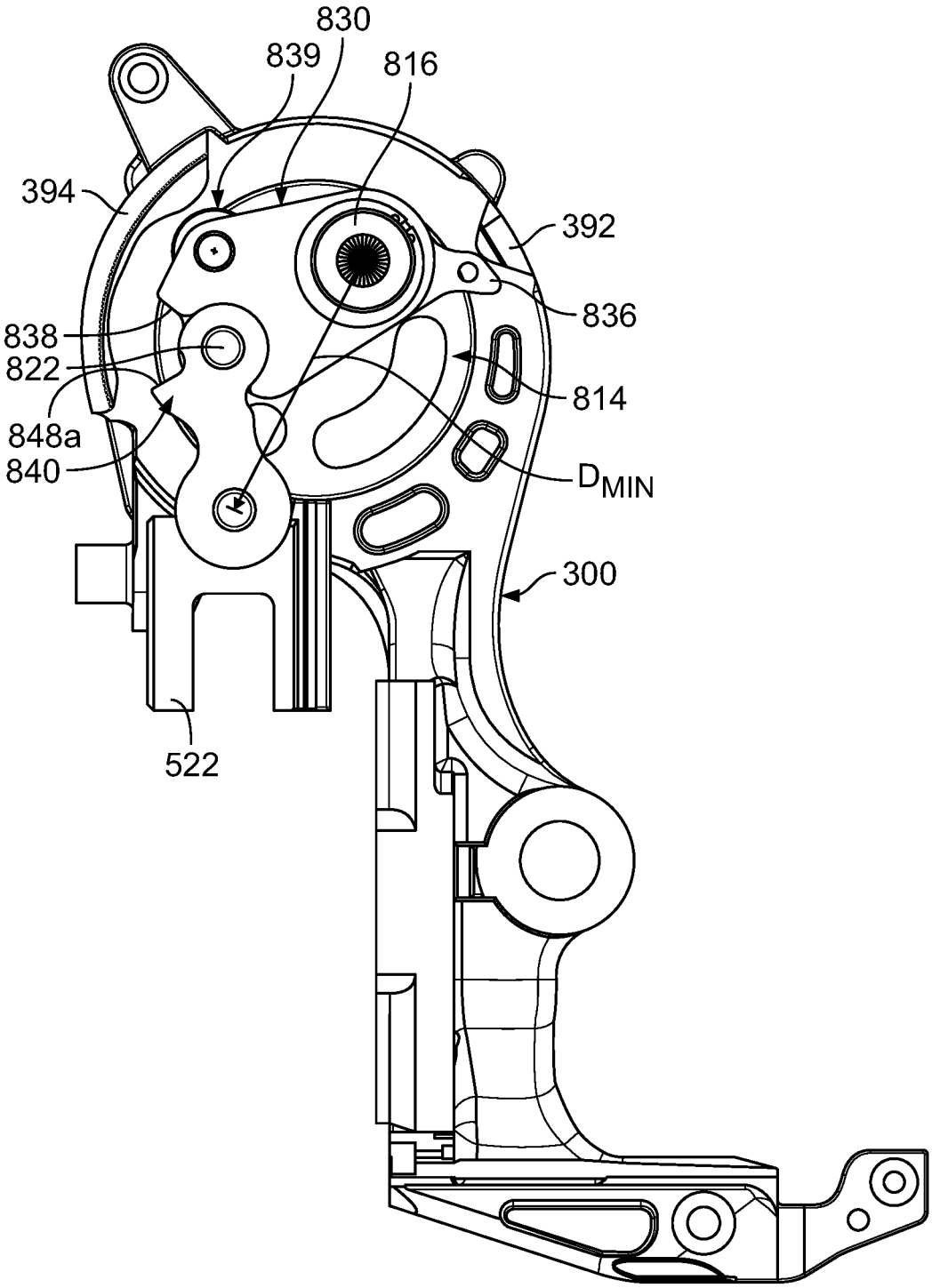
FIGS. 15A-15H are side views of the support of FIG. 2 and part of the conversion assembly of FIG. 13A illustrating how the effective length of the linkage of the conversion assembly varies during the sealing cycle.

The drive wheel 810 has a home position, a sealing position, and a sealing-cycle-interrupt position. The one or more sensors 1700 include a home-position sensor 1720 (FIG. 1B) positioned, oriented, and otherwise configured to detect when the drive wheel 810 is at its home position and to communicate this to the controller 1300. The home-position sensor may be any suitable sensor, such as a microswitch, a hall-effect sensor, an or an ultrasonic sensor. As best shown in FIGS. 14A and 15A, when the drive wheel 810 is in its home position: the foot of the linkage 820 is at its home position (which is its uppermost position in this example embodiment); the sealing assembly 500 is in its home position; and the jaws 530, 534, 538, and 542 are in their respective home positions. Upon initiation of the sealing cycle, the drive wheel 810 begins rotating (counter-clockwise in this example embodiment) from its home position to its sealing position. As the drive wheel 810 rotates from its home position to its sealing position, the linkage 820 imparts a force on the coupler 522 that causes the coupler to force the sealing assembly 500 to move from its home position toward its sealing position.

After the sealing assembly 500 reaches its sealing position (and before the drive wheel 810 reaches its sealing position), continued rotation of the drive wheel 810 toward its sealing position causes the coupler 522 to move toward the jaws relative to the front and back plates 502 and 506 of the sealing assembly 500 (guided by the coupler pivot 524 received in the slot defined in the back plate). This causes downward movement of the upper ends of first and second coupler/jaw linkages 526 and 528, which causes outward movement of the lower ends of the first and second coupler/jaw linkages 526 and 528. This causes outward movement of the upper portions of the jaws. This causes inward movement of the lower portions of the jaws. In other words, this causes the jaws to pivot from their respective home positions to their respective sealing positions. The jaws are in their respective sealing positions when the foot of the linkage 820 reaches its sealing position (which is its lowermost position in this example embodiment) and the drive wheel 810 reaches its sealing position, as shown in FIGS. 14B and 15F. Continued rotation of the drive wheel 810 back to its home position reverses the above movements: the jaws move from their sealing positions back to their home positions, and afterwards the sealing assembly moves back to its home position.

In this example embodiment, the sealing-cycle-interrupt position of the drive wheel 810 is between the sealing position and the home position. When the drive wheel 810 is in the sealing-cycle-interrupt position, the sealing assembly 500 is still in its sealing position and the jaws 530, 534, 538, and 542 are in sealing-cycle-interrupt positions in which their respective lower teeth engage the seal element and the strap and pin the seal element and the strap against the seal-support surfaces 546*s*, 552*s*, and 566*s* of the jaw connectors 540, 550, and 560 of the sealing assembly 500. In this example embodiment, the jaws are between their respective home and sealing positions when in their sealing-cycle-interrupt positions, but in other embodiments the sealing-cycle-interrupt and sealing positions are the same. As described below in conjunction with FIG. 19, when the strapping tool 50 is operated in the sealing-cycle-interrupt operating mode, the controller 1600 pauses the sealing cycle after the interrupt condition has been met and completes the sealing cycle after the release condition has been met.

The components of the conversion assembly 800 are sized, shaped, positioned, oriented, and otherwise configured to change the distance between the head and the foot of the linkage during the sealing cycle. Put differently, the components of the conversion assembly 800 are sized, shaped, positioned, oriented, and otherwise configured to change the effective length of the linkage 820—which in this example embodiment is the distance D between the axes $A_{820}$ and $A_{844}$—during the sealing cycle to rapidly move the sealing assembly 500 toward its sealing position (by increasing the effective length of the linkage 820) and, after notching, back toward its home position (by decreasing the effective length of the linkage 820). The minimum effective length of the linkage 820 is $D_{MIN}$, and the maximum effective length of the linkage 820 is $D_{MAX}$, as shown in FIGS. 14A and 14B.

Figure 15B:
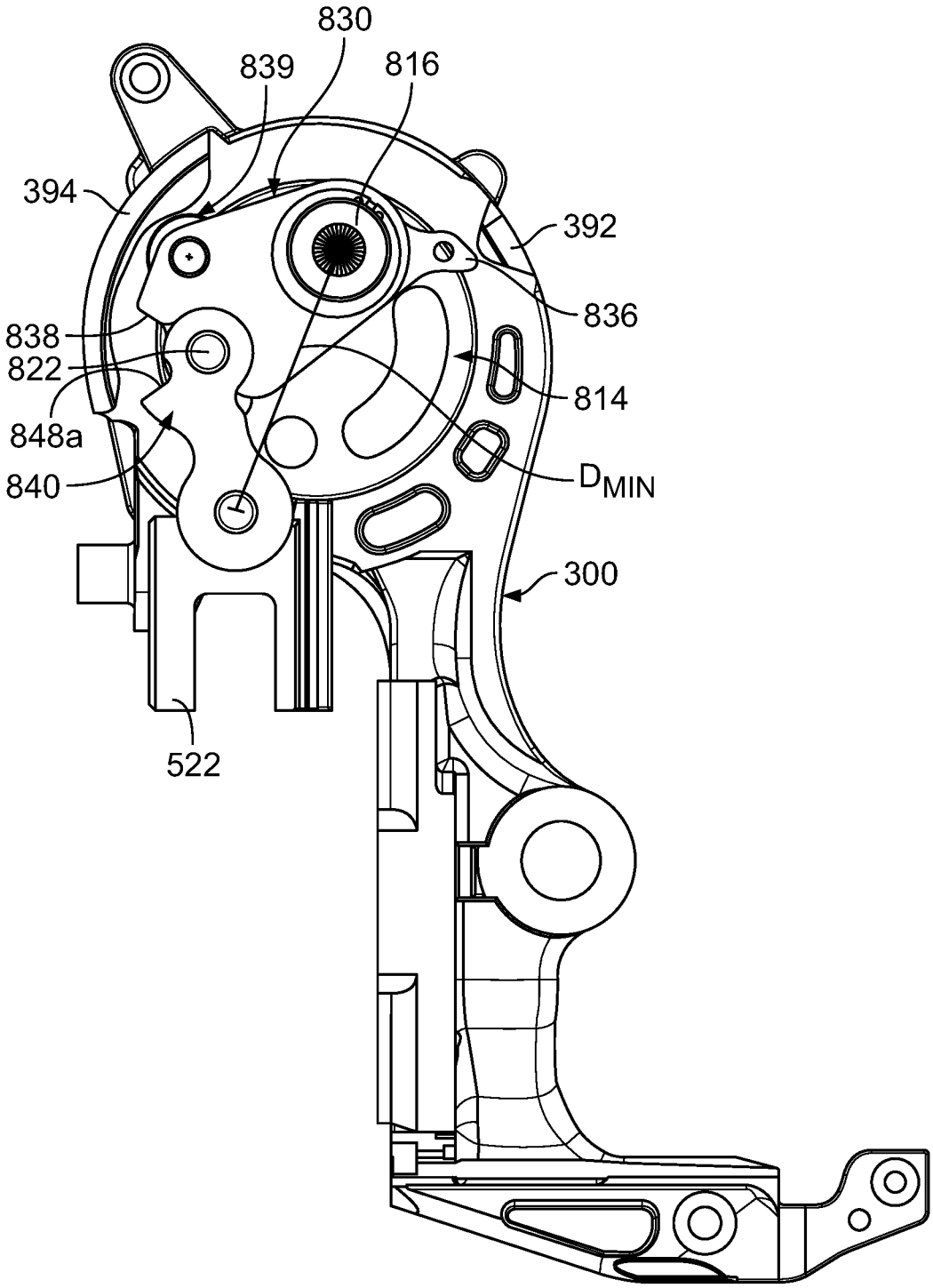
Figure 15C:
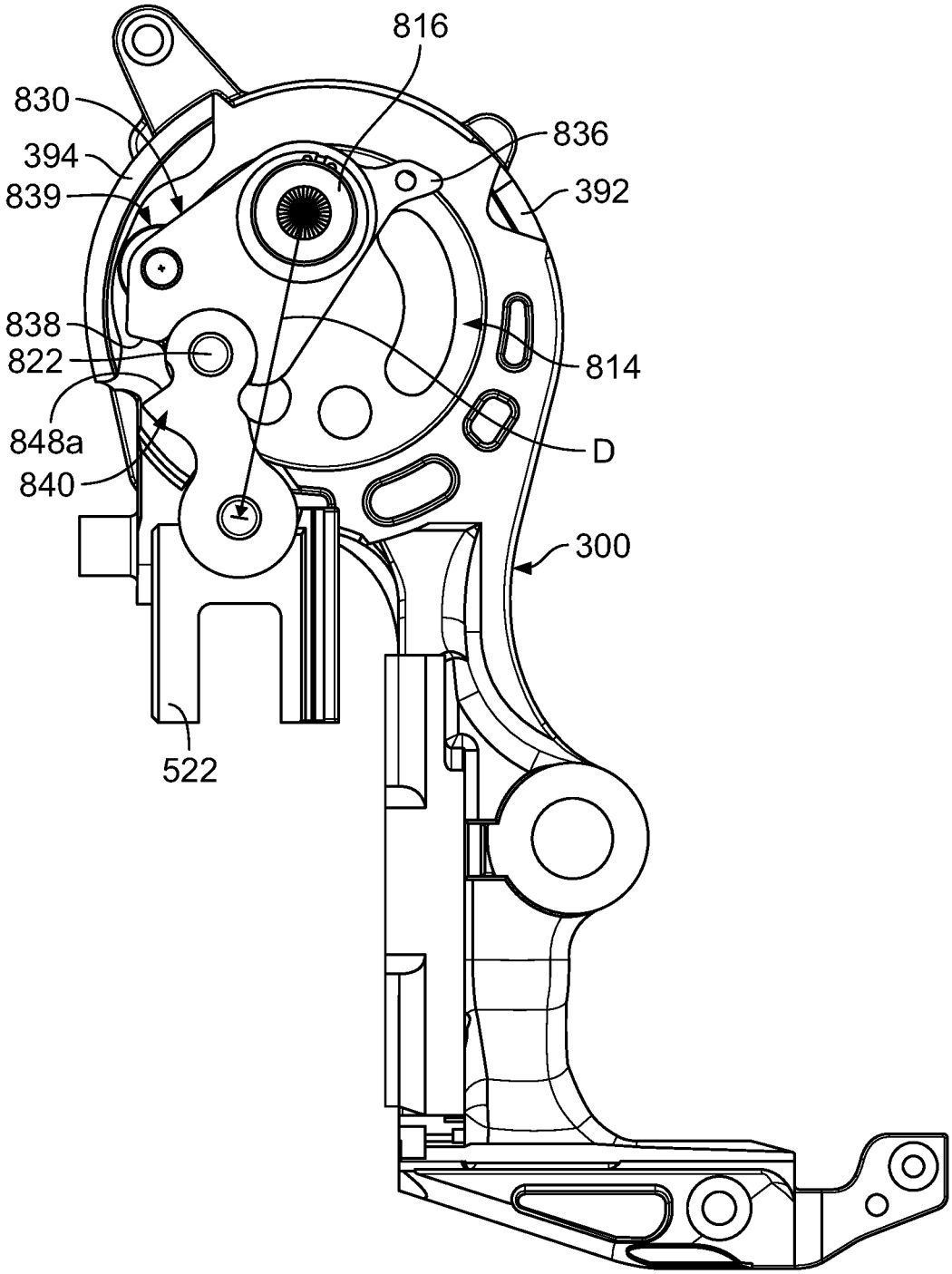
Figure 15D:
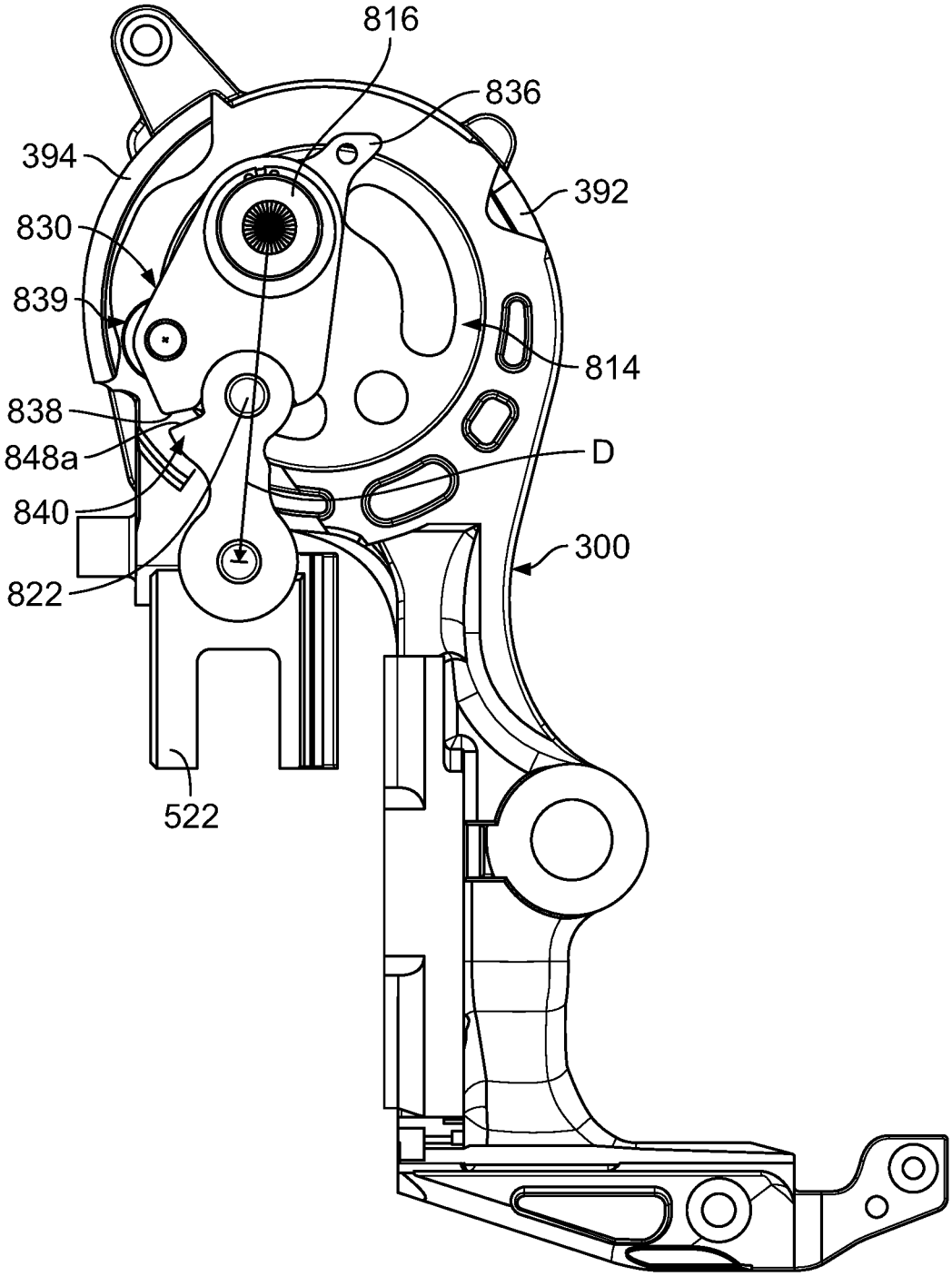
Figure 15E:
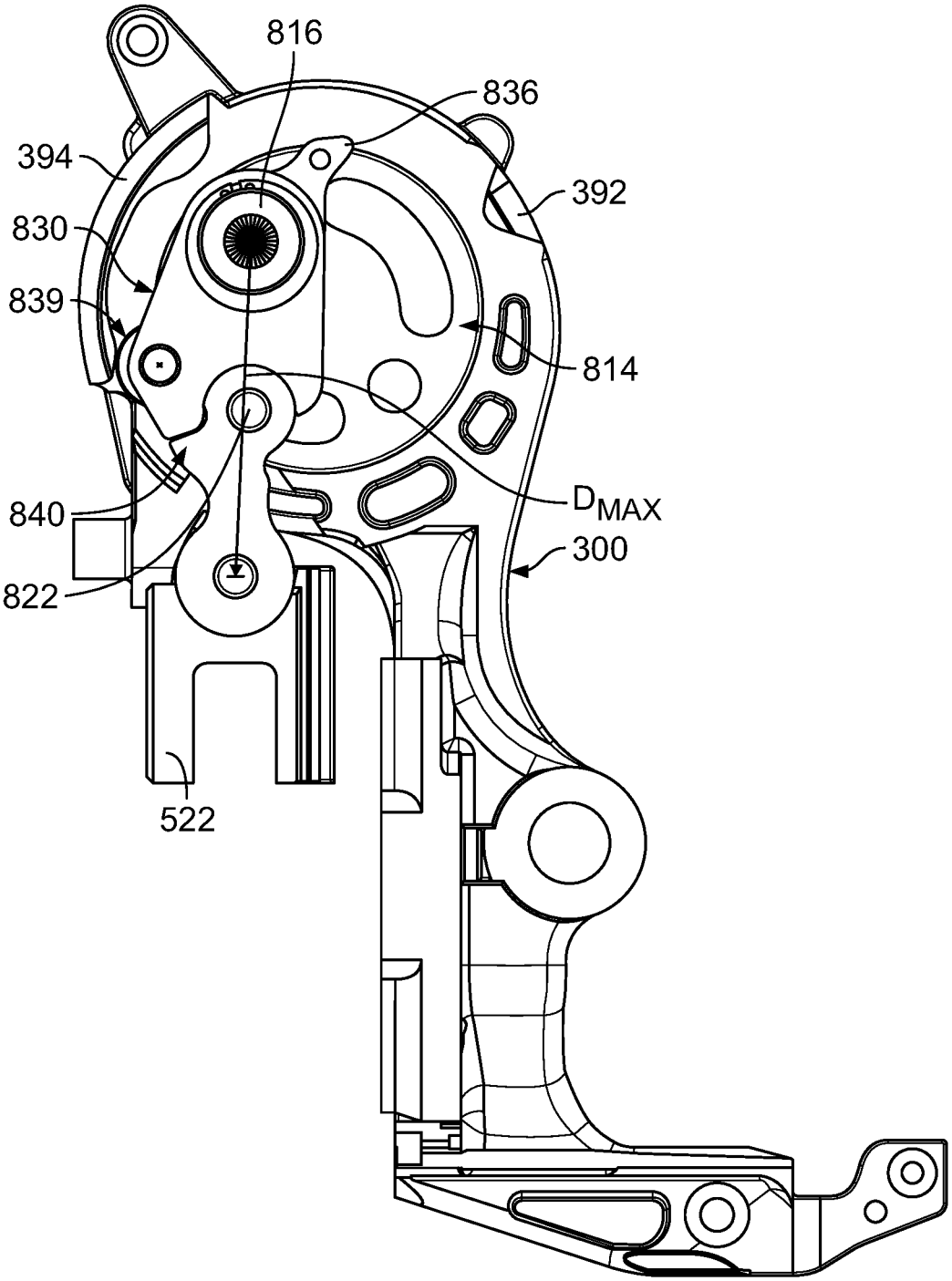
Figure 15F:
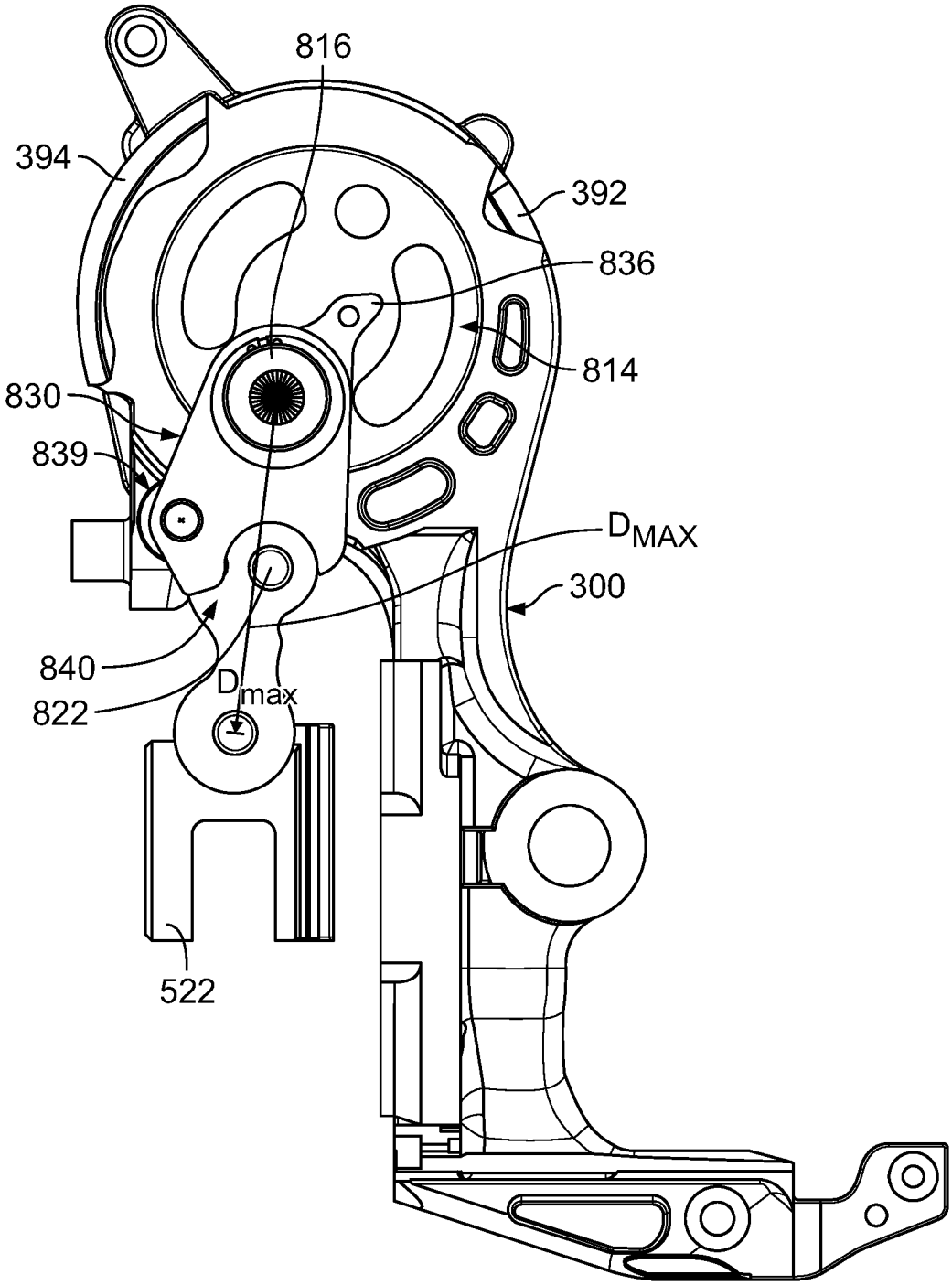

FIGS. 15A-15H illustrate how the components of the conversion assembly 800 cooperate to change the effective length of the linkage 820 during the sealing cycle. At the start of the sealing cycle, the drive wheel 810 and the foot of the linkage 820 are at their respective home positions and the effective length of the linkage 820 is $D_{MIN}$, as shown in FIG. 15A. The drive wheel 810 begins rotating from its home position to its sealing position, carrying the linkage 820 with it. As shown in FIG. 15B, this brings the second support engager 839 into contact with the second linkage engager 394. Continued rotation of the drive wheel 810 causes the first link 830 to rotate counter-clockwise (from the viewpoint shown in FIGS. 15A-15H) relative to the drive wheel 810 and the second link 840, which causes the effective length of the linkage 820 to increase to its maximum $D_{MAX}$ as shown in FIGS. 15C-15E. As shown in FIG. 15E, just as the effective length of the linkage 820 reaches its maximum $D_{MAX}$, the stop fingers 838 of the first link engage the stop surfaces 848*a* of the stop element 848 of the second link 848, which prevents further rotation of the first link 830 relative to the second link 840, and the second support engager 839 disengages the second linkage engager 394. In this example embodiment, the sealing assembly 500 reaches its sealing position and the jaws begin moving from their home positions to their sealing positions before the effective length of the linkage 820 reaches its maximum $D_{MAX}$.

Figure 15G:
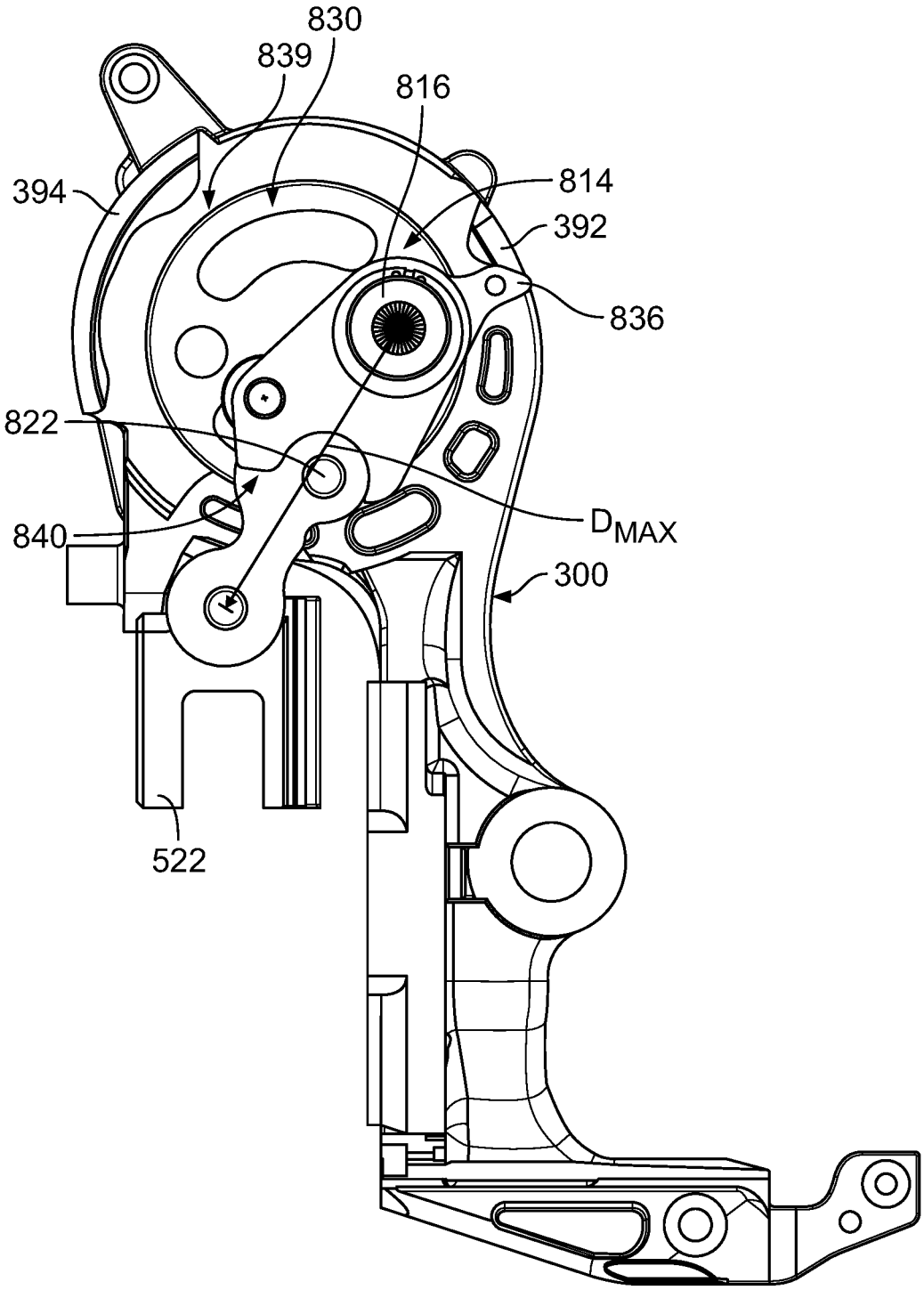
Figure 15H:
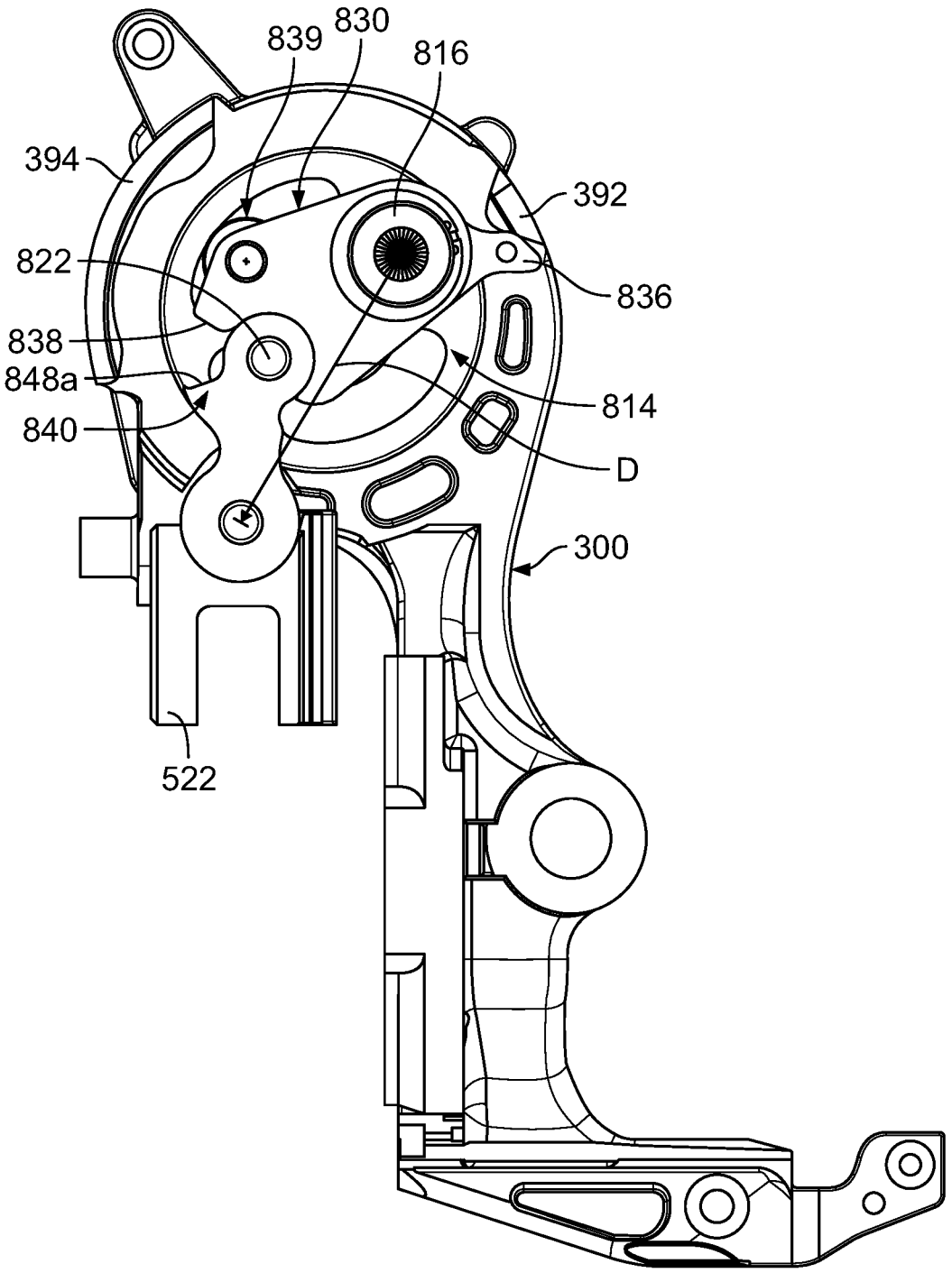

After the effective length of the linkage 820 reaches $D_{MAX}$, as the drive wheel 810 continues to rotate toward its sealing position, the linkage 820 maintains its effective length as the jaws continue moving from their home positions to their sealing positions. In this example embodiment, the jaws begin to contact the seal element (as described in detail below) just as the effective length of the linkage 820 reaches its maximum $D_{MAX}$. FIG. 15F shows the drive wheel 810 at its sealing position, at which point the jaws have also reached their sealing positions and notched the seal element and the strap. Afterwards, continued rotation of the drive wheel 810 brings the first support engager 836 into contact with the first linkage engager 392 of the base 300, as shown in FIG. 15G. As the drive wheel 810 continues to rotate back to its home position, the engagement between the first support engager 836 and the first linkage engager 392 causes the first link 830 to rotate clockwise relative to the drive wheel 810 and the second link 140. As shown in FIG. 15H, this relative rotation of the first link 830 causes the effective length of the linkage 820 to decrease from $D_{MAX}$ to $D_{MIN}$ by the time the drive wheel 810 reaches its home position. In this example embodiment, the sealing assembly 500 reaches its home position just as the effective length of the linkage 820 reaches its minimum $D_{MIN}$.

The timing of movement of the sealing assembly 500 and the jaws relative to the rotation of the drive wheel 810 and the changing effective length of the linkage 820 may differ in other embodiments. For instance, in another embodiment, the sealing assembly 500 reaches its sealing position just as the effective length of the linkage 820 reaches its maximum $D_{MAX}$, after which point the jaws begin moving to their sealing positions.

The display assembly 1300 includes a suitable display screen 1310 with a touch panel 1320. The display screen 1310 is configured to display information regarding the strapping tool 50 (at least in this embodiment), and the touch screen 1320 is configured to receive operator inputs such as a desired strap tension, desired weld cooling time, and the like as is known in the art. A display controller (not shown) may control the display screen 1310 and the touch panel 1320 and, in these embodiments, is communicatively connected to the controller 1300 to send signals to the controller 1300 and to receive signals from the controller 1300. Other embodiments of the strapping tool do not include a touch panel. Still other embodiments of the strapping tool do not include a display assembly.

The actuating assembly 1400 is configured to receive operator input to start operation of the tensioning and sealing cycles. In this example embodiment, the actuating assembly 1400 includes first and second pushbutton actuators 1410 and 1420 that, depending on the operating mode of the strapping tool 50, initiate the tensioning and/or sealing cycles as described below. Other embodiments of the strapping tool 50 do not have an actuating assembly 1400 and instead incorporate its functionality into the display assembly 1300. For instance, in one of these embodiments two areas of the touch panel define virtual buttons that have the same functionality as mechanical pushbutton actuators.

The controller 1600 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping tool 50. The controller 1600 is communicatively and operably connected to the motor 710, the display assembly 1300, the actuating assembly 1400, and the sensor(s) 1700 and configured to receive signals from and to control those components. The controller 1600 may also be communicatively connectable (such as via Wifi, Bluetooth, near-field communication, or other suitable wireless communications protocol) to an external device, such as a computing device, to send information to and receive information from that external device.

The sensors 1700 include any suitable sensors, such as microswitches, optical sensors, ultrasonic sensors, magnetic position sensors, and the like, configured to detect the position of certain components of the strapping tool 50 and to send appropriate signals to the controller 1600. The sensors 1700 include a release sensor 1710 and the home-position sensor 1720. The release sensor 1710 is configured to detect when the rocker lever 910 has begun moving from its home position to its actuated position. More specifically, in this example embodiment the release sensor 1710 includes a microswitch triggered by the rocker-lever gear 930 as the rocker lever 910 begins moving from its home position to its actuated position. The release sensor may be any suitable sensor, such as a motion sensor, and be positioned in any suitable location on the strapping tool.

The controller 1600 is configured to operate the strapping tool in one of three operating modes: (1) a manual operating mode; (2) a semi-automatic operating mode; and (3) a sealing-cycle-interrupt operating mode.

In the manual operating mode, the controller 1600 operates the motor 710 to cause the tension wheel 440 to rotate responsive to the first pushbutton actuator 1410 being actuated and maintained in its actuated state. The controller 1600 operates the motor 710 to cause the sealing assembly 500 to carry out the sealing cycle responsive to the second pushbutton actuator 1420 being actuated.

In the semi-automatic operating mode, the controller 1600 operates the motor 710 to cause the tension wheel 440 to rotate responsive to the first pushbutton actuator 1410 being actuated and maintained in its actuated state. Once the controller 1600 determines that the tension in the strap reaches the (preset) desired strap tension, the controller 1600 automatically operates the motor to cause the sealing assembly 500 to carry out the sealing cycle (without requiring additional input from the operator).

Figure 19:
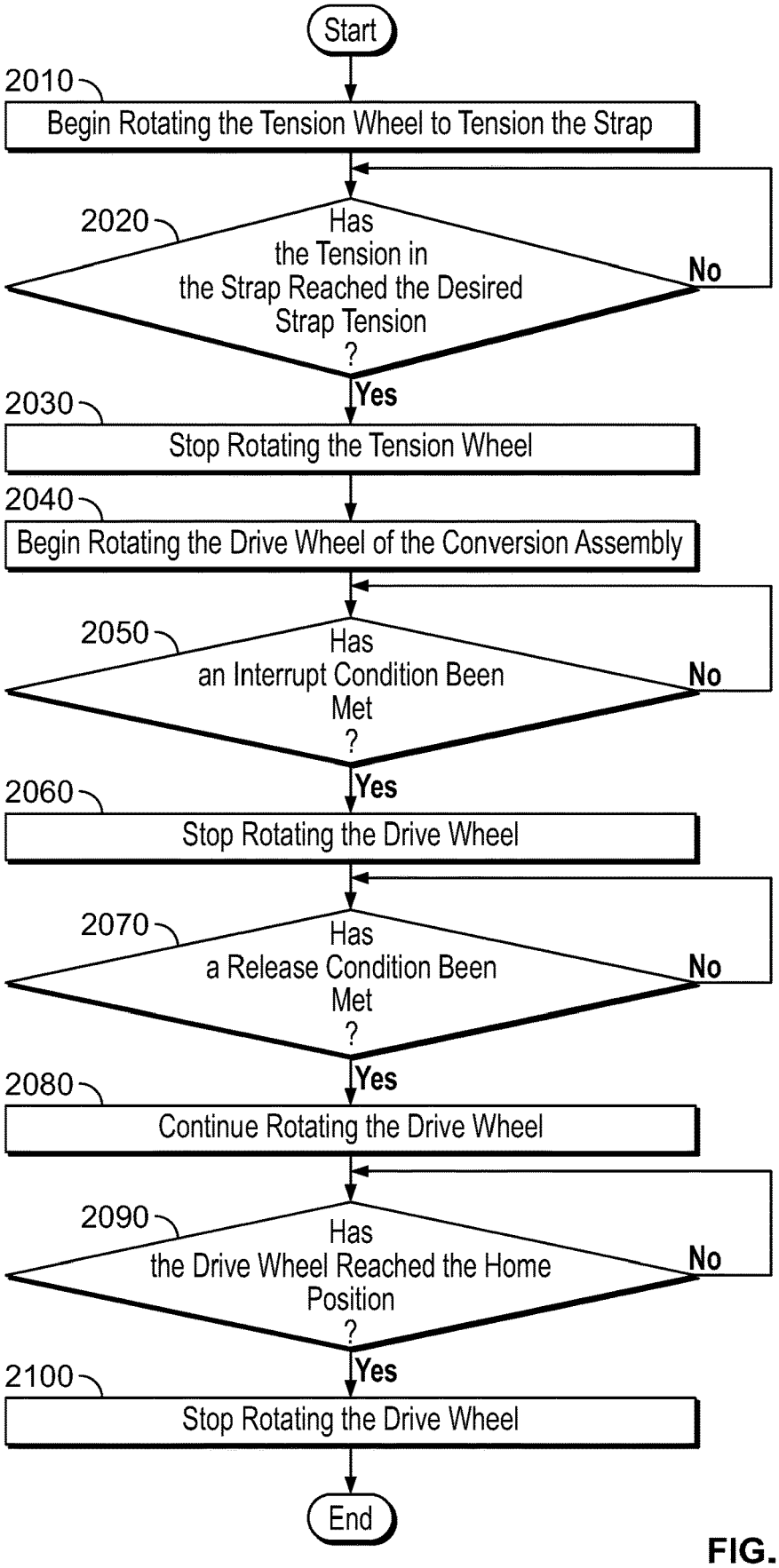
FIG. 19 is a flowchart showing a method of operating the strapping tool of FIGS. 1A and 1B in a sealing-cycle-interrupt operating mode.

FIG. 19 is a flowchart showing a process 2000 for operating the strapping 50 in the sealing-cycle-interrupt operating mode. The process 2000 starts responsive to the first pushbutton actuator 1410 being actuated. Once this occurs, the controller 1600 operates the motor 710 to cause the tension wheel 440 to begin rotating to tension the strap, as block 2010 indicates. The controller 1600 determines at diamond 2020 whether the tension in the strap has reached the (preset) desired strap tension. Once the controller 1600 determines that the tension in the strap has reached the desired strap tension, the controller 1600 stops the motor 710 to cause the tension wheel 440 to stop rotating, as block 2030 indicates.

Without additional input from the operator, the controller 1600 controls the motor 710 to cause the drive wheel 810 of the conversion assembly 800 to begin rotating from its home position toward its sealing position, as block 2040 indicates. The controller 1600 determines at diamond 2050 whether an interrupt condition has been met. In this example embodiment, the interrupt condition is met when the drive wheel 810 reaches the sealing-cycle-interrupt position. Once the controller 1600 determines that the interrupt condition has been met (here, that the drive wheel 810 has reached the sealing-cycle-interrupt position), the controller 1600 stops the motor 710 to cause the drive wheel 810 to stop rotating, as block 2060 indicates. At this point: (1) the sealing assembly 500 has moved from its home position to its sealing position; and (2) the jaws 530, 534, 538, and 542 have pivoted from their respective home positions to their respective sealing positions to cut notches into the seal element and the strap and back outward to their respective sealing-cycle-interrupt positions such that the lower teeth of the jaws pin the seal element and the strap against the support surfaces 546*s*, 552*s*, and 566*s* of the jaw connectors 540, 550, and 560 of the sealing assembly 500. This prevents the strapping tool from being inadvertently removed from the strap, such as by falling off of the strap if the operator releases the strapping tool during the strapping cycle.

The controller then determines at diamond 2070 whether a release condition has been met. In this example embodiment, the release condition is met when the release sensor 1710 is triggered. Once the controller 1600 determines that the release condition has been met (here, that release sensor 1710 has been triggered), the controller 1600 controls the motor 710 to cause the drive wheel 810 to continue rotating back toward its home position, as block 2080 indicates. The controller determines at diamond 2090 whether the drive wheel 810 has reached its home position, as diamond 2090 indicates. Once the controller 1600 determines that the drive wheel 810 has returned to its home position, the controller 1600 controls the motor 710 to cause the drive wheel 810 to stop rotating, as block 2100 indicates, and the process 2000 ends.

In certain embodiments, the controller 1600 is configured to operate the strapping tool in an automatic operating mode, which is similar to the sealing-cycle-interrupt operating mode but which does not interrupt the sealing cycle. Specifically, in the automatic operating mode, the controller 1600 operates the motor 710 to cause the tension wheel 440 to rotate responsive to the first pushbutton actuator 1410 being actuated. Once the controller 1600 determines that the tension in the strap reaches the (preset) desired strap tension, the controller 1600 automatically operates the motor to cause the sealing assembly 500 to carry out the entire sealing cycle (without requiring additional input from the operator).

The power supply 1500 is electrically connected to (via suitable wiring and other components) and configured to power several components of the strapping tool 50, including the motor 710, the display assembly 1300, the actuating assembly 1400, the controller 1600, and the sensor(s) 1700. The power supply 1500 is a rechargeable battery (such as a lithium-ion or nickel cadmium battery) in this example embodiment, though it may be any other suitable electric power supply in other embodiments. The power supply 1500 is sized, shaped, and otherwise configured to be received in a receptacle (not labeled) defined by the housing 100. The strapping tool 50 includes one or more battery-securing devices (not shown) to releasably lock the power supply 1500 in place upon receipt in the receptacle. Actuation of a release device of the strapping tool 50 or the power supply 1500 unlocks the power supply 1500 from the housing 100 and enables an operator to remove the power supply 1500 from the housing 100.

Use of the strapping tool 50 to carry out a strapping cycle including: (1) a tensioning cycle in which the strapping tool 50 tensions a strap S around a load L; and (2) a sealing cycle in which the strapping tool 50 notches both a seal element SE positioned around overlapping top and bottom portions of the strap S and the top and bottom portions of the straps themselves and cuts the strap from the strap supply is described in accordance with FIGS. 17A-17C. Initially: the tensioning assembly 400 is in its strap-tensioning position; the sealing assembly 500 is in its home position; the jaws are in their respective home positions; the drive wheel 810 is in its home position; and the rocker lever 910 is in its home position. The strapping tool 50 is in the sealing-cycle-interrupt operating mode for the purposes of this example.

Figure 16:
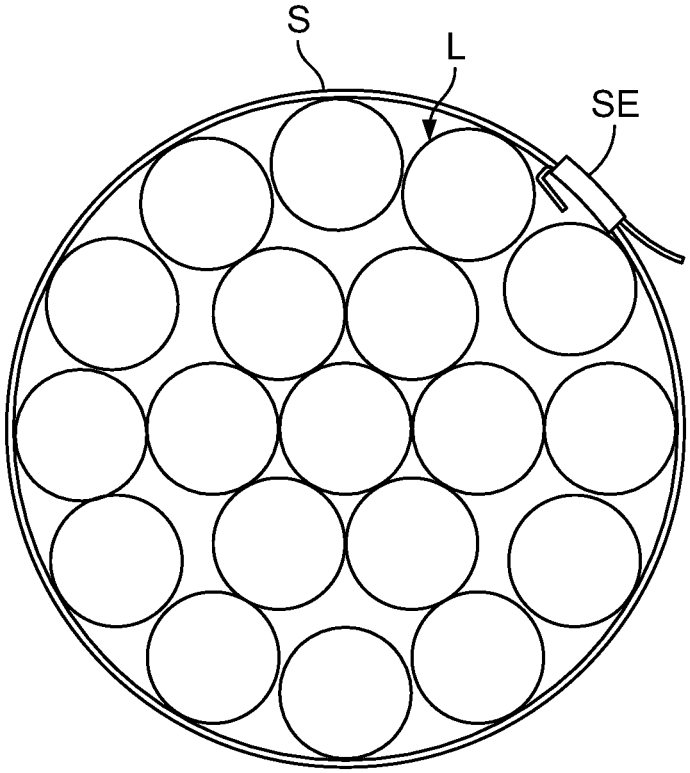
FIG. 16 is a diagrammatic elevational view of the strap and the seal element positioned around a load before being tensioned and sealed by the strapping tool.

The operator pulls the strap S leading-end first from a strap supply (not shown) and threads the leading end of the strap S through the seal element SE. While holding the seal element SE, the operator wraps the strap around the load L and positions the leading end of the strap S below another portion of the strap S, and again threads the leading end of the strap S through the seal element SE. Afterwards, the seal element SE is positioned around overlapping top and bottom portions of the strap S. The operator then bends the leading end of the strap S backward, slides the seal element SE along the strap S until it meets the bend, and pulls the strap through the seal element to eliminate the slack. FIG. 16 shows the position of the bend and the seal element SE at this point.

The operator then pulls the rocker lever 910 from its home position to its actuated position, which pivots the tensioning assembly 400 from its strap-tensioning position to its strap-insertion position. While holding the rocker lever 910 in its actuated position, the operator introduces the top portion of the strap S rearward of the seal element SE into the strap-receiving opening so the top portion of the strap S is between the tension wheel 440 and the roller 380 of the foot 320 of the support 300. With the seal element SE in place, the operator releases the rocker lever 910, and the appropriate biasing elements force the rocker lever 910 back to its home position and the tensioning assembly 400 to its strap-tensioning position. This causes the tension wheel 440 to engage the top portion of the strap S and pinch it against the roller 380. At this point the bottom portion of the strap S is beneath the foot 320.

The operator then actuates the first pushbutton actuator 1410 to initiate the strapping cycle. In response the controller 1600 starts the tensioning cycle by controlling the motor 710 to begin rotating the motor output shaft 712 in the first rotational direction, which causes the tension-wheel shaft 428*b* and tension wheel 440 thereon to begin rotating. As the tension wheel 440 rotates, it pulls on the top portion of the strap S, thereby tensioning the strap S around the load L. Throughout the tensioning cycle, the controller 1600 monitors the current drawn by the motor 710. When this current reaches a preset value that is correlated with the (preset) desired strap tension for this strapping cycle, the controller 1600 stops the motor 710, thereby terminating the tensioning cycle.

The controller 1600 then automatically starts the sealing cycle by controlling the motor 710 to begin rotating the motor output shaft 712 in the second rotational direction. As described in detail above, this causes the sealing assembly 500 to move to its sealing position. After the sealing assembly 500 reaches its sealing position, the jaws pivot from their respective home positions to their respective sealing positions to cut notches in the seal element SE and the top and bottom portions of the strap S within the seal element SE, as shown in FIG. 17C. While this is occurring, the controller 1600 is monitoring the position of the drive wheel 810 and, particularly monitoring for the drive wheel 810 reaching its sealing-cycle-interrupt position. Once the controller 1600 determines that the drive wheel 810 has reached its sealing-cycle-interrupt position (either via a dedicated sensor, via an encoder of the motor 710, or any other suitable manner), the controller stops the motor 710. At this point, the jaws are in their sealing-cycle-interrupt positions and pin the seal element SE and the strap S against the support surfaces of the jaw connectors. This effectively locks the strapping tool 50 onto the seal element SE and the strap S and prevents the operator from removing the strapping tool 50 from the seal element SE and the strap S.

Figure 18:
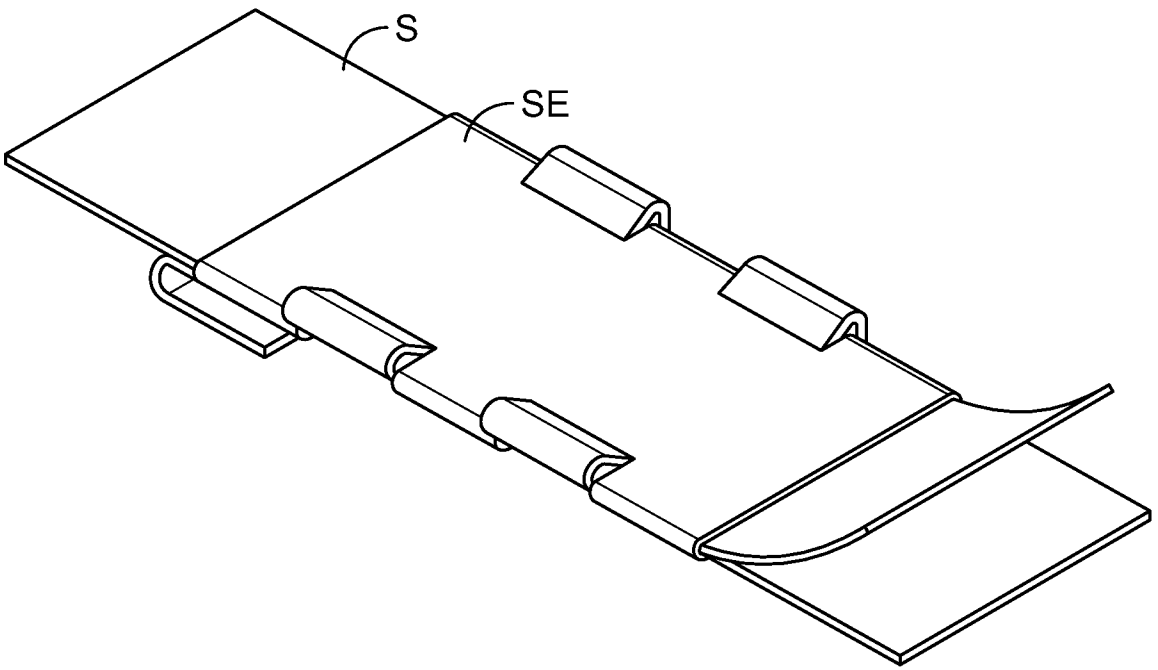
FIG. 18 is a perspective view of the notched seal element.

Afterwards, the controller 1600 monitors for triggering of the release sensor 1710, which in this embodiment occurs as the rocker lever 910 is moved from its home position toward its actuated position. After the operator begins moving the rocker lever 910 from its home position toward its actuated position—thereby triggering the release sensor—the controller 1610 completes the sealing cycle by controlling the motor 710 to continue rotating the motor output shaft 712 in the second rotational direction until it returns to its home position. As this occurs, the jaws pivot back to their respective home positions and the sealing assembly 500 slides back to its home position to enable the strapping tool 50 to be removed from the strap S. FIG. 18 shows the notched seal element SE and strap S.

In certain embodiments, the controller monitors for the interrupt condition for a designated time period. If the interrupt condition is not met during that designated time period, the controller stops rotating the drive wheel and displays an error message on the display device.

In various embodiments, the controller monitors for the release condition for a designated time period. If the release condition is not met during that designated time period, the controller displays an error message on the display device. In other embodiments, the controller monitors for the release condition for a first designated time period. If the release condition is not met during that first designated time period, the controller causes an alert, such as a displayed message on the display device or an audible tone, to be output. If the release condition is still not met following expiration of a second designated time period, the controller displays an error message on the display device.

In certain embodiments, the strapping tool includes an operator sensor configured to detect whether an operator is holding the strapping tool. In some of these embodiments, the operator sensor includes a touch or tactile sensor (such as a capacitive or infrared sensor) or a mechanical switch positioned on the first handle of the housing and configured to detect the operator's hand when grasping the first handle, though the operator sensor may be any suitable sensor positioned on any suitable component of the strapping tool. In certain such embodiments, the interrupt condition is met when the drive wheel is in it sealing-cycle-interrupt position while the operator sensor detects that an operator is not holding the strapping tool. In one such embodiment, the controller monitors for the interrupt condition being met for a designated period of time after the jaws have reached their respective jaw sealing positions. If the interrupt condition is met during the designated period of time, the controller stops rotating the drive wheel and does not resume until the release condition is met. In some embodiments, the release condition is met when the operator sensor detects that the operator is holding the strapping tool. If the interrupt condition is not met during the designated period of time, the controller does not stop rotating the drive wheel until it reaches its home position. Put differently, in this particular embodiment, the controller does not interrupt the sealing cycle if the operator is holding the strapping tool.

In various embodiments, the strapping tool includes a tool-orientation sensor, such as a gyroscope, configured to detect the orientation of the tool. In these embodiments, the controller only monitors for the interrupt condition if the tool-orientation sensor detects that the tool is oriented in any position other than an upright position in which the foot of the support is resting atop the load to-be-strapped.

Although the sealing assembly comprises jaws configured to cut into seal elements to attach two portions of the strap to itself, the sealing assembly may comprise other sealing mechanisms in other embodiments, such as jaws configured to crimp the seal element and the strap.

The above-described example embodiment of the strapping tool includes a single motor configured to drive both the tensioning assembly and the sealing assembly. In other embodiments, the strapping tool includes separate motors configured to drive the respective tensioning and sealing assemblies.

The above-described example embodiment of the strapping tool includes a tensioning assembly and a sealing assembly. In other embodiments, the strapping tool only includes a sealing assembly.

The invention claimed is:

1. A strapping device comprising:

a sealing assembly comprising a jaw connector defining a support surface and opposing first and second jaws comprising respective teeth, wherein the first jaw is pivotable relative to the jaw connector and the second jaw between a first jaw home position and a first jaw sealing position, wherein the second jaw is pivotable relative to the jaw connector and the first jaw between a second jaw home position and a second jaw sealing position, and wherein a strap path is defined between the first and second jaws and the support surface;

a motor operably connected to the sealing assembly and configured to pivot the first jaw between the first jaw home position and the first jaw sealing position and the second jaw between the second jaw home position and the second jaw sealing position; and a controller operably connected to the motor and configured to, responsive to receipt of an input:

control the motor to pivot the first and second jaws to the first and second jaw sealing positions; and responsive to an interrupt condition being met based on the first and second jaws reaching first and second sealing-cycle-interrupt positions:

control the motor to stop pivoting the jaws; and responsive to a release condition being met after the interrupt condition is met, control the motor to pivot the first and second jaws to the first and second jaw home positions.

2. The strapping device of claim 1, wherein the first sealing-cycle-interrupt position is between the first jaw home position and the first jaw sealing position, and wherein the second sealing-cycle-interrupt position is between the second jaw home position and the second jaw sealing position.

3. The strapping device of claim 1, wherein the sealing assembly further comprises a rotatable drive wheel operably connected to the first and second jaws to pivot the first jaw between the first jaw home position and the first jaw sealing position and the second jaw between the second jaw home position and the second jaw sealing position, wherein the motor is operably connected to the drive wheel and configured to rotate the drive wheel.

4. The strapping device of claim 3, wherein the drive wheel has a home position, a sealing position, and a sealing-cycle-interrupt position, wherein the first and second jaws are in the first and second jaw home positions when the drive wheel is in the home position, wherein the first and second jaws are in the first and second jaw sealing positions when the drive wheel is in the sealing position, and wherein the first and second jaws are in the first and second sealing-cycle-interrupt positions when the drive wheel is in the sealing-cycle-interrupt position.

5. The strapping device of claim 4, further comprising one or more drive-wheel-position sensors configured to sense when the drive wheel is in at least one of: the home position and the sealing-cycle-interrupt position.

6. The strapping device of claim 4, further comprising a support, wherein the sealing assembly is mounted to the support and movable relative to the support between a sealing-assembly home position and a sealing-assembly sealing position.

7. The strapping device of claim 6, wherein the support is in the sealing-assembly home position when the drive wheel is in the home position, and wherein the support is in the sealing-assembly sealing position when the drive wheel is in the sealing position and the sealing-cycle-interrupt position.

8. The strapping device of claim 4, wherein the sealing position of the drive wheel is different from the sealing-cycle-interrupt position of the drive wheel.

9. The strapping device of claim 4, wherein the sealing position of the drive wheel is the same as the sealing-cycle-interrupt position of the drive wheel.

10. The strapping device of claim 1, further comprising a release sensor, wherein the release condition is met when the release sensor is triggered.

11. The strapping device of claim 10, further comprising:

a support to which the sealing assembly is mounted;

a tensioning assembly mounted to the support and pivotable relative to the support and about a tensioning-assembly pivot axis between a strap-tensioning position and a strap-insertion position; and an actuator operably connected to the tensioning assembly and pivotable from a home position to an actuated position to cause the tensioning assembly to move from the strap-tensioning position to the strap-insertion position, wherein the release sensor is positioned to be triggered as the actuator lever moves from the home position to the actuated position.

12. The strapping device of claim 1, wherein the first sealing-cycle-interrupt position is the same as the first jaw sealing position, and wherein the second sealing-cycle-interrupt position is the same as the second jaw sealing position.

13. A method of operating a strapping device including a sealing assembly comprising a jaw connector defining a support surface and opposing first and second jaws comprising respective teeth, wherein the first jaw is pivotable relative to the jaw connector and the second jaw between a first jaw home position and a first jaw sealing position, wherein the second jaw is pivotable relative to the jaw connector and the first jaw between a second jaw home position and a second jaw sealing position, and wherein a strap path is defined between the first and second jaws and the support surface, the method comprising:

when a seal element positioned around two overlapping portions of strap is positioned in the strap path, pivoting the first and second jaws to the first and second jaw sealing positions such that the teeth of the first and second jaws deform the seal element and the overlapping portions of strap;

responsive to an interrupt condition being met, stop pivoting the first and second jaws such that the seal element is trapped between the teeth of the first and second jaws and the support surface of the jaw connector; and responsive to a release condition being met after the interrupt condition is met, pivoting the first and second jaws to the first and second jaw home positions.

14. The method of claim 13, wherein pivoting the first and second jaws to the first and second jaw sealing positions such that the teeth of the first and second jaws deform the seal element and the overlapping portions of strap comprises pivoting the first and second jaws to the first and second jaw sealing positions such that the teeth of the first and second jaws cut notches into the seal element and the overlapping portions of strap.

15. The method of claim 13, further comprising tensioning the strap around a load before pivoting the first and second jaws to the first and second jaw sealing positions.

16. The method of claim 15, wherein the strapping device further comprises a support to which the sealing assembly is mounted; a tensioning assembly mounted to the support and pivotable relative to the support and about a tensioning-assembly pivot axis between a strap-tensioning position and a strap-insertion position; an actuator operably connected to the tensioning assembly and pivotable from a home position to an actuated position to cause the tensioning assembly to move from the strap-tensioning position to the strap-insertion position; and a release sensor positioned to be triggered as the actuator moves from the home position to the actuated position, wherein the release condition is met when the release sensor is triggered.

17. The method of claim 16, wherein the interrupt condition is met when the first and second jaws reach first and second sealing-cycle-interrupt positions, respectively, between the first and second jaw home and jaw sealing positions, respectively.

18. A strapping device comprising:

a sealing assembly comprising a jaw connector defining a support surface and opposing first and second jaws comprising respective teeth, wherein the first jaw is pivotable relative to the jaw connector and the second jaw between a first jaw home position and a first jaw sealing position, wherein the second jaw is pivotable relative to the jaw connector and the first jaw between a second jaw home position and a second jaw sealing position, and wherein a strap path is defined between the first and second jaws and the support surface;

a motor operably connected to the sealing assembly and configured to pivot the first jaw between the first jaw home position and the first jaw sealing position and the second jaw between the second jaw home position and the second jaw sealing position;

a release sensor; and a controller operably connected to the motor and configured to, responsive to receipt of an input:

control the motor to pivot the first and second jaws to the first and second jaw sealing positions; and responsive to an interrupt condition being met:

control the motor to stop pivoting the jaws; and responsive to the release sensor being triggered after the interrupt condition is met, control the motor to pivot the first and second jaws to the first and second jaw home positions.

19. The strapping device of claim 18, further comprising:

a support to which the sealing assembly is mounted;

a tensioning assembly mounted to the support and pivotable relative to the support and about a tensioning-assembly pivot axis between a strap-tensioning position and a strap-insertion position; and an actuator operably connected to the tensioning assembly and pivotable from a home position to an actuated position to cause the tensioning assembly to move from the strap-tensioning position to the strap-insertion position, wherein the release sensor is positioned to be triggered as the actuator moves from the home position to the actuated position.

* * * * *